US007101293B2

(12) United States Patent
Tarng et al.

(10) Patent No.: US 7,101,293 B2
(45) Date of Patent: Sep. 5, 2006

(54) GOLH: THE GOLF HYBRID SPORT OF GOLFRISBEE

(75) Inventors: Min Ming Tarng, San Jose, CA (US); Mei Jech Lin, San Jose, CA (US); Eric Yu-Shiao Tarng, San Jose, CA (US); Alfred Yu-Chih Tarng, San Jose, CA (US); Angela Yu-Shiu Tarng, San Jose, CA (US); Jwu-Ing Tarng, San Jose, CA (US); Huang-Chang Tarng, San Jose, CA (US); Shun-Yu Nieh, San Jose, CA (US)

(73) Assignee: TANG System Golh:Golfish, Golfrisbee, Golhunting, San Jose, CA (US)

( * ) Notice: Subject to any disclaimer, the term of this patent is extended or adjusted under 35 U.S.C. 154(b) by 0 days.

(21) Appl. No.: 10/842,739

(22) Filed: May 10, 2004

(65) Prior Publication Data

US 2004/0209712 A1 Oct. 21, 2004

Related U.S. Application Data

(63) Continuation-in-part of application No. 10/091,984, filed on Mar. 6, 2002, now abandoned.

(51) Int. Cl.
*A63B 67/00* (2006.01)

(52) U.S. Cl. ..... 473/446; 473/588; 273/400

(58) Field of Classification Search ..... 473/465, 473/588, 590; 124/5; 446/47, 46; 273/348.4, 273/400

See application file for complete search history.

(56) References Cited

U.S. PATENT DOCUMENTS 4,039,189 A * 8/1977 Headrick et al. ..... 273/400
6,106,355 A * 8/2000 Hoerner ..... 446/46
6,193,620 B1 * 2/2001 Tarng ..... 437/465
6,834,858 B1 * 12/2004 Reineke ..... 273/400

OTHER PUBLICATIONS

Webpage download, United States Golfrisbee, Mar. 30, 2006, www.alibaba.com/catalog/11254104/Golfrisbee.html, 2 pages.*

Webpage download, Golfrisbee, Oct. 16, 2002, www.geocities.com/tangsystem, 4 pages.*

Webpage download, Golfrisbee Market Analysis, Feb. 11, 2002, www.geocities.com/tangsystem/Gofrisbee_Market.html, 9 pages.*

* cited by examiner

*Primary Examiner*—Eugene Kim
*Assistant Examiner*—M. Chambers

(57) ABSTRACT

The golh sport is comprised of the golh club, golfrisbee disc and golfrisbee basket. Swiveling the golh club, the flying object such as golfrisbee disk is thrown to fly into the golfrisbee basket. The golfrisbee basket has the wind-bell-chain reverted umbrella structure to protect the golfrisbee from damage. The flying object has many types such as the golfball, golfrisbee disk, golfring, diskring, boomerang, polygon boomerang, multi-boomerang ring, multi-boomerang diskring, etc. Golh is the hybrid golf comprising the flying golfrisbee and the golf ball. Basedisc is the golfrisbee sport following the similar game rules of baseball. The core technologies are the swiveling club throwing technology, wind-bell-chain reverted-umbrella golfrisbee basket and the universal direction wing flying disk technology. The golh system comprises the golh club, golfrisbee, golfrisbee basket, portable hole, golh lubricant, golh cart, golh trolley, golh bag, golh swing trainer, and the manufacture processes to be an integrated system package.

20 Claims, 81 Drawing Sheets

151
15
12
13

1511
151
1521
15
12
13
152

151
15a
12
13
153
151a 5
2
3
34p
34
36

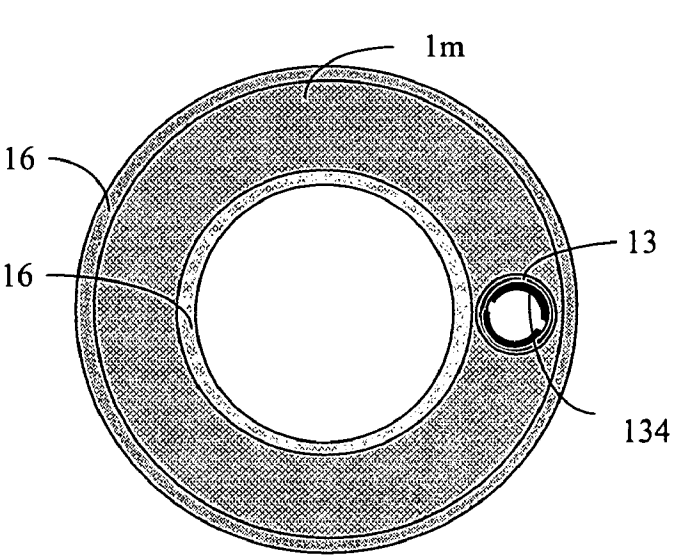
FIG.44B
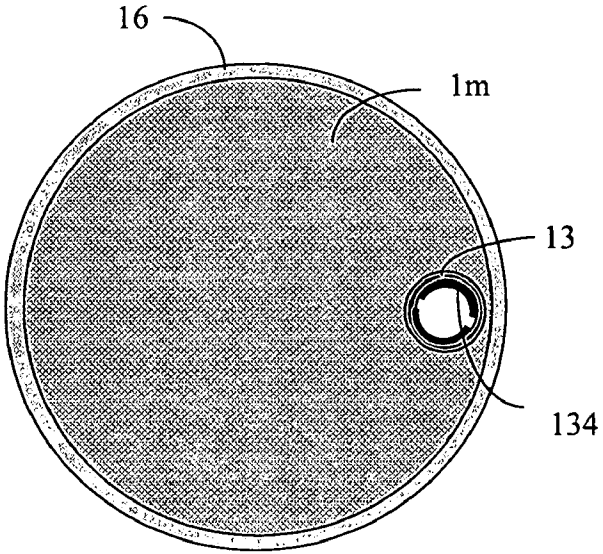
FIG.44A
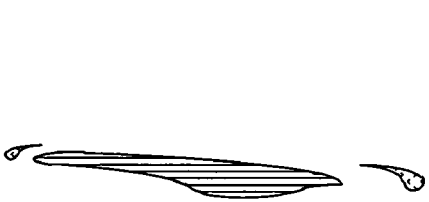
FIG.44C
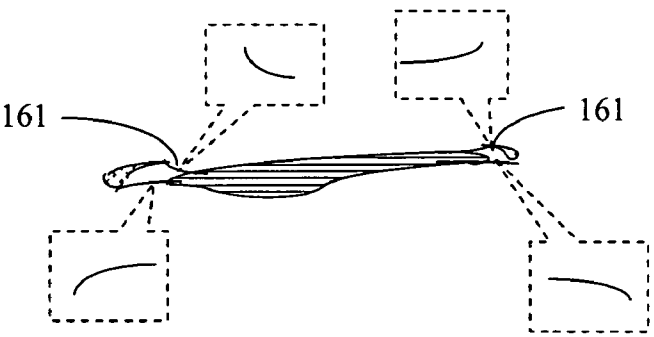

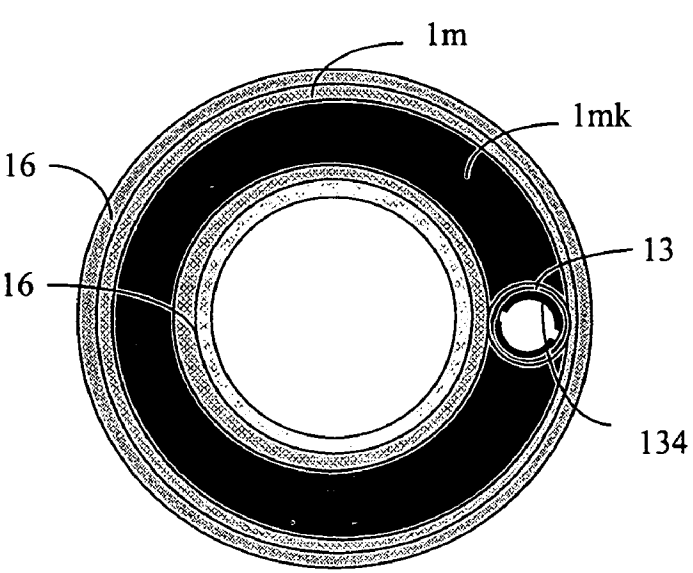
FIG.47B
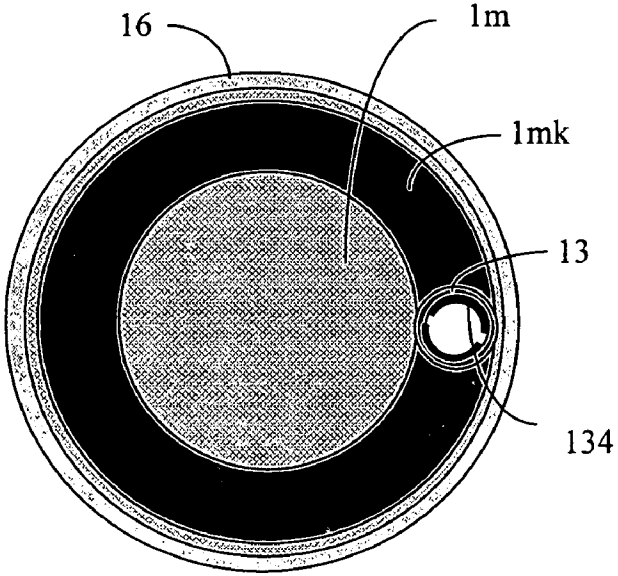
FIG.47A
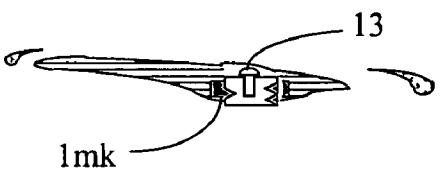
FIG.47C
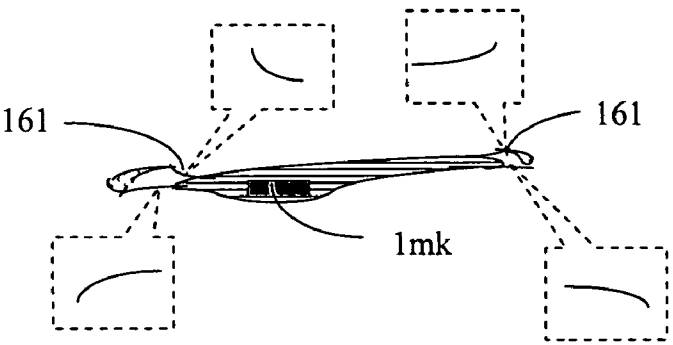

GOLH: THE GOLF HYBRID SPORT OF GOLFRISBEE

This is a Continuation in Part application claims priority of U.S. patent application Ser. No. 10/091,984, filed Mar. 6, 2002, now abandoned, which herein incorporated by reference in its entirety.

BACKGROUND FIELD OF INVENTION

Golh sports are the sports for the 21 st century. The golher plays the golfrisbee on the golfrisbee course according to the golf rules. As shown in FIG. 1A, FIG. 2A, FIG. 2Q and FIG. 2R, golhers swivel the golh club 2 to launch the golfrisbee disk 1 to fly into the golfrisbee basket 18. The core technologies of golh sport are golfrisbee 1, golh club 2 and golfrisbee basket 18.

As shown in FIG. 1A, the golh is the hybrid golf sport constituted of golfrisbee 1 and golfball 15. The golh sport is to swivel the golh club 2 to launch the golfrisbee 1 to fly and throw the golfball 15. The golfrisbee 1 is thrown into the golfrisbee basket 18 with the golh club 2. The flag 18*f* is at the top of the golfrisbee basket 18. The flag 18*f* is not only to mark the destination and basket/hole number but also to be the indication of the wind direction and wind speed. The golh player needs to adjust the way to throw the golfrisbee to compensate the influence of the wind direction and wind speed. The golfball 15 is to be thrown to the hole then putt the ball 151 to roll into the hole or portable hole 6 with the golh club. The golh is the long drive of golf playing with the golfrisbee disk 1 and golfball 15. The flying distance of the golfrisbee 1 is compatible with the conventional golf ball.

The golfrisbee 1 throwing process is more like the hand-throwing disk. It looks beautiful just like the ballet dancer spinning on the stage. Therefore, we refer the golfrisbee to be the ballet in the sky. The sports of golh, handisc, and basedisc, etc are the new sports derived from our inventions golfrisbee and golfball.

The golfrisbee has the soft-landing essential characteristic which makes it is safe to play golfrisbee in the park. Playing in the golh course, multiple groups of golhers can play at the same hole/basket without safety concern. Multiple groups of golhers share the golh course price. Golh does not need the tee-time. It increases the usage of the golh course. It is safe to play golfrisbee in the public park. The golh played in the park is the Park Golh. In the park, the city government pays the green fee and it is free to play the golh in the park. The park golh will make the golh popular. The course golh is Green Golf and the park golh is the Free Golf.

The golh club launches the golfrisbee just as the human hand throws the flying disk. The soft-landing is the essential characteristics of the flying disk. Therefore, there is no impact force applied to the flying disk in both the launching and landing process. The golh can play the long drive in the golh course during the darkness in the night. We may embed the LED light in the golfrisbee to have the long drive Night Golh/Black Golh and the long drive Snow Golh/White Golh in the field.

To differentiate from the conventional golf sports having no long driving activities, we mention the new golf having the long drive capability with golfrisbee to be the park golh, snow golh and night golh. However, to make the golfers and the golf courses to accept the golh sport, we need to provide the complete golh system package for the golh strategic market.

However, the night golh and the snow golh have the tough times and tough places to play. Therefore, we make the innovation in the golh system pack to meet the challenges of all the tough environments. We make the innovation in golh system technologies based on our invention of golfrisbee. The system pack includes the golh cart, swing trainer, etc. We integrate technologies and make the innovation in system integration to meet the technical challenges in park golh, night golh, ski golh and snow golh to promote the golh sports. Without the innovation of the sporting system integration, the golh sport will not be functional properly. Eventually, as the golhers population increases, the golh will be the dominant sport in the golf course.

BACKGROUND-DESCRIPTION OF PRIOR ART

The prior arts related to golh sport have two: one is golf and the other is disk golf. The golfers and the hand-throwing disk golfers are the potential customers for golh sport. The golh is compatible to golf. The long drive of flying disk is compatible to the long drive of golf ball. The disk golf is to throw the flying disk into the disk golf basket with the hand. Recently, the disk technology has made a lot of progress. They are the Innova disk and the Aerobie flying ring. They make the disk golf sport be possible.

The U.S. Pat. No. 4,568,297 of Innova disk has the flying range of 712 ft. It is a flying disk approved by the Professional Disc Golf Association (PDGA). At the bottom of the disk, the hand-thrown flying disk has the vertical sharp edge to grasp with hand. The sharp vertical straight edge introduces a lot of drag. Outside the vertical sharp edge is the triangular design of the supersonic airfoil. However, the hand-thrown flying disk is always operating in the subsonic speed range. It is not a correct design for the front edge. The triangle is tilt upward. It is not a correct design for the tail end, either. The speed of flying disk is much less than the sonic speed. For the subsonic airfoil design, it does not need the triangle. At the head, the sharp edge does not have the supersonic effect. At the tail, the vertical edge and the upward slope of the triangular design causes the separation of the airflow from the tail fin. It induces a lot of drag to the flying disk. Due to the vertical sharp-edge, the Innova Disk is thrown horizontally. Even worse, the sharp edge of triangular design causes the Innova disk to be unsafe for the park sport. Originally, the flying disk has the benefit to play in the park safely. However, the Innova disk destroyed the park sport benefit. The Innova disk is small and heavy with the sharp edge. The Innova disk is dangerous to the public. You cannot play the Innova disc in the public park. Just as the golf ball is forbidden to play in the park, the disk golf is forbidden to play in the park, too. The disk golf is no more a park sport. Just like the golf, the disk golf has to be played in the disk golf course.

The Guinness World Record set the Aerobic Pro Ring (U.S. Pat. Nos. 4,560,358 and 4,456,265) to be the world farthermost thrown object 1,333 feet. However, it is not the dome-shaped flying disk. It is a flying ring with a flat plate having ring shape. There are two reasons for the ring plate structure to be the farthermost thrown object. The first is the thin profile of the ring plate; the second is the long-range stability. The thin profile has the low drag force. The long-range stability is due to the side stability of the spoiler rim to keep the straight flight. However, the side stability causes the Aerobie Ring not to have the dogleg curving flying capability. The dogleg flying capability is very important in the disk golf course. To have the dogleg curving flying capability, the player needs to bend the fly ring. It is not easy to control the amount of bending to have the desired dogleg curving flying. Furthermore, the inclined edge of the spoiler rim induces the drag at both the front and end edges. It reduces the throwing distance. The thin plate has no proper protection. It easily hurts the other people. Therefore, the Aerobie fly ring uses the composite materials.

The Aerobie Superdisc is the flying disk version of the Aerobie Pro Ring. However, Aerobic Superdisc no longer keeps the thin profile of the ring structure. The Aerobic Superdisc has the inclined curved edge with the dotted surface to increase the friction for handholding. At the edge, it also has the spoiler rim for stable flight. The spoiler rim is more like the upright directional wing of the airplane or the damping board of the boat. However, it induces many other drawbacks. At the leading edge, the spoiler rim will induce the separation of the boundary layer on the top of the flying disk. At the tailing edge, the spoiler rim will induce the separation of the flow from the soft cushion tail fin. The throwing distance is small due to the separation of the flow Golf is the national sport of US. It is the representative sport of the capitalism. The high-flying golf ball is dangerous that the golf is not allowed to be played in the park. In the private golf course, the golfers need to pay the green fee for the green grass. It causes the high operation cost of the golf course that golh is the rich people sport. However, it becomes the critics and hatred target of the poor people in the world. Before, we do not care. After 911, we must consider that it is time for us to change the style of the golf sport. After 911, all the Americans are confused why the other worlds hate us so much? Golf sport is the representative for the hatred and is attacked by the outside western and well-developed countries. To the eyes of the poor people, the golf is the rich people sport. One-round of 18-hole play cost at least $30.00, even more. It is the monthly living fee of the poor people. With the addition of the caddy fee, the poor people cannot imagine to join the golf sport in all his life. No wonder the golf represents the wealthy people sport to be the hatred for the poor people. Due to the hatred caused by envy, the golf is still rejected to be the sport of the Olympic sport even though it is so popular in US.

Why does the golf cost so much? The long drive of the golf ball causes all the problems. It causes the extreme low rate of the usage of the golf course. The low rate of usage of the golf course causes the high cost of golf sport. Why does the golf course have such a low rate of usage?

(i) The highflying golf ball is very dangerous that the golf cannot be played in the public park. It can only be played in the private golf course. Even in the private golf course, the highflying golf ball of the multiple groups of golfers will hit on each other and hurt each other. The golf cannot have multiple groups playing at the same time. For the safety reasons, golf has the Tee-Time regulation. At any time, only one group can play at one hole place of the golf course.

(ii) The long drive of golf cannot be played in the winter snow course. On the thick snow, there is no solid ground to place the tee. The golf ball has to be played on the snow directly. As the swiveling golf club hits the ball, the snow powders will sprays everywhere that you can not see where the golf ball flies. Even worse, as the highflying golf ball falls on the snow, the golf ball punches the snow pile and is buried in the snow. The golf ball disappears in the snow golf course. The golfer can never find the golf ball until the snow melts in the next spring. Therefore, there is no long drive in the snowy golf course. The golf course needs to shut down in the snowy winter season.

(iii) There is no night golf or after hour golf. During the golf club swing, the golf ball is hit by the golf club seriously. As the high flying golf ball falling and hitting on the solid ground, the impact is seriously, too. Even LED embedded in the golf ball will be destroyed in the hitting and impact processes. Therefore, there is no night golf or after hour golf.

There are the places and times which the golfers cannot play the long drive such as the park, snow course and the time in the night. The snow golf is popular in the snowy place. The night golf is popular in the desert place. In the desert, it is very hot in the day. So, the night golf becomes popular. Both snow golf and night golf are limited to putting. There is no highflying golf ball activity in the snow golf and night golf.

In 1893, the father of snow golf, Rudyard Kipling, started to putt the golf ball into the tin can. He introduced the snow golf putting of golf ball to roll on the small area snow-clean ground. The snow golf does not have the long-range high-flying golf ball activities. The snow golf is no more the golf sport in the open field. It is only in-house activities.

In the winter season, the golf course is filled with snow. Without the LED and buzzer, the highflying golf ball falls on to the snow and buried under the snow. It is impossible to find the golf ball that the golf game cannot play in the snowy golf course in the winter season. However, the golfer cannot play the long drive in the night or in the snowy field with the LED and buzzer being embedded in the golf ball. As the golf club head hits on the golf ball, the LED, buzzer and battery embedded in the golf ball will crack. As the highflying golf ball hits on the solid ground, the LED, buzzer and battery will crack, too. Therefore, the snow golf only has the putting activity that the golf course has to be shut down in the winter. The golf courses lost a lot of money and the employee is laid off for 3 months to half year. The snowy golf course still needs to shut down and lay off their employee.

OBJECTS AND ADVANTAGES

The golh sport is composed of three core technologies of golh club, golfrisbee disk and the golfrisbee basket. The golh sport families of golh, snow golh, ski golh, night golh, park golh, disk golh and basedisc, etc are derived from the invention of the golh. We provide the complete system solution for the golh sport. Accordingly, the innovations of golh and golfrisbee we made are not only in the golf technology and flying disk technology but also in the way of sporting system integration. The system pack includes the golfrisbee, golh club, golfrisbee basket, portable hole base, static friction lubricant, swing trainer, self-lock golh bag, and golh cart, etc. Furthermore, the cost of golh is reduced with the integrated manufacturing process. Golh is the sport for the people. For the golh and basedisc sports, the golfrisbee completely changes the image about the golf with the golh core technology. It will save the American from the hatred and attacks of the terrorism. The golh, ski golh and basedisc, etc will be the first golf type sports to be the official Olympic Sports and Winter Olympic Sports.

One of the golh target accounts is the golf course. To approach the golf course, at the beginning, the golh market strategy is to take the market which the golfer cannot play the long drive with golf ball. Golh will save the golf course in the winter season. The Golh adopts the golfrisbee flying disk to solve the snow golh and night golh problems:

(1) For the long drive of golh, there is no hitting impact force during the launching of the golfrisbee. As the golfrisbee falls on the ground, the golfrisbee has the soft-landing characteristics. The golfrisbee has enough lift force to carry the miniature LED, buzzer and battery. So, the LED and buzzer can be installed on the golfrisbee. The light and sound will lead the golher to locate and find the golfrisbee in the dark or in the snow very quickly.

(2) The golfrisbee is mounted on the golfrisbee club to launch to fly. The golfrisbee club does not contact with the snow powder at all. Therefore, the golher can see where the golfrsibee flies and lands.

(3) Due to the soft-landing of the golfrisbee, the golfrisbee will land on the top of the snow. The golher can identify the golfrisbee in the snowfield easily.

(4) Due to the safety of golfrisbee, the golh course can be as compact as a small park. The paths of 18 baskets/holes can be folded as a net. The compact golh course can be located in the residential area, which is close to the golher customers. It is convenient and safe for the night golher.

(5) The golh can have the multiple groups to share the golf course at the same time. The multiple groups share the same tee-time or there is no need to reserve the tee-time anymore. Golh reduces the cost a lot and increases the income of the golf course. It is the new golf standard which can play the golh in the snowy golf course. With the golh sport, the golf course can continue operating in the winter season.

DRAWING FIGURES

FIG. 1 (A) the golh sport is constituted of the golfrisbee and golfball. Swiveling the golh club, the golfrisbee is thrown into the golh basket and the golfball is thrown and putt to roll into the hole; (B) the basedisc is the golfrisbee being played as the baseball does; (C) is the golh pair-match game for the dating; (D) is the handisc sport which has the game rules similar to the football does; (E) is the golh sport being played as the arrow does.

FIG. 2 is the official standard golfrisbee basket adopted by PGFA (Professional GolFrisbee Association); (A) shows the wind-bell-chain reverted-umbrella type golfrisbee basket; (B) is the wind-bell-chain of the golfrisbee basket; (C) is the sectional view of the reverted-umbrella type basket; (D) is the elevational view of the reverted-umbrella type basket; (E) is the sectional view of the stand; (F) is the elevational view of the stand; (G) is the elevational view of the wind-bell-chain; (H) is the sectional view of the alignment of the wind-bell-chain taken along the line H—H in FIG. 2G; (I) is the exposed sectional view of the wind-bell-chain hanger and support; (J) is the partial exposed elevational view of the wind-bell-chain hanger and support; (K) is the front view of the wind-bell-chain; (L) is the side view of the wind-bell-chain; (M) is the sectional view of a pole locker; (N) is the elevational view of a pole locker; (O) is the pole locker applied to the extension pole; (P) is the pole locker applied to the stand; (O) is the fixed wind-bell-chain golfrisbee basket; (R) is the alternative design of the fixed golfrisbee basket.

FIG. 3 is elevation view of mounting process of mounting the golfrisbee and golfball on the head of the golh club; (A) the golfrisbee is installed on the head of the golh club; (B) rotating the golfrisbee 180 degrees, the golfrisbee is engaged with the head and is free dangling on the head of golh club; (C) the golfball is installed on the head of the golh club; (D) rotating the golfball 180 degrees, the golfball is engaged with the head and is free dangling on the head of golh club.

FIG. 4 is the top view of swiveling golh club to launch the golfrisbee and golfball; the swivel of golh club is similar to the swivel of the pole of baseball; (A) after mounting the golfrisbee on the golh club, swiveling backward and upward to the position to be ready to swivel golh club forward to launch the golfrisbee; (B) swiveling forward to launch the golfrisbee; the golfrisbee rotates due to the eccentric force; (C) the golfrisbee takes off and flies in the sky; (D) after mounting the golfball on the golh club, swiveling golh club backward and upward to the position to be ready to swivel forward to throw the golfball; (E) swiveling forward to throw the golfball; the golfball rotates due to the eccentric force; (F) the golfball is thrown in the sky.

FIG. 5 The view of the rotating mechanism for the mounting and launching golfrisbee and golfball; (A) mounting the golfrisbee on the head of golh club; (B) rotating golfrisbee 180 degrees that the golfrisbee hangs and dangles on the head of the golh club; (C) swiveling the golh club, the golfrisbee rotates 180 degrees and takes-off from the head of golh club; (E) the flying disc 1 rotates due to the initial mass force; (F) the angular momentum is due to the eccentric force with the pivotal axis to be the center of rotation; (G) the position having the maximum linear momentum and maximum angular momentum for the flying disc to take off; (H) the taking-off flying disc has the rotation axis to the new center of rotation.

FIG. 6 The dynamic study of the launching angle of the golfrisbee; (A) is the dynamics of the golfrisbee at the launching point; (B) the angle position that golfrisbee is too early to launch properly; (C) the optimum launching angle to launch the golfrisbee; (D) the angle position that golfrisbee is too late to launch properly.

FIG. 7 is putting the golfrisbee and golfball; (A) putting a golfball into the portable hole; (B) putting the golfrisbee to roll into a cave.

FIG. 8 is the basic set of golh including golh club, golfrisbee, golfball and dust cover; (A) is the elevational view of the golfrisbee disk; (B) is the side view of the golfball; (C) is the right-hand golfrisbee club having the right hand screw on the club head; (D) is the left-hand golfrisbee club having the left hand screw on the club head; (E) is the partial exposed sectional view of the golh head with the dust cover; (F) is the top view of the golh head having the dust cover; (G) is the top view of the dust cover for the golh head.

FIG. 9 is the section view of the golh club, golfrisbee and golfball; (A) is the side section view of the golfrisbee disk; (B) is the side section view of the golfball; (C) is the section view of the right-hand golfrisbee club having the right-hand screw on the golh head; (D) is the section view of the left-hand golfrisbee club having the left-hand screw on the golh head.

FIG. 10 The fundamental principles of the universal directional flying wing of the golfrisbee; (A) is the conventional wing flying in the forward direction; (B) is the conventional wing flying in the backward direction; (C) is the overlap of the wing flying in the forward direction as shown in FIG. 10A and the wing flying in the backward direction as shown in FIG. 10B; (D) is the bi-directional flying wing which is the envelope of the wing overlapped as shown in FIG. 10C; the bi-directional flying wing having the bi-directional flying capability which is the overlap composition of the uni-directional flying wings; (E) is the conventional wing having the slat and flap flying in the forward direction; (F) is the conventional wing having the slat and flap flying in the backward direction; (G) is the overlap of the wing having the slat and flap flying in the forward direction as shown in FIG. 10E with the wing having the slat and flap flying in backward direction as shown in FIG. 10F; (H) is the bi-directional flying wing with the skirt having the functions of both slat and flap; the skirt of the bi-directional flying wing is the composite envelop of the overlapped slat and flap of the overlapped uni-directional wings.

FIG. 11 The application of the bi-directional flying wing to the design of the golfrisbee disk having the universal directional flying capability; (A) is the sectional view of the golfrisbee having the sectional view of bi-directional wing; (B) is the isometric view of the golfrisbee disk; (C) is the aerodynamic analysis for the golfrisbee.

FIG. 12 The application of the bi-directional flying wing to the design of the golfrisbee ringdisk having the ring shape with the universal directional flying capability; (A) is the sectional view of the golfrisbee ring having the sectional view of the bi-directional wing; (B) is the isometric view of the golfrisbee ringdisk.

FIG. 13 The application the bi-directional flying wing to the design of the diskring type golfrisbee having the hybrid of disk and ring shape with the universal directional flying capability; (A) is the sectional view of the diskring type golfrisbee having the sectional view of the bi-directional wing; (B) is the isometric view of the diskring type golfrisbee.

FIG. 14 The golh uses the golh club to throw the golfball; (A) is the golfball being thrown with the golh club as shown in FIG. 14D; (B) is the section view of the golfball with the fast release latch; (C) is the golfball with the arrowhead; (D) is the golh club being swiveled to throw golfball.

FIG. 15 is the application of the golh club to throw the boomerang; (A) is the sectional view of the boomerang with the adaptor for the golh head to be thrown with the golh club; (B) is the top view of the boomerang with the adaptor being thrown with the golh club; (C) is the sectional view of the boomerang with the bi-directional wing segment to be thrown with the golh club; (D) is the top view of the boomerang with the bi-directional wing segment to be thrown with the golh club; (E) after mounting the golfrisbee on the golh club, swiveling backward and upward to the position to be ready to swivel forward to launch the golfrisbee made of boomerang; (F) swiveling forward and downward to launch the golfrisbee made of boomerang; (G) the golfrisbee made of boomerang takes off and flies in the sky.

FIG. 16 is the application of the golh club to throw the multi-boomerang; (A) is the sectional view of the odd-boomerang with the adaptor being thrown with the golh club; (B) is the top view of the odd-boomerang with the adaptor being thrown with the golh club; (C) is the top view of the even-boomerang with the adaptor being thrown with the golh club; (D) is the sectional view of the odd-boomerang with the bi-directional wing segment to be thrown with the golh club; (E) is the top view of the odd-boomerang with the bi-directional wing segment to be thrown with the golh club; (F) is the top view of the even-boomerang with the bi-directional wing segment to be thrown with the golh club; (G) after mounting the tri-boomerang golfrisbee on the golh club, swiveling backward to the position to be ready to swivel forward to launch the tri-boomerang golfrisbee; (H) swiveling forward to launch the tri-boomerang golfrisbee; (I) the tri-boomerang golfrisbee takes off and flies in the sky.

FIG. 17 is the application of the golh club to throw the polygon-boomerang; (A) is the sectional view of the polygon-boomerang with the adaptor of golh club head being thrown with the golh club; (B) is the top view of the polygon-boomerang with the adaptor of golh club head being thrown with the golh club; (C) is the sectional view of the polygon-boomerang with the bi-directional wing segment being thrown with the golh club; (D) is the top view of the polygon-boomerang with the bi-directional wing segment being thrown with the golh club; (E) after mounting the triangle-boomerang golfrisbee on the golh club, swiveling backward to the position to be ready to swivel forward to launch the golfrisbee made of triangle-boomerang; (F) swiveling forward to launch the triangle-boomerang golfrisbee; (G) the tri-boomerang golfrisbee takes off and flies in the sky.

FIG. 18 is the application of the golh club to throw the universal directional flying wing golfrisbee disk; (A) is the sectional view of the golfrisbee disk having the universal directional flying wing and screw adaptor to be thrown with the golh club; (B) is the top view of the golfrisbee disk having the universal directional flying wing and adaptor being thrown with the golh club; (C) is the sectional view of the golfrisbee disk having the multi-segment of universal direction flying wing to be thrown with the golh club; (D) is the top view of the golfrisbee disk having the multi-segment of universal direction flying wing to be thrown with the golh club; (E) after mounting the golfrisbee disk on the golh club, swiveling backward to the position to be ready to swivel forward to launch the golfrisbee made of disk; (F) swiveling forward to launch the golfrisbee disk; (G) the golfrisbee disk takes off and flies in the sky.

FIG. 19 is the application of the golh club to throw the golfrisbee ring having the universal directional wing; (A) is the sectional view of the golfrisbee ring with the screw adaptor to be thrown with the golh club; (B) is the top view of the golfrisbee ring with the screw adaptor to be thrown with the golh club; (C) is the sectional view of the golfrisbee ring having the multi-segment universal directional wing to be thrown with the golh club; (D) is the top view of the golfrisbee ring having the multi-segment universal directional wing to be thrown with the golh club; (E) after mounting the golfrisbee ring on the golh club, swiveling backward to the position to be ready to swivel forward to launch the golfrisbee ring; (F) swiveling forward to launch the golfrisbee ring; (G) the golfrisbee ring takes off and flies in the sky.

FIG. 20 is the application of the golh club to throw the golfrisbee diskring; (A) is the sectional view of the golfrisbee diskring with the screw adaptor to be thrown with the golh club; (B) is the top view of the golfrisbee diskring with the screw adaptor to be thrown with the golh club; (C) is the sectional view of the golfrisbee diskring with the multi-segment universal directional wing to be thrown with the golh club; (D) is the top view of the golfrisbee diskring with the multi-segment universal directional wing to be thrown with the golh club; (E) after mounting the golfrisbee diskring on the golh club, swiveling backward to the position to be ready to swivel forward to launch the golfrisbee diskring; (F) swiveling forward to launch the golfrisbee diskring; (G) the golfrisbee diskring takes off and flies in the sky.

FIG. 21 is the application of the golh club to throw the multi-boomerang golfrisbee ring and diskring; (A) is the partial exposed elevation view of the multi-boomerang golfrisbee ring and diskring with the screw adaptor to be thrown with the golh club; (B) is the top view of the odd-boomerang golfrisbee ring and diskring with the screw adaptor to be thrown with the golh club; (C) is the top view of the even-boomerang golfrisbee ring and diskring with the screw adaptor to be thrown with the golh club; (D) is the partial exposed elevation view of the multi-boomerang golfrisbee ring and diskring having the multi-segment universal directional wing to be thrown with the golh club; (E) is the top view of the odd-boomerang golfrisbee ring and diskring having the multi-segment universal directional wing to be thrown with the golh club; (F) is the top view of the even-boomerang golfrisbee ring and diskring having the multi-segment universal directional wing to be thrown with the golh club; (G) is the top view of the golfrisbee with the arrowhead; (H) after mounting the multi-boomerang golfrisbee ring and diskring on the golh club, swiveling backward to the position to be ready to swivel forward to launch the tri-boomerang golfrisbee ring or diskring; (I) swiveling forward to launch the tri-boomerang golfrisbee ring or diskring; (J) the tri-boomerang golfrisbee ring or diskring takes off and flies in the sky.

FIG. 22 is the implementations of the boomerang golfrisbee ring and diskring; (A) is the partial exposed elevation view of the golfrisbee boomerang ringdisk or diskring with the screw adaptor to be thrown with the golh club; (B) is the sectional view of the boomerang golfrisbee diskring with the disk type multi-segment universal directional wing; (C) is the boomerang golfrisbee ring with the multi-segment universal directional wing.

FIG. 23 is the section view of the golfrisbee boomerang diskring as shown in FIG. 8A; (A) is the bottom view of the golfrisbee taken at the horizontal line X—X in FIG. 23B; (B) is the horizontal section view of the golfrisbee taken at the horizontal center line in FIG. 23A; (C) is the vertical section view of the golfrisbee taken at the vertical center line Y—Y in FIG. 23A; (D) the golfrisbee boomerang polygon is derived from the combination of boomerangs in FIG. 16 and FIG. 17; it is similar to the boomerang disk ring; (E) the boomerang polygon golfrisbee has the same structure as the golfrisbee as shown in FIG. 23A with the edge numbers of polygon to be infinite; (F) is the bottom view of the alternative design of golfrisbee with the slotted skirt enveloping the edge of golfrisbee taken at the horizontal line X1—X1 in FIG. 23G; (G) is the horizontal section view of the golfrisbee with the slotted skirt enveloping the edge of the golfrisbee edge taken at the horizontal center line in FIG. 23F; (H) is the vertical section view of the golfrisbee with slotted skirt enveloping the edge of the golfrisbee edge taken at the vertical center line Y1—Y1 in FIG. 23F.

FIG. 24 is the section view of the golfrisbee having the punched through fitting screw cap and the boomerang wing segment with the angle of attack being adjustable; (A) is the bottom view of the golfrisbee taken at the horizontal line W—W in FIG. 24B; (B) is the horizontal section view of the golfrisbee taken at the horizontal center line in FIG. 24A; (C) is the vertical section view of the golfrisbee taken at the vertical center line Z—Z in FIG. 24A.

FIG. 27 is the golfrisbee static friction controller which has the multi-functions of air compressor, air cleaner and lubricant; (A) is the golfrisbee static friction controller at the idle position; (B) is the golfrisbee static friction controller in the air compression mode; (C) is the golfrisbee static friction controller at the air cleaning mode; (D) is the golfrisbee static friction controller in the lubrication mode.

Figures 10A, 10B, 10C, 10D:
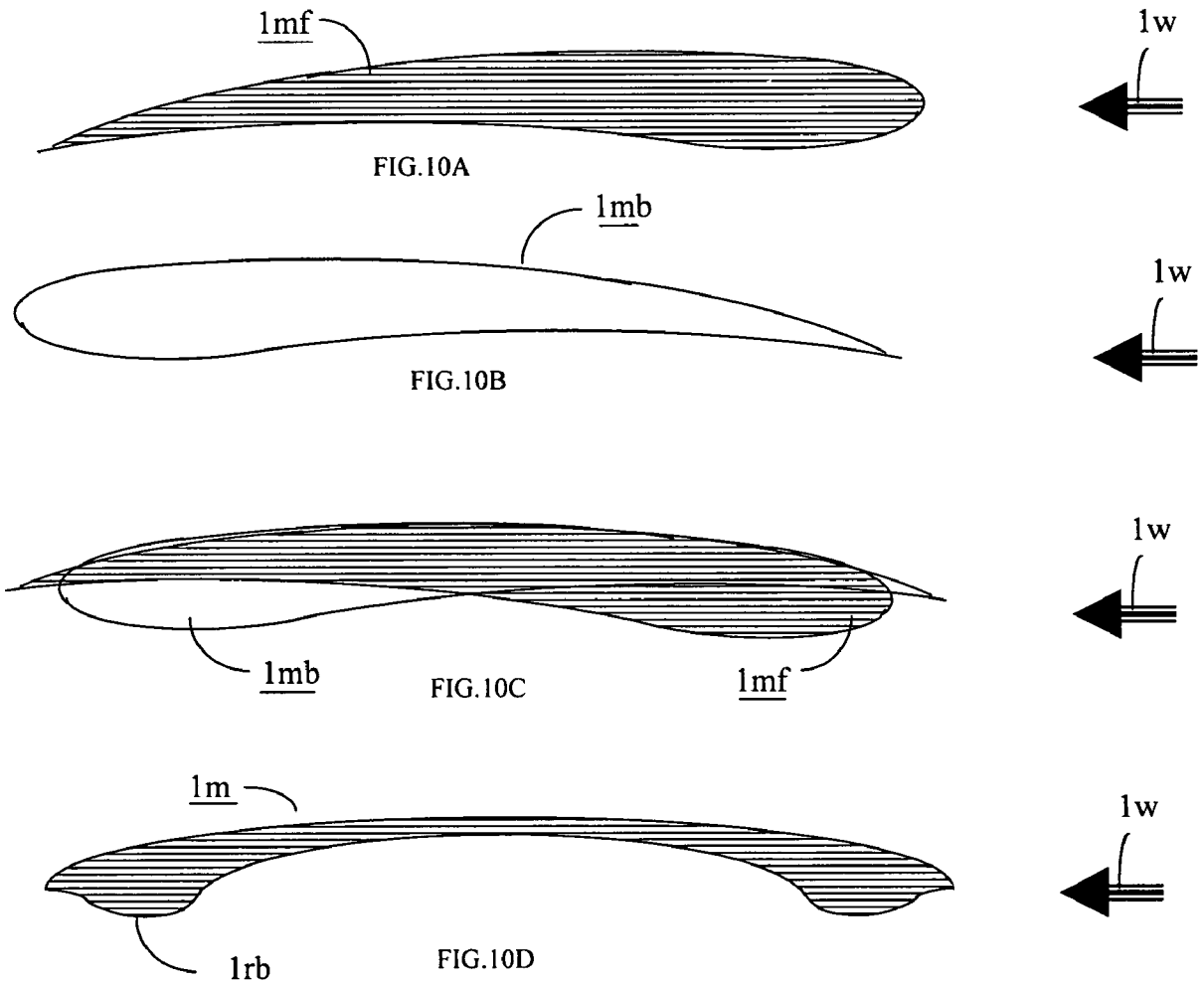

FIG. 28 is the airfoil shape of the golfrisbee boomerang wings; (A) is the section view of an airfoil for the lift-upward motion for the right hand rotation golfrisbee; (B) is the section view of an airfoil for the lift-up motion for left hand rotation golfrisbee; (C)) is the section view of an airfoil as shown in FIG. 10D for the lift-upward motion; (D) is the section view of an airfoil for the diving-downward motion of the right hand rotation golfrisbee; (E) is the section view of an airfoil for the diving-downward motion of the left hand rotation golfrisbee; (F) is the section view of an airfoil as shown in FIG. 10D for the diving-downward motion.

FIG. 29 is the two-wheel golh trolley; (A) is the two-wheel golh-pulling trolley; (B) is the integrated two-wheel golh trolley with the golh bag; (C) is the ski type golh trolley; (D) is the belt type golh trolley.

FIG. 30 is three-wheel type portable personal golh cart; (A) is the side view of the portable personal golh cart; (B) the portable personal golh cart stands as standing bag; (C) is the back view of the portable personal golh cart; (D) is the side view of the portable personal golh cart having the snow ski; (E) is the portable personal golh cart having the snow ski stands as stand-up bag; (F) is the back view of the portable personal golh cart having the snow ski.

FIG. 31 is two-wheel type foldable and portable personal golh cart; (A) is the side view of the personal golh cart; (B) is the personal golh cart stands as standing bag; (C) is the back view of the personal golh cart; (D) is the side view of the personal golh cart having the automatic ski capability; (E) is the personal golh cart having the automatic ski capability and also serving as standing bag; (F) is the back view of the personal golh cart having the automatic ski capability.

FIG. 32 shows the operation of the automatic ski system; (A) is on the hard ground, the ski is not engaged with the ground; (B) is the detailed mechanism of the automatic ski not engaged with the ground as shown in FIG. 32A; (C) is on the soft ground, the ski is engaged with the ground; (D) is the detailed mechanism of the automatic ski engaged with the ground as shown in FIG. 32C.

FIG. 33 shows the operation of the fast installment of the ski shoes of the golh cart; (A) is the shaft of wheel fed into the notch on the ski frame; (B) is the shaft of wheel fed into the guided slot of ski shoe; (C) the lock plate is closed to have the shaft of wheel sealed in the slot; (D) the hook of the spring is mounted on the shaft to have the automatic bias of the automatic operation of the snow ski.

Figure 34:
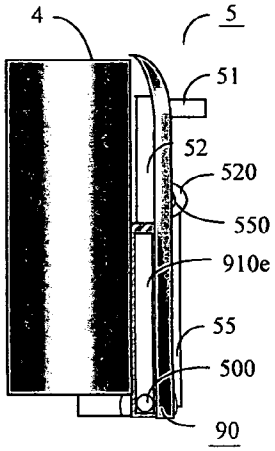

FIG. 34 is the snow ski having the elongated guiding slot to have snow ski to be packed.

Figure 35B:
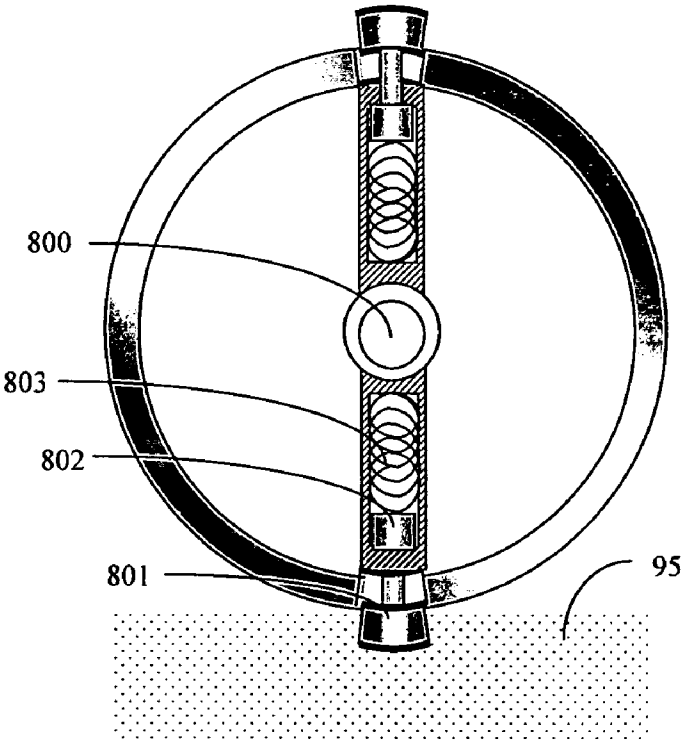

FIG. 35 is the snow wheel; (A) is the snow wheel rolling on the solid ground; (B) is the snow wheel rolling on the snow.

Figure 36A:
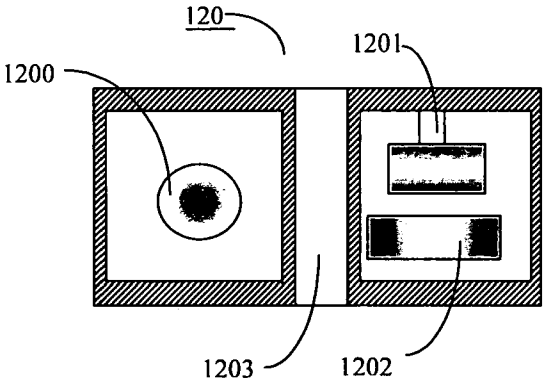
Figure 36B:
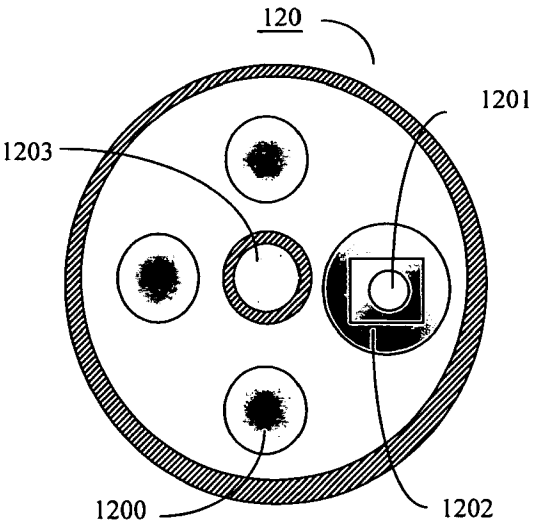

FIG. 36 (A) is the section view of the integrated waterproof LED light for golfrisbee; (B) is the top view of the integrated waterproof LED light for golfrisbee.

Figure 37A:
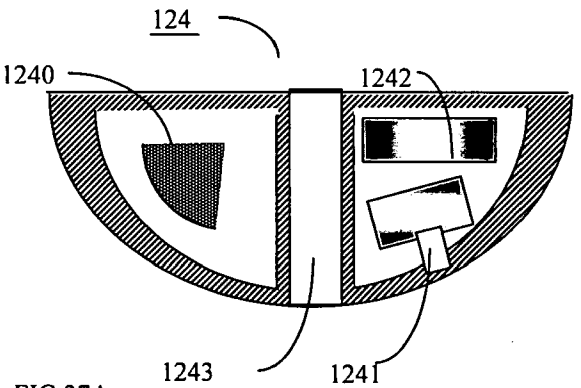
Figure 37B:
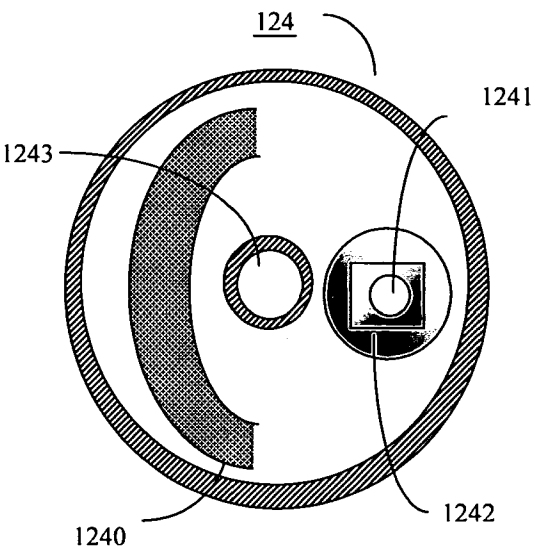

FIG. 37 (A) is the section view of the integrated waterproof sound generator for golfrisbee; (B) is the top view of the integrated waterproof sound generator for golfrisbee.

FIG. 38 is the partial exposed section view of the self-locked golh bag; (A) the cap of the self-locked golh bag is in the locked position; (B) the cap of the self-locked golh bag is uncapped and is self-locked at the bottom of the bag.

Figure 39:
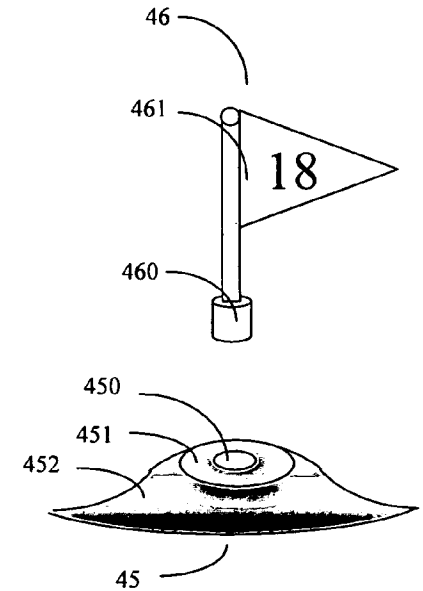

FIG. 39 is the portable base for the golh putting and basedisc.

FIG. 40 is golh swing trainer; (A) is the isometric view of the golh swing trainer; (B) is the side view of the golh swing trainer; (C) is the guide implemented with the gear for the golfrisbee club; (D) is the guide implemented with the steel rope for the golfrisbee club.

Figure 41:
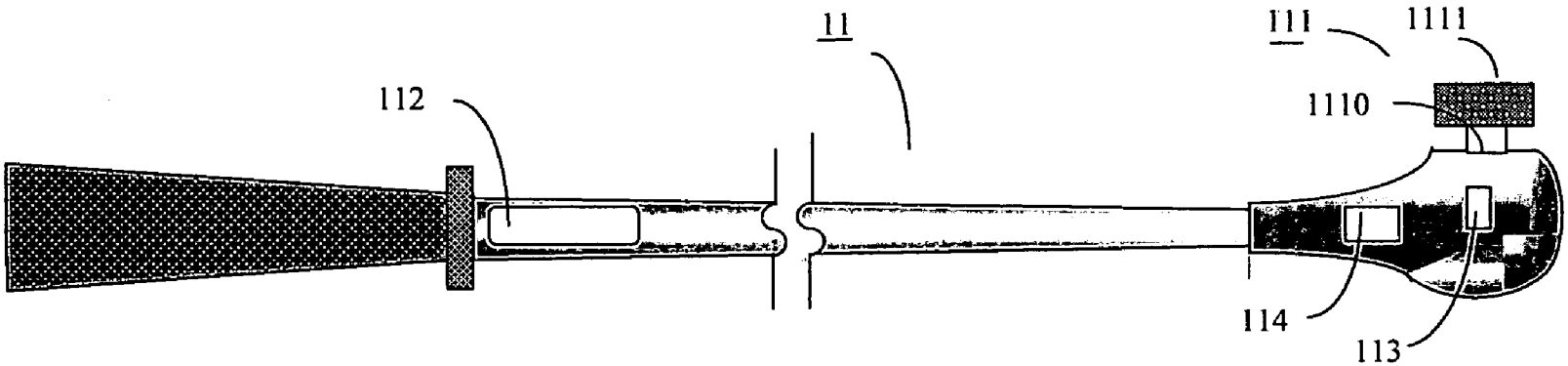

FIG. 41 is the golh simulator.

FIG. 42 is the flowchart of the manufacture process for the golh club and golfrisbee disk; (A) the module process flow for golh head and golfrisbee; (B) the assembly flow for the golh club and golfrisbee.

FIG. 43 The plastic injection module for the golfrisbee with double injection; (A) the plastic injection of the elastic material for the main plane which include the screw adaptor; (B) the retrieve and rotation of the screw module; (C) the open of the injection modules, the golfrisbee without distortion is formed.

FIG. 44 The golfrisbee design for the plastic injection module with triple injection; (A) is the top view of the golfrisbee disk; (B) is the top view of the golfrisbee diskring made of three different plastic material; (C) is the sectional view of the golfrisbee diskring made of three different plastic material.

FIG. 45 The plastic injection module for the golfrisbee with triple injection; (A) the plastic injection of the elastic plastic material for the main disk; (B) as the module opens, the pore for the screw is formed; (C) the plastic injection of the hard plastic for the screw; (D) as the module opens, the screw is formed.

Figure 46A:
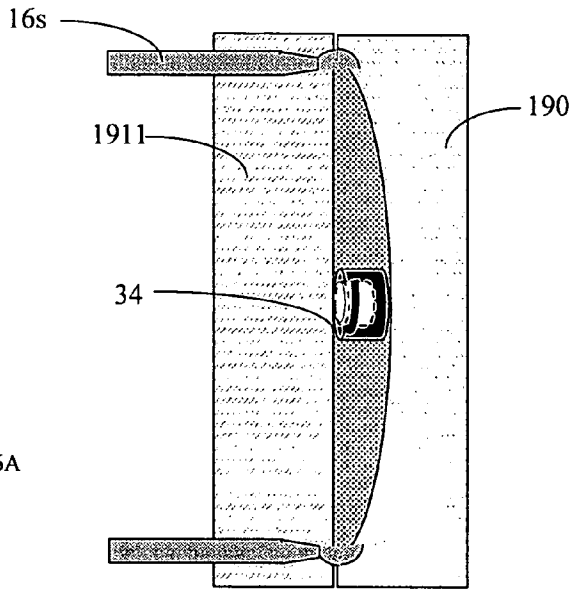
Figure 46B:
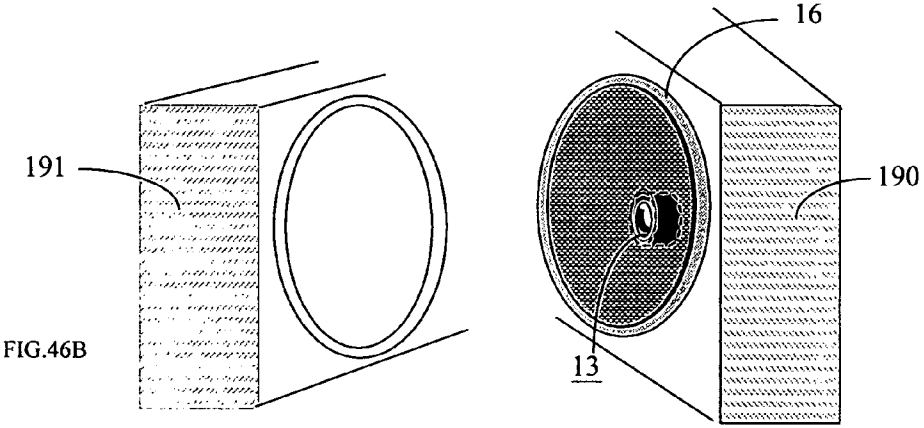

FIG. 46 The plastic injection for the skirt which can be integrated with the double injection or triple injection; (A) the plastic injection of the soft skirt plastic material; (B) the module opens and the completed golfrisbee is formed.

FIG. 47 The design of the golfrisbee having the backbone plate and it is injected with the triple injection plastic injection module; (A) is the top view of the golfrisbee disk having the backbone plate; (B) is the top view of the golfrisbee ring or diskring having backbone plate and it is made of three different plastic materials; (C) is the sectional view of the golfrisbee diskring having backbone plate and it is made of three different plastic materials.

Figure 48B:
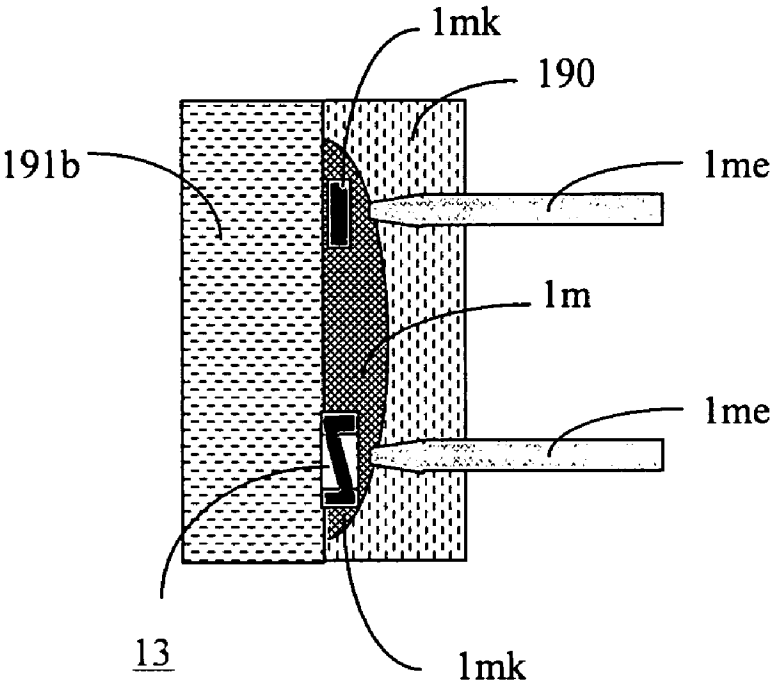
Figure 48A:
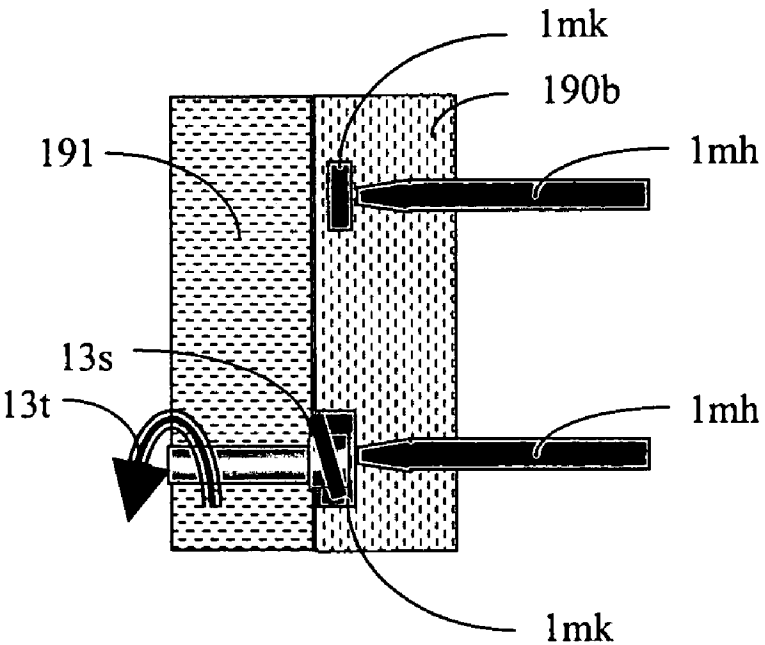

FIG. 48 the backbone plate is injected with the plastic injection which can be integrated with the double injection or triple injection manufacturing process; (A) is the plastic injection of the hard backbone plastic material; (B) is the plastic injection for the main body of golfrisbee having the backbone plate be embedded.

DESCRIPTION AND OPERATION

Figure 1A:
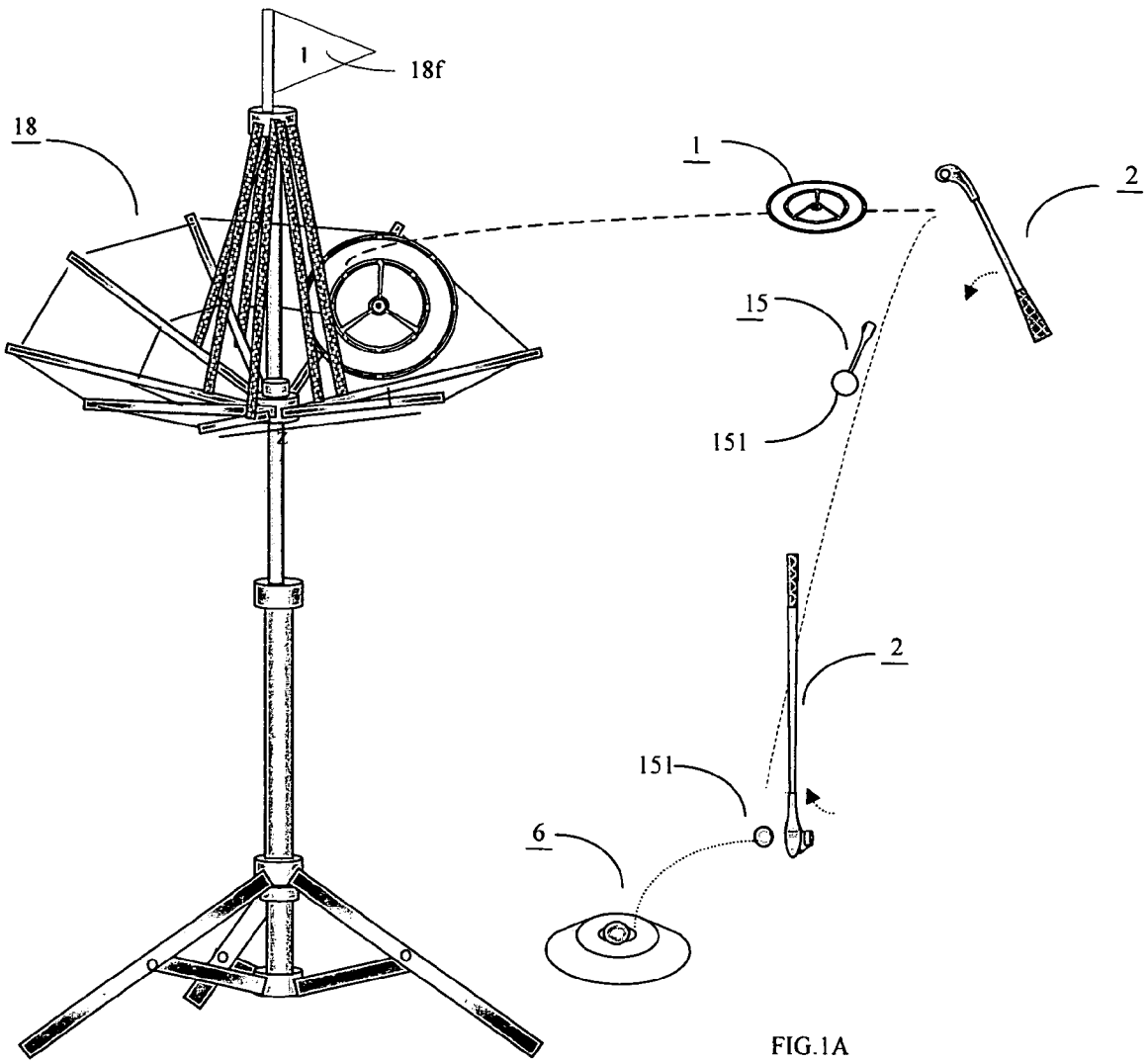
Figure 1B:
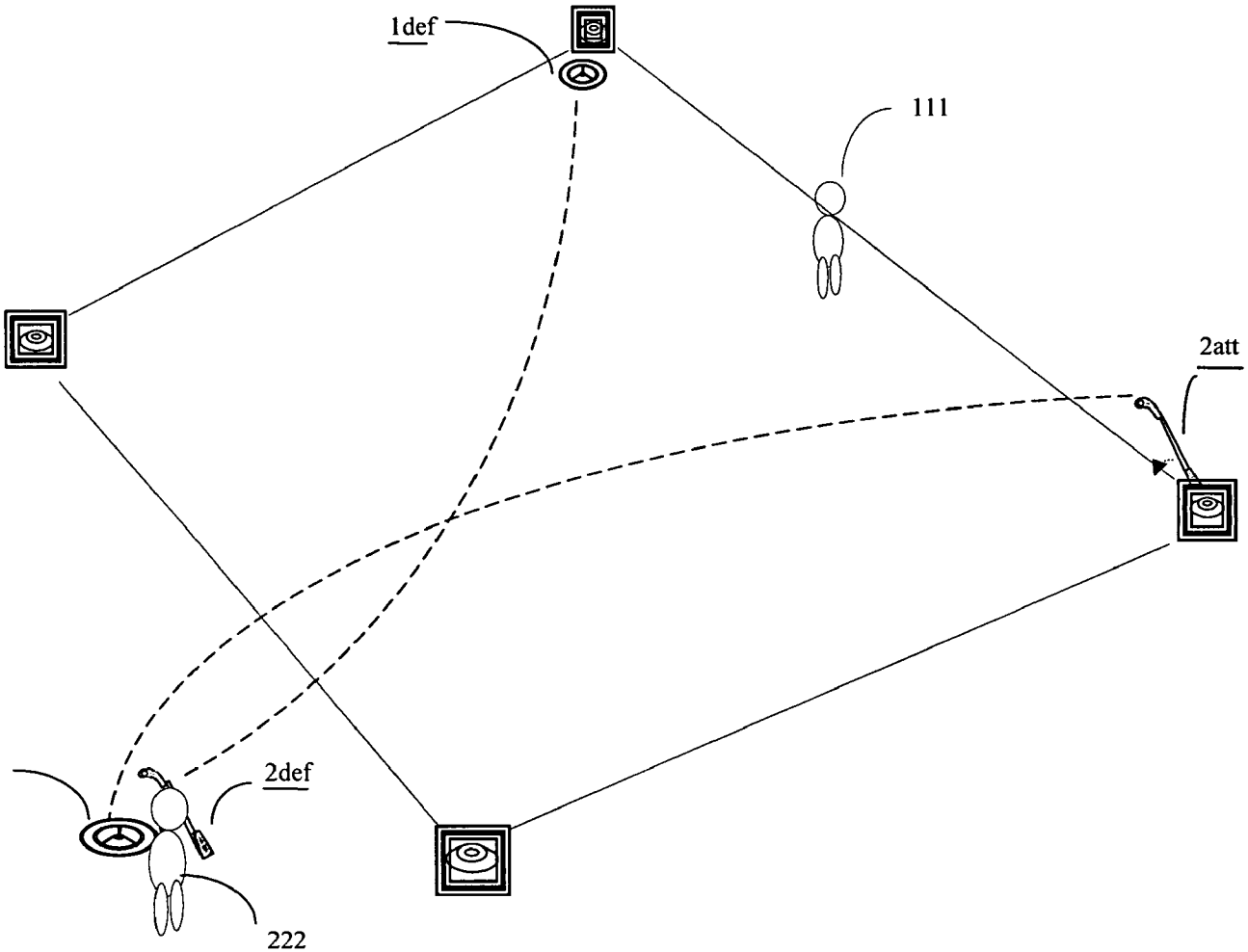

As shown in FIG. 1A, golh is the hybrid golf sport made of flying golfrisbee 1, golfball 15 and the rolling ball 151. Golfrisbee is the sport to swivel club 2 to launch flying disk 1 to fly. Golfball is the sport to swivel club 2 to throw ball 15. In golh sport, the long drive adopts the flying golfrisbee 1 or golfball 15 as shown in FIG. 1A; the putting adopts the basket 18 for disk 1 or the hole 6 for golf ball as shown in FIG. 1A and FIG. 7.

Comparison Table for Golf & Golh

| Place/Time | | Sport: Golf | Sport: Golh/Golfrisbee |
|---|---|---|---|
| Golf Course | Tee-Time | Required | Not Required |
| | Cost | High | Low |
| City Park | | Cannot Play | Can Play |
| Night | | Only Putting | Long Drive & Putting |

-continued

Comparison Table for Golf & Golh

| Place/Time | Sport: Golf | Sport: Golh/Golfrisbee |
|---|---|---|
| Weekday After Hours | Cannot Play | Can Play |
| Desert | | |
| Snow Golf | Only Putting | Long Drive & Putting |
| Snow Golf Course | Cannot Play | Can Play |
| Snow Field | | |
| Ski-Golf | | |
| Disk Golf Course | Cannot Play | |
| Basedisk | Cannot Play | Can Play |
| Handisk, etc | | |

From the table of comparison, eventually the golh sport will be the dominant sport over the golf sport. Our goal is to have the golh sports to be the Olympic sports. However, the golf is still not an Olympic sport yet. It is due to the golf being the sport for the rich people. Due to safety reason, the golfers need to book for the tee-time to play. The percent of usage of the golf course is very low that the golfing fees are high. Golf becomes the sport for the rich people only. To change the situation, the golfrisbee is introduced to make the revolution in the golf sport of modern society. Now, the golfrisbee has made the breakthrough in golh technology. It will make the golh sport to be the sport for the people, not for the rich.

The golh sports can be further divided to be (1) Course Golh;
(2) Park Golh;
(3) Disk Golh;
(4) Snow Golh;
(5) Ski Golh;
(6) Night Golh;
(7) Long-Drive Golh;
(8) Basedisc;
(9) Handisc;
(10) Golh Shooting, etc;

Others: such as Ice Golfrisbee, Tennidisc, Basketdisc, Waterdisc, golh shooting, etc.

Some selected applications of the golh sports and games are illustrated in FIG. 1. The basedisc is the golfrisbee adopting the baseball game rule. Both basedisc and golh are the new sports based on the innovation of the golfrisbee. As shown in FIG. 1B, the basedisc is the conjugate sport of the baseball. Basedisc is to play golfrisbee according to the baseball game rules. As shown in FIG. 1B, the golfrisbee can be played as the baseball and is referred to be the basedisc. For the basedisc, the baseball is replaced with the golfrisbee disc. The sporting rules of basedisc are similar to the sporting rules of baseball. However, the pitcher in the baseball game is no longer needed in the basedisc game. In basedisc game, the attacker swivels the golh club to launch the disk to fly. The defenders catch the disk and pass the disk to touch the attacker. The rule is the same as the baseball. The flying disk for the golh and basedisc has innovations to fly long-range distance and is safe to operate. The attacker 111 swivels the golh club 2*att* to launch the basedisc 1*att* and runs. The defender 222 catches the basedisc 1*att* then swivels the golh club 2*def* to launch the basedisc 2*def* to block the attacker 111. As shown in FIG. 1A and FIG. 1B, to play the basedisc or golh in the park, we need to have the portable base or portable-putting hole. As shown in FIG. 39, the golh system pack includes the universal portable putting base 45 for both the basedisc and park golh. The specially designed golfrisbee adopted in the basedisc sport is referred as basedisc. The basedisc 1*att* and 2*def* fly as fast as the baseball does. The basedisc is smaller and heavier than golfrisbee adopts in the golh sport. The basedisc is the golfrisbee type flying disc launched with the swivel of golh club.

Figure 1C:
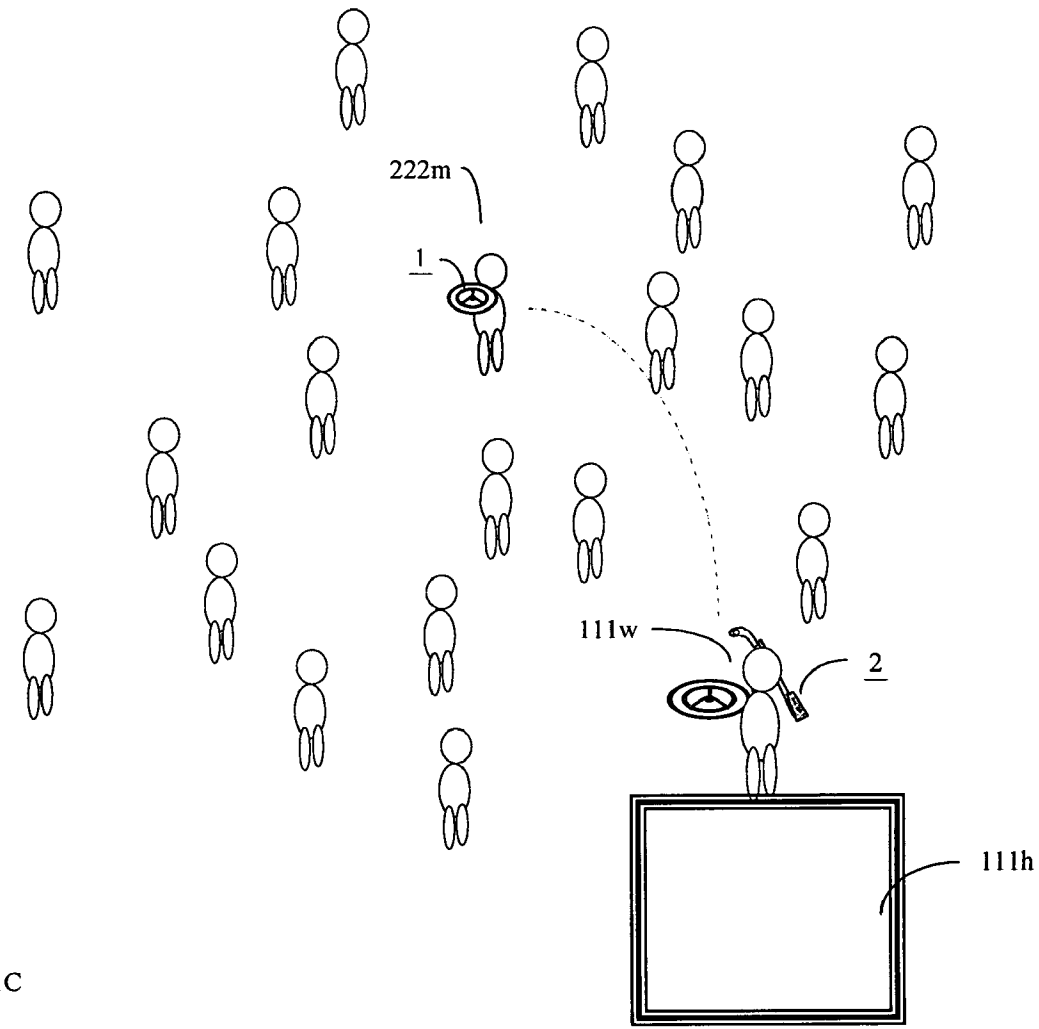

FIG. 1C shows the application of the golfrisbee on the match game of the date of boys and girls. The girl 111*w* stands on the high tower 111*h*. The boy 222*m* wishes to be dated stands on the ground. As the girl 111*h* finds out the boy 222*m* who wishes to date, the girl 111*h* throws the golfrisbee 1 with the swivel of the golh club 2. The boy 222*m* catches the golfrisbee 1 and he has the right to ask for the date of the girl 111*h*. This is the match game with the golfrisbee.

Figure 1D:
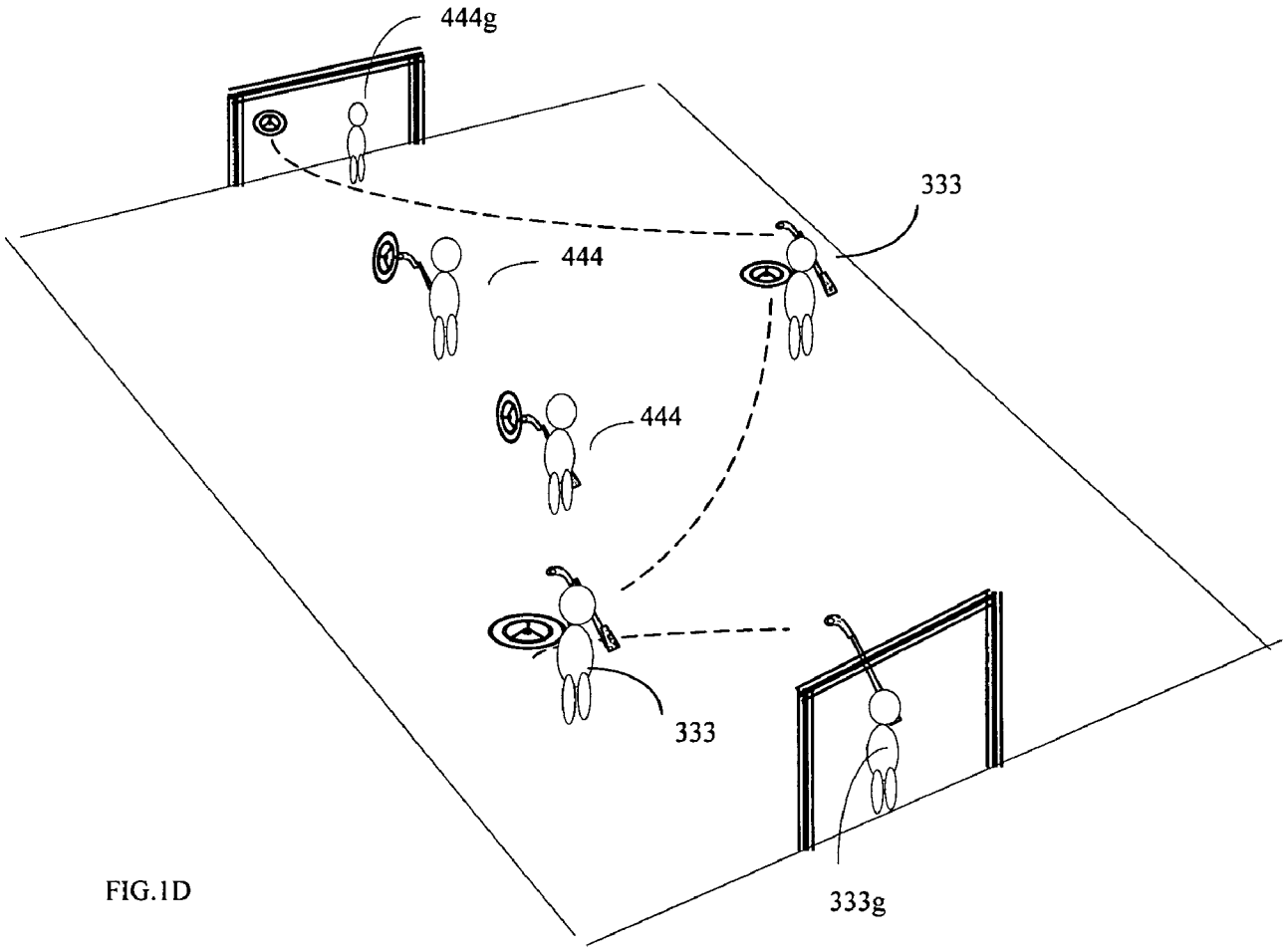

FIG. 1D shows the handisc sport which is derived from the golh technique. The handisc is the conjugate sport of the football. The handisc is to play the golfrisbee according to the football game rules. The gatekeeper 333*g* can use two hands to catch the golfrisbee. The gatekeeper 333*g* can use either hand or golh club 2 to pass the golfrisbee 1 to the player 333. Each team player 333 or the enemy's player 444 has one golfrisbee hang on the golly club. As soon as the player 333 or player 444 received the passed golfrisbee with left hand, the player 333 or 444 can swivel the golh club to launch the golfrisbee disk to pass or attack the gate. As the golfrisbee is thrown out, the player takes time to mount the golfrisbee on the club again. As shown in FIG. 1D, the golhers 333 pass golfrisbee and attack the gate; the enemy's gater 444*g* tries to catch the attacking disk 1 and misses it.

Figure 1E:
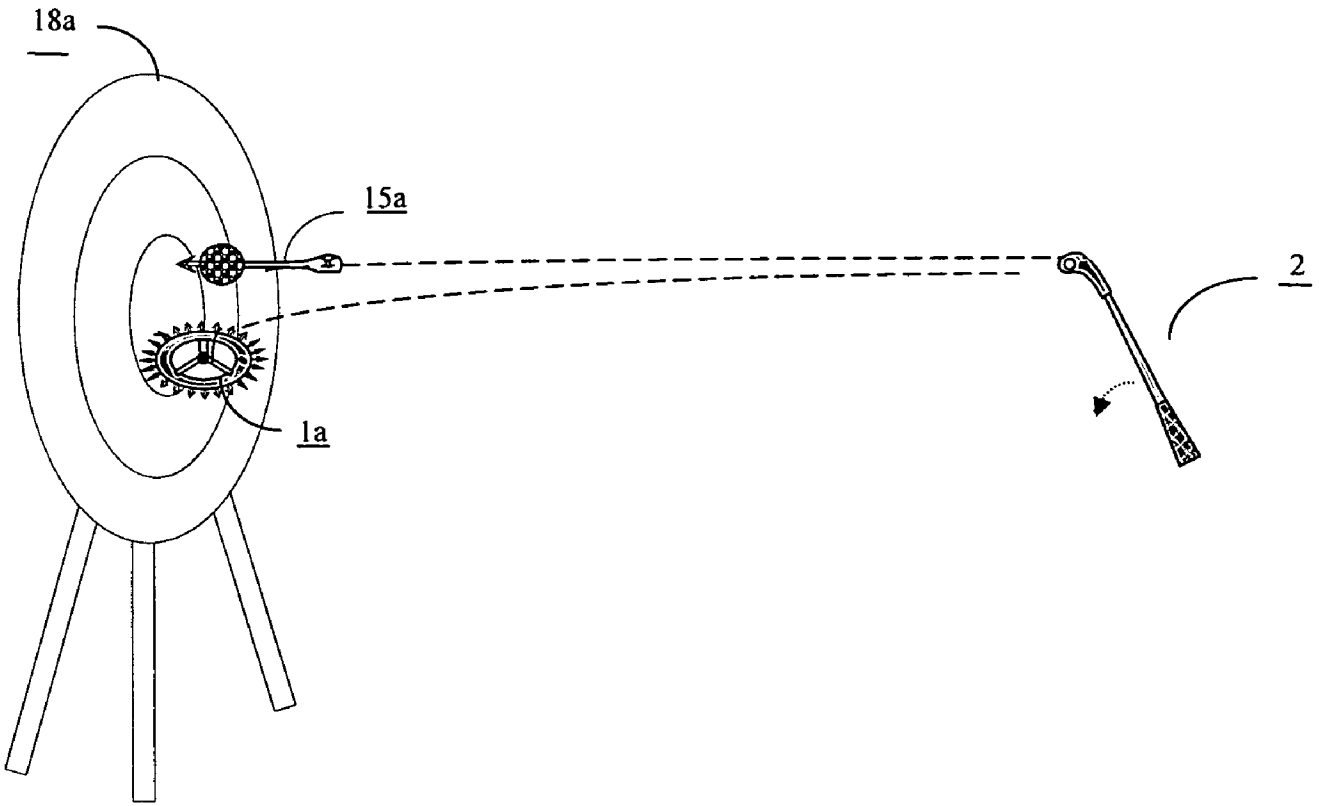

FIG. 1E shows the golh sport can play as the arrow shooting gain. Swiveling the golh club, the golfball type arrow 15*a* or the golfrisbee type arrow 1*a* is shot at the target 18*a*.

Based on the innovation of the golfrisbee, many sports are created accordingly such as golh, golfrisbee, golfball, basedisc, handisc, basketdisc, tennidisc, waterdisc, golh shooting, etc. A lot of new associations such as Golh Association, Golfrisbee Association, Basedisc Association, Handisc Association, Basketdisc Association, Waterdisc Association, and Golh Shooting Association, etc will come to exist. In the future, since the handisc and golfrisbee will be the popular sport for people, golh has the potential to be the Olympic sport. Therefore, the golh will be the first Olympic sports of golf type sports.

Golh can be played on the golf course. Golh is the golf hybrid of flying disk and rolling ball. In golf, the golf ball is hit with the swiveling golf club. In golh, the golfball is thrown with the swiveling golh club. There are the compatibilities among the golfrisbee, golfball and golf ball. FIG. 2 shows the standard portable golfrisbee basket 18*wcp* approved by the PGFA (Professional GolFrisbee Association) to have the golf course converted to be the golh course. Instead of using hand-throwing disk as the disk golfer does, the golher swings the golh club 2 to launch the golfrisbee 1 to fly into the golfrisbee basket 18. On the golh course, there are many golfrisbee baskets 18. The golfrisbee basket 18 corresponds to the hole on the golf course. In golh sport, the golher launches the golfrisbee 1 to fly into the basket directly with the golh club 2. For the course golh, there is no tee-time requirement for the golfrisbee. The golher can play golh on the course any time and any place.

Figure 2A:
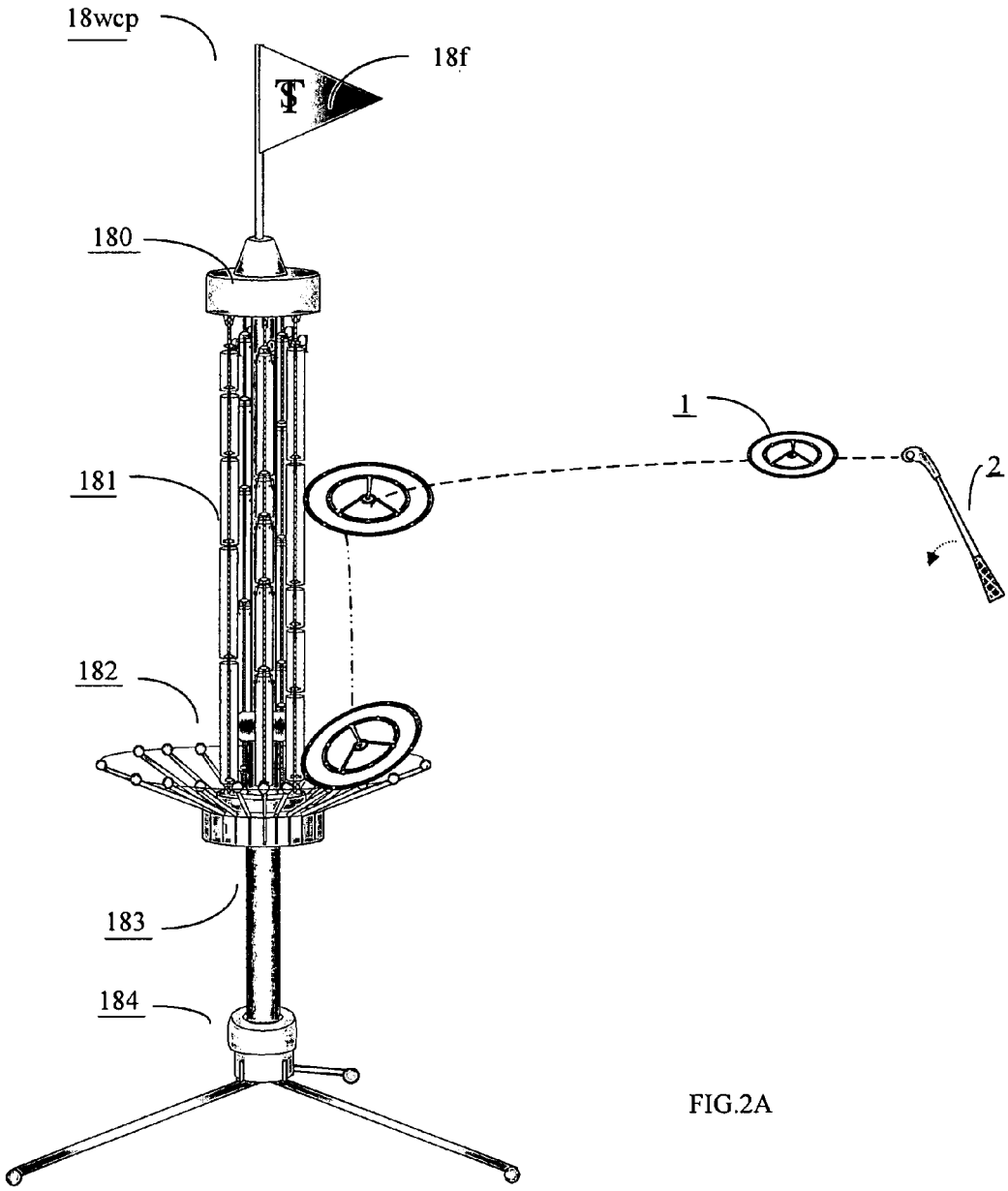
Figure 2B:
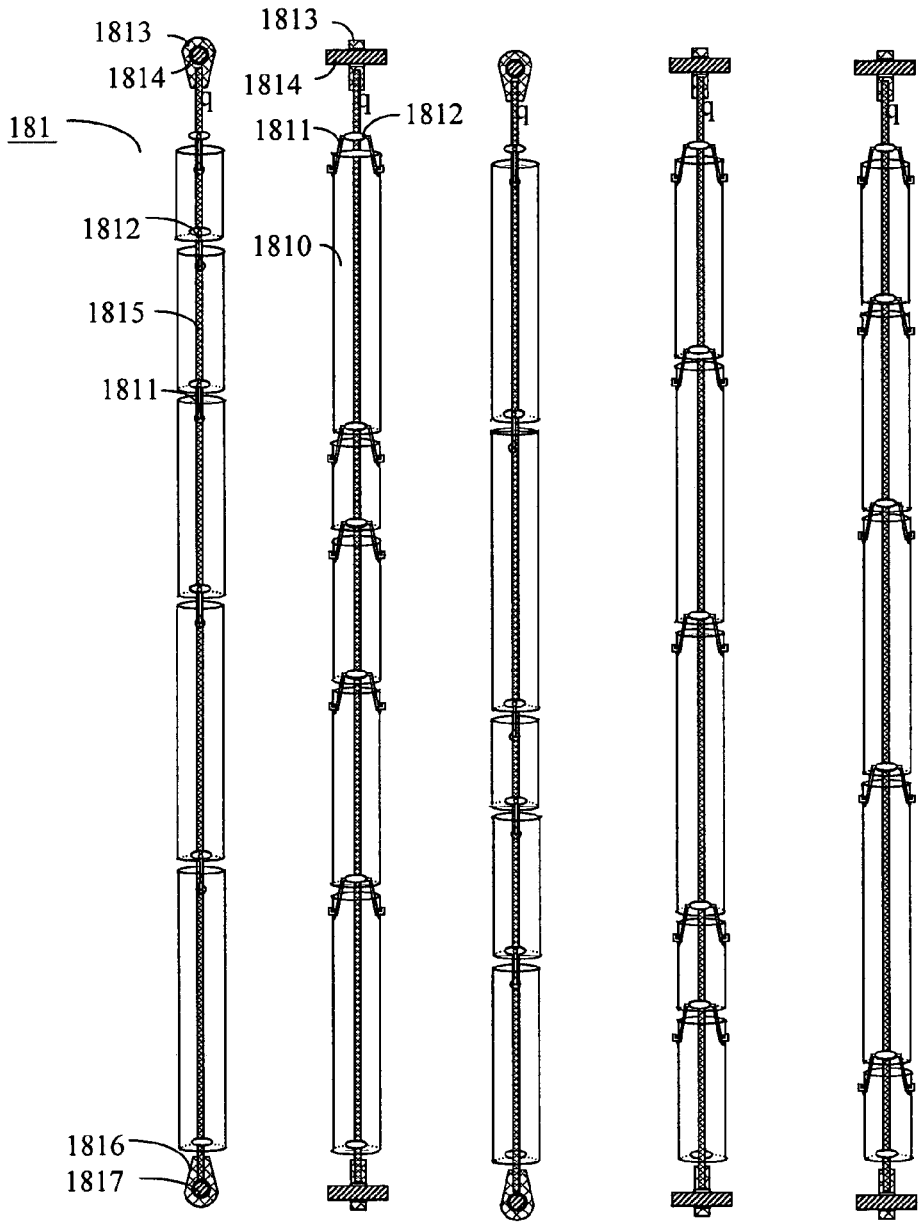

This is a portable type golfrisbee basket 18*wcp*. For the fixed type golfrisbee basket, there is no need for the stand 184 as shown in FIG. 2Q and FIG. 2R. The flag 18*f* gives golher the indications for the wind direction and the wind speed. As shown in FIG. 2A, in the golfrisbee sport, the golfrisbee 1 must be thrown by the golh club 2 to fly and fall into the basket 182 just as the ball rolls into the hole as the golf sport does. To absorb the impact of the golfrisbee 1 and increase the possibility of the golfrisbee 1 to fall into the basket 18*wcp* from any direction, the basket 18*wcp* adopts the wind-bell-chain 181 and the basket 182 having small diameter reverted umbrella structure.

To make the golfers and golf courses accept the golh sport, we promote the night golh and snow golh. The night golh and snow golh can have the long drive with the flying golfrisbee 1 and putting with golfrisbee 1 or the rolling golf ball 151. The snow golh and night golh do not conflict with the existing golf sport activities. The snow golh and night golh can do the time-sharing with golf for the same golf course. So, the portable gollfrisbee basket 18*wcp* is invented that the golh can time share with the golf of the conventional golf course. To make the putting of the golfrisbee 1 have the same difficulty as the putting of the golf ball does, the outside diameter of the bundle made of the wind-bell-chain 181 is small. However, the diameter becomes small, the golfrisbee is easily damaged. Therefore, the small cross section golfrisbee basket 18*wcp* has the special design to reduce the impact force. The special design is the wind-bell-chain 181. As the golfrisbee 1 hits on the wind-bell-chain 181 and/or falls in the reverted-umbrella basket 182, the wind-bell-chain 181 and the reverted-umbrella basket 182 swivel and generate the music sound of wind chain. The kinetic energy of the flying golfrisbee 1 is converted to the acoustic vibrational energy of the wind chain 181. The swivel movement of the wind-bell-chain 181 serves as the buffer to protect the golfrisbee 1 from damage.

The wind-bell-chain 181 has a long dimension. The putting art of golfrisbee 1 is the golher has to control the force correctly. If the force is too large, the golfrisbee will bounce back and fall outside the reverted umbrella basket 182. As shown in FIG. 2B, the wind-bell-chain 181 is made of the multiple sections of wind-bell 1810. To have the harmonics of music, the wind-bell tube 1810 has the different length. Furthermore, to have the different harmonic combination, for different string of the wind-bell-chain 181, the different length wind-bells 1810 are aligned cyclically. As shown in FIG. 2G and FIG. 2H, the wind-bell-chains 181 are hanged around the supporting pole 1801. To make the wind-bell chain generate the music sound, the wind-bell-chain must be hanged near vertically. The tube 1810 only can hit on the dangling pan 1812. As the tube 1810 touches on dangling pan 1812, the sound cannot be generated. Therefore, the swivel amount of the wind-bell-chain 181 is small. Therefore, as shown in FIG. 2J, there is a pan 1830 to limit the swivel of the wind-bell-chain 181 and the basket 182. The conventional wind chain stands still and is hit outside to generate sound and the conventional bell moves and is hit inside to generate sound. As shown in FIG. 2K and FIG. 2L, the wind-bell-chain 181 has the hybrid characteristics of both the bell and the wind chain . . . The tube 1801 of wind-bell-chain 180 swivels on the link 1811 and hit by the pan 1812 from inside the tube 1801 as the bell does. The pan 1812 clamps on the string 1815. The pan 1812 supports the fork 1811. The linkage of fork 1811 passes through the holes 1810*n* of the cylindrical tube 1810. The fork 1811 has the hook 1811*m* to hold the tube 1801. As the cylindrical tube 1810 dangles and swivels on the fork 1811, the bottom of the cylindrical tube 1810 hits on the pan 1812 and the music sound is generated. In the conventional bell and wind chain, the moving pan hits the walls of bell and wind chain. For the wind-bell-chain 181, the moving wall of the cylindrical bell 1810 hits the pan 1812. This operation is the reversed operation of the conventional bell and wind chain.

As shown in FIG. 21 and FIG. 2J, the wind-bell-chain 181 is hanged beneath the hanging cap 180. The string 1814 passes through the hole of hanger 1813 and the slot 1803 in the hanging cap 180 to hang up the wind-bell-chain 181. To increase the swivel of the wind-bell-chain, the hanging cap 180 is supported on the universal joint type ball 18010. To swivel only, the hanging cap 180 might be supported on one pinpoint. However, for the fixed golfrisbee basket, to keep the theft from stealing the wind-bell-chain 181, we need to use the ball joint to lock the wind-bell-chain 181 to the supporting pole 1801 as shown in FIG. 2Q. As the wind-bell-chain 181 swivels, the hanging cap 801 rolls on the ball joint 18010. There is a lot of space 1800 reserved for the free roll movement of the hanging cap 180. With the free roll mechanism of the hanging cap 180, the whole wind-bell-chain 181 can free to rotate as the conventional wind chain does.

The light 180L is for the night golf. In the night, the light 180L shines on the flag 18*f*, the wind-bell chain 181 and the reverted umbrella 182. With the lights 180L, the golher can see the golh basket 18*wcp* in the night and swivels the golh club 2 to launch the golfrisbee 1 to fly toward the golfrisbee basket 18*wcp*.

The working principles of the wind-bell-chain 181 are different from the conventional wind chain.

For the conventional wind chain, (1) it has only one section of tube; (2) the pan hits the outside of the tube to ring; (3) the pan moves to hit the tube; (4) each tube of wind chain swivels individually.

For the wind-bell-chain, (1) each string has multiple sections of tube; (2) the pan hits the inside of the tube to ring; (3) the tube moves to hit the pan; (4) the whole wind-bell-chain swivels all together; (5) the still pan hits the inside of the tube of the swiveling wind-bell-chain as the bell does. Therefore, our invention is referred as the wind-bell-chain.

Without the free roll mechanism of the universal joint type ball 18010 of the cap 180, the wind-bell-chain 181 and the foldable basket 182 cannot swing. The wind-bell-chain absorption capability of the impact energy will be reduced a lot. Both the golfrisbee basket 182*cp* and the golfrisbee 1 will be damaged due to the hit impact of the golfrisbee 1. Therefore, the free roll mechanism of the universal joint type ball 18010 is the core technology of the golfrisbee basket 18*wcp*.

Figure 2C:
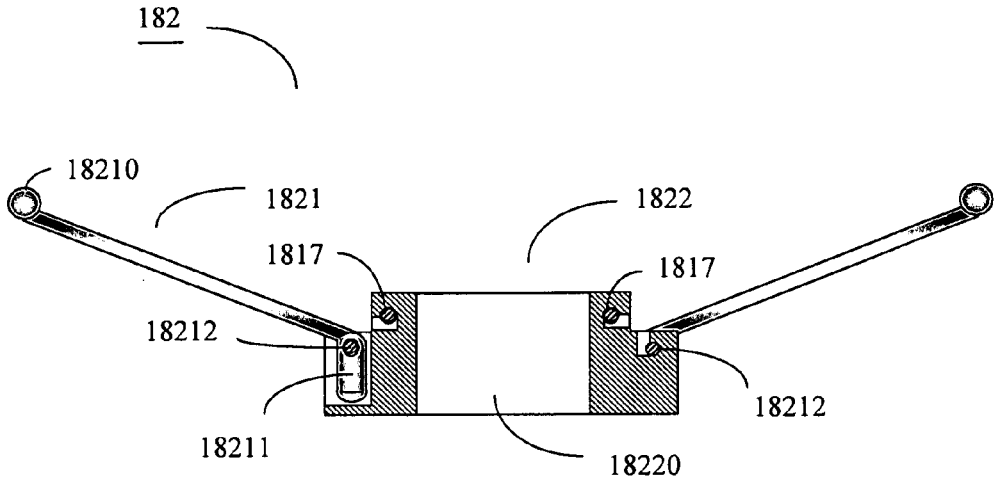
Figure 2D:
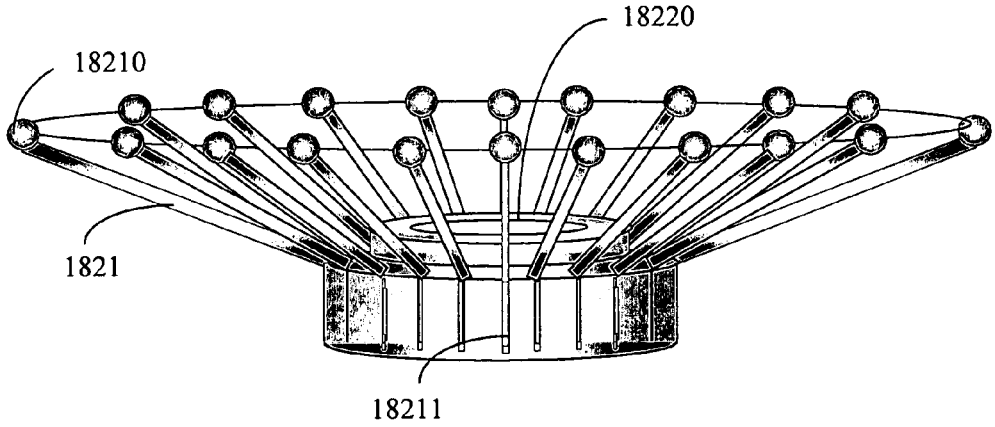

As shown in FIG. 2C and FIG. 2D, to be portable, the basket 182 is in the shape of the reverted umbrella. The L-shaped basket bone 1821 pivots on the string 18212 as the umbrella bone does. In the normal operation, the end 18211 leans against the wall of the basket ring 18220. In the portable mode, the L-shaped basket bones 1821 rotate and concentrate to be a bundle of ribs just like the umbrella does.

As shown in FIG. 2A, FIG. 2G, FIG. 2H, FIG. 21 and FIG. 2J, to be portable, the supporting pole 1801, the lock screw 1830 and the stand pole 1831 can pass the hole of the basket support 18220. The lock screw 1830 has the pan structure to hit the outside of tube 1810 as the conventional wind chain does. The lock screw 1830 is to limit the swing of the wind-bell-chain 181. As the dangling wind-bell-chain 181 hits on the pan of the lock screw 1830 with the impact force and the wind-bell-chain 181 will bounce back to swing in the reverse direction. The dangling tubes 1810 will continue swinging in the original moving direction that the tube 1810 hits on the pan 1812 on the inside of the tube wall. This process is similar to the emergency brake of the car, all the passengers continue moving forward and hit by the blockages.

Therefore, there are three different hit mechanisms to generate the music sound of the wind-bell-chain 181. The first hit mechanism is the flying golfrisbee 1 hit on the outside of tubes 1810 and the wind-bell-chain 181 begins to swing. The second hit mechanism is the pan of the lock screw 1830 hits on the outside of tubes 1810 of the swinging wind-bell-chain 181. The third hit mechanism is the dangling tubes 1810 hit on the pans on the inside wall of the tubes 1810 during the swinging wind-bell-chain 181 hitting on the pan of the lock screw 1830.

Since the tube 1810 swiveling only in one direction, as shown in FIG. 2H, the fork 1811 is aligned in the tangent direction of the circle. As shown in FIG. 2B, the upper hanger 1813 and the lower hanger 1816 keep the tubes of the wind-bell-chain in the correct direction. The upper hanger 1813 passes through the string 1814 inside the hanging cap 180 as shown in FIG. 2J; the lower hanger 1816 passes through the string 18212 as shown in FIG. 2C. The strings 1814 and 18212 are in circle shape.

Figure 2E:
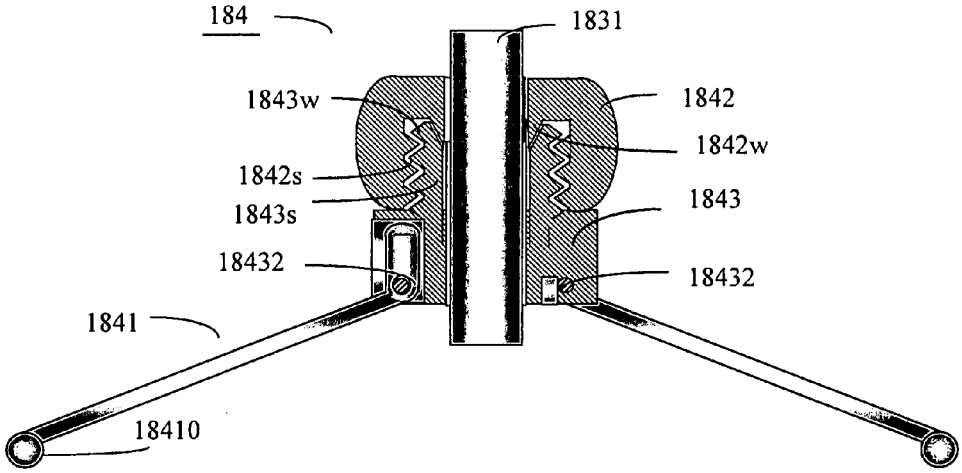
Figure 2F:
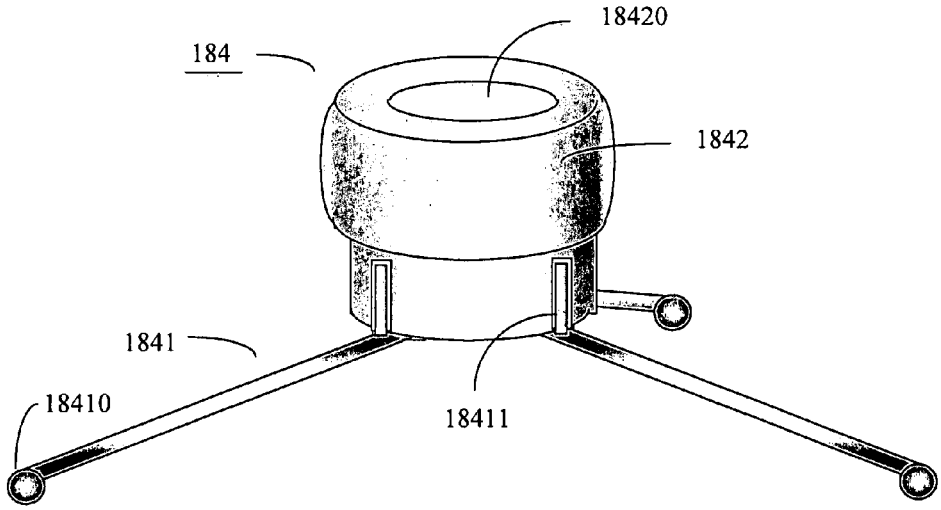
Figure 2G:
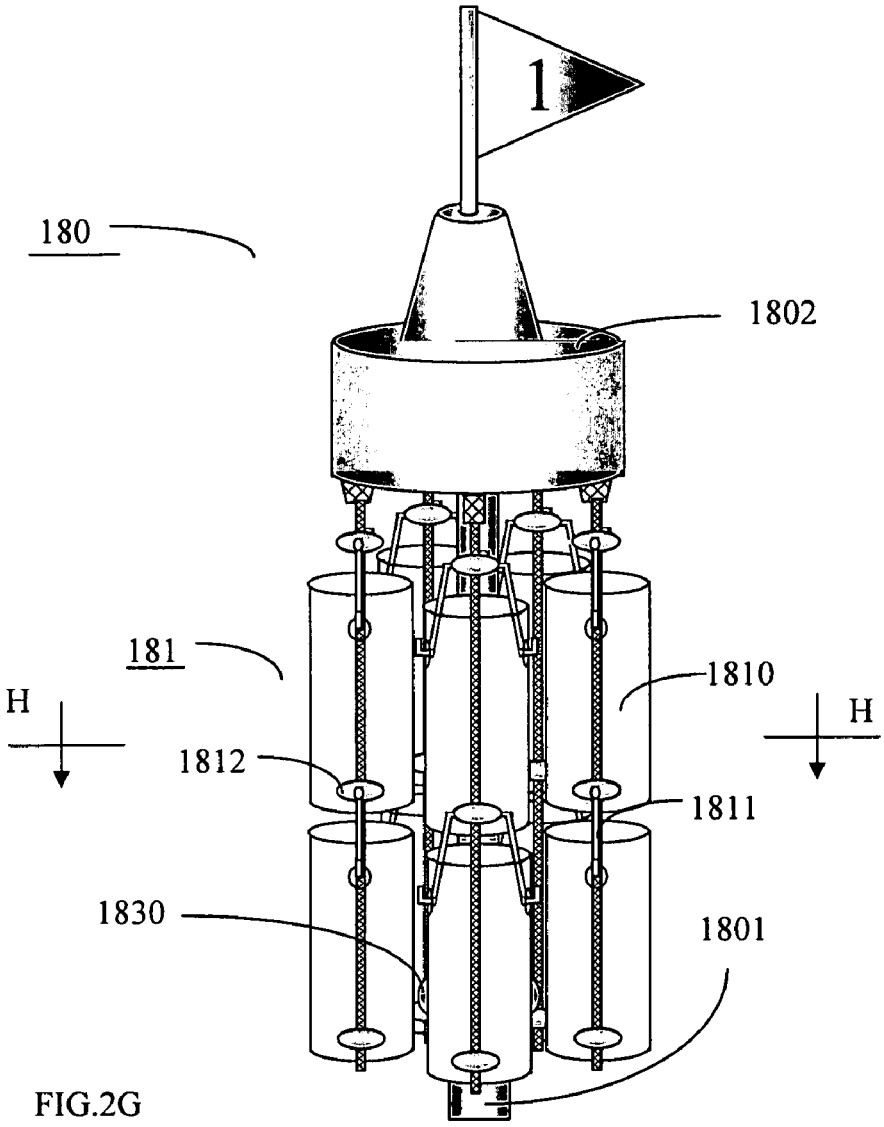
Figure 2H:
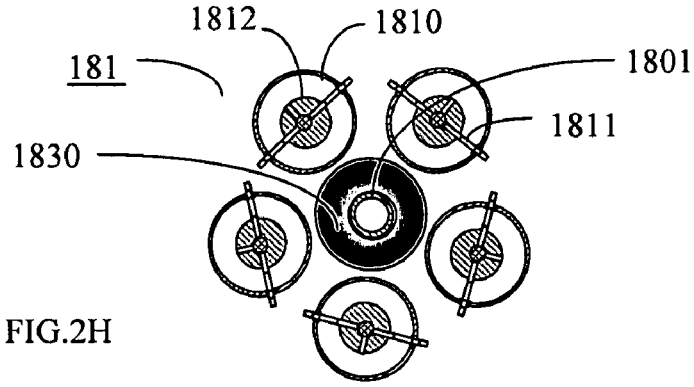
Figure 2I:
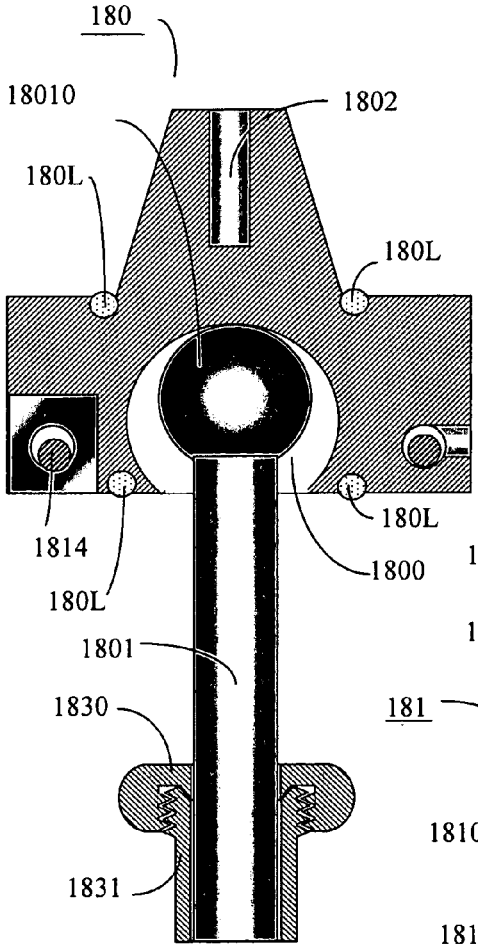
Figure 2J:
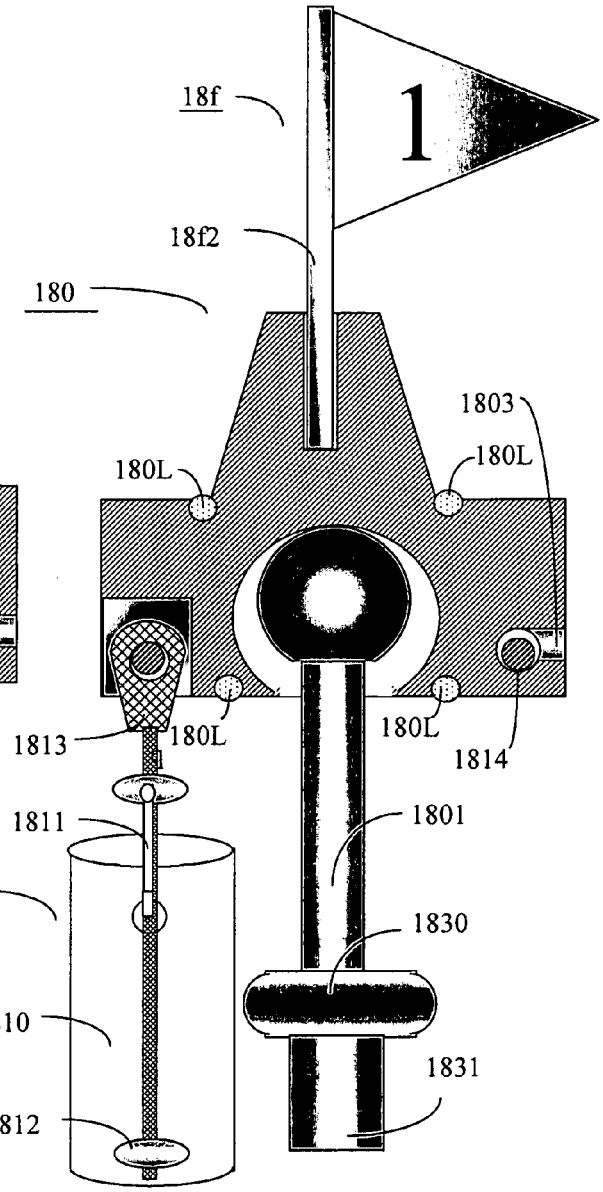
Figure 2K:
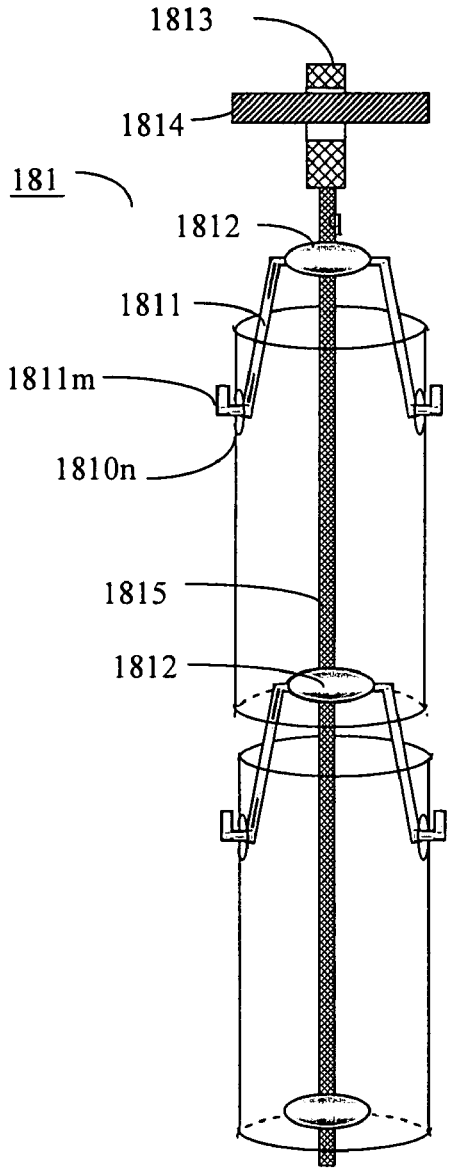
Figure 2L:
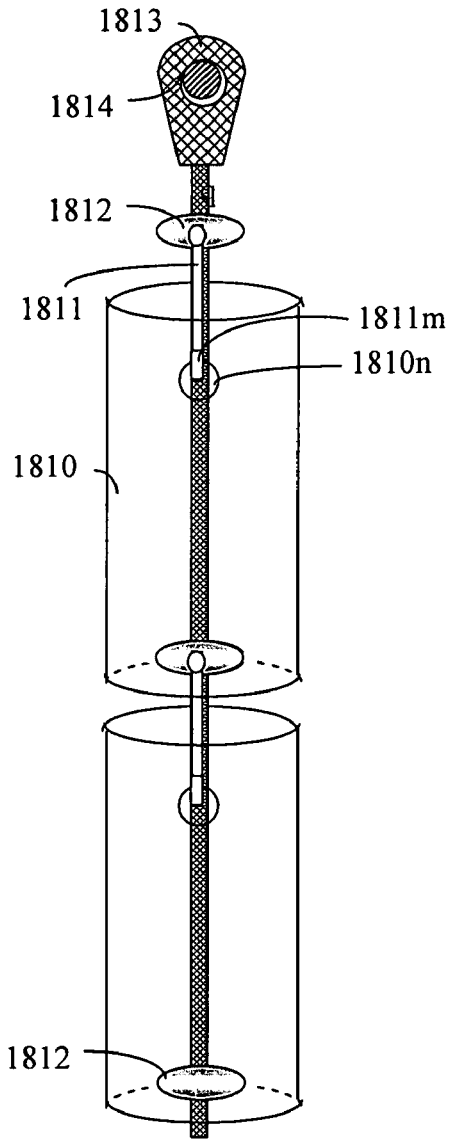

As shown in FIG. 2E and FIG. 2F, the stand 184 of the portable wind-bell-chain golfrisbee basket 18*wcp* has the similar structure of the basket 182. The only difference is that the stand 184 has only three legs 1841 and the legs 1841 are much stronger than the rib 1821 of the basket 182. The stand legs 1841 pivotally rotate on the string 18432 and bears against the cylindrical wall 1843 of the stand 184.

Figure 2M:
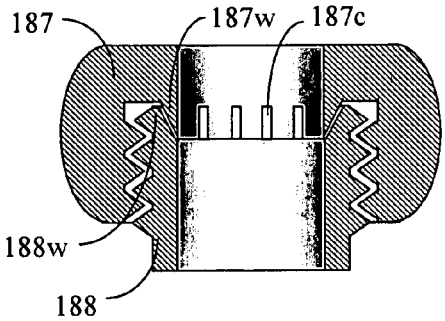
Figure 2N:
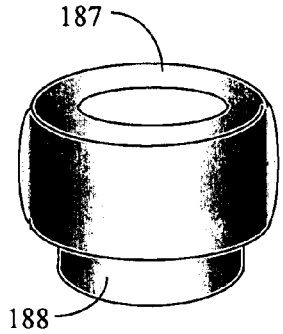
Figure 2O:
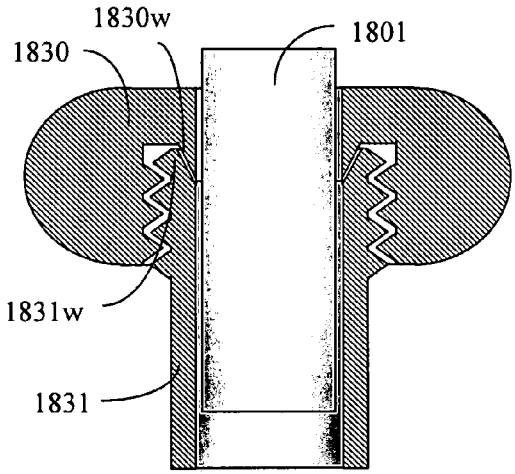
Figure 2P:
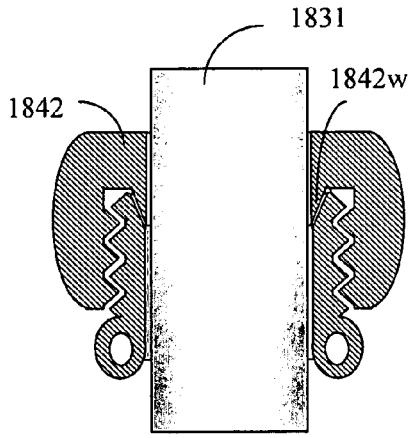
Figure 2Q:
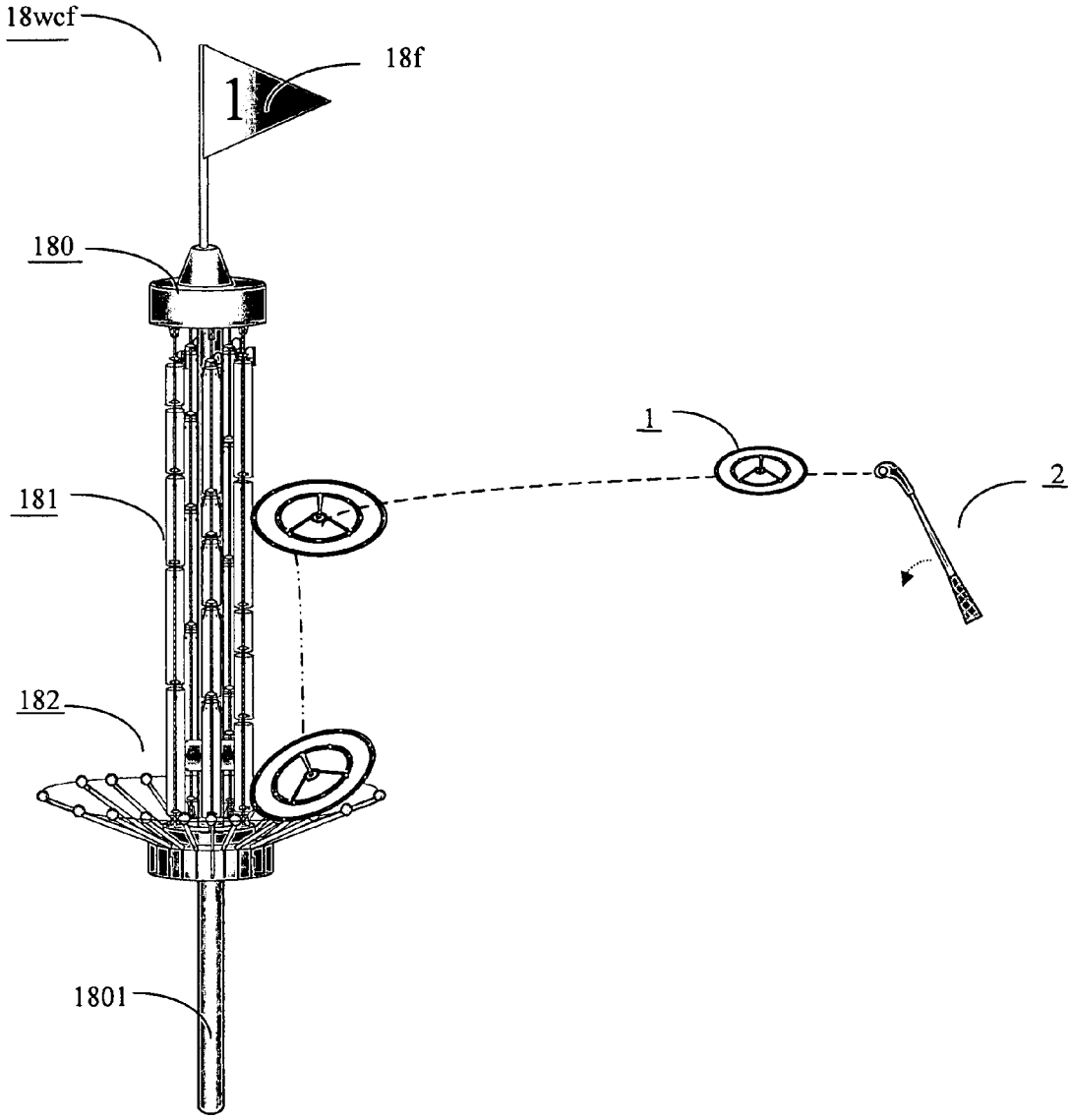
Figure 2R:
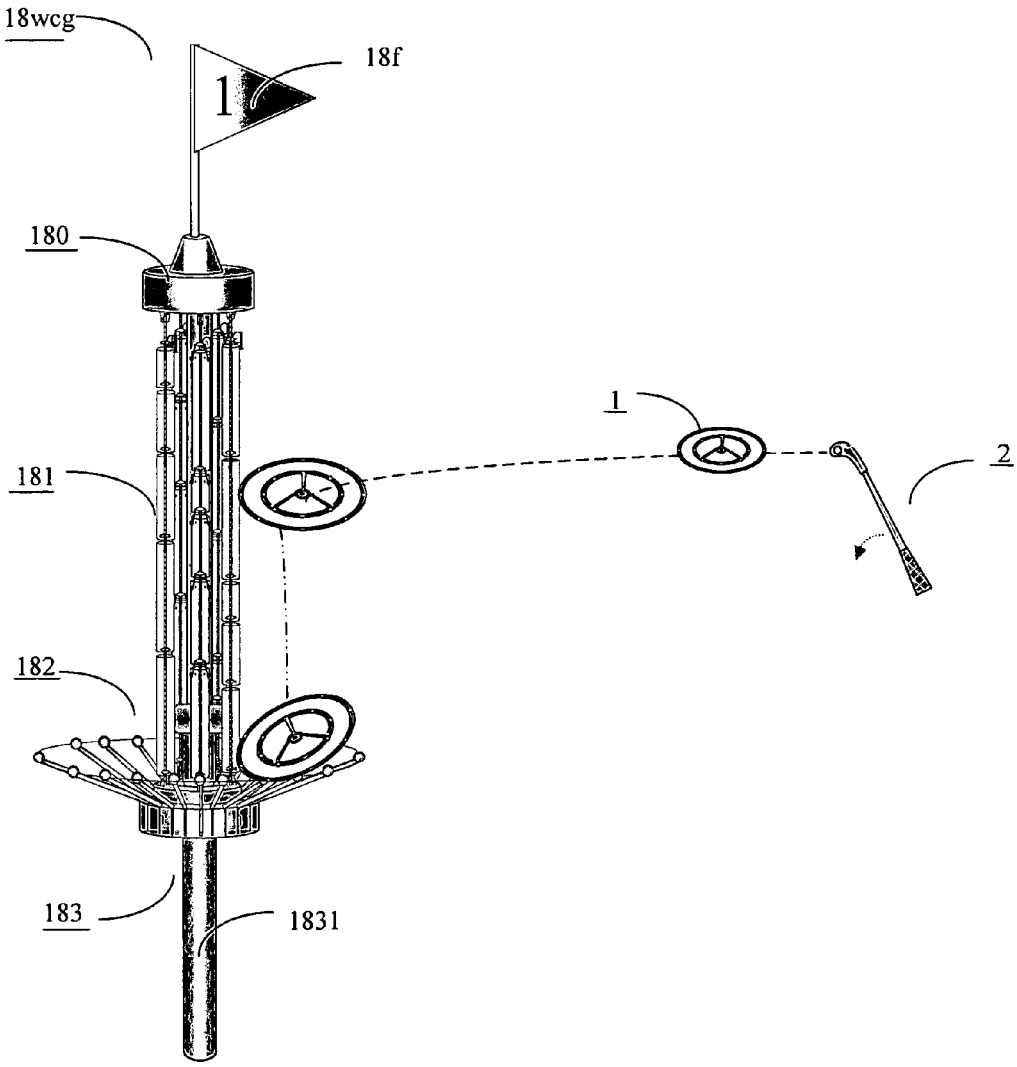
Figure 3B:
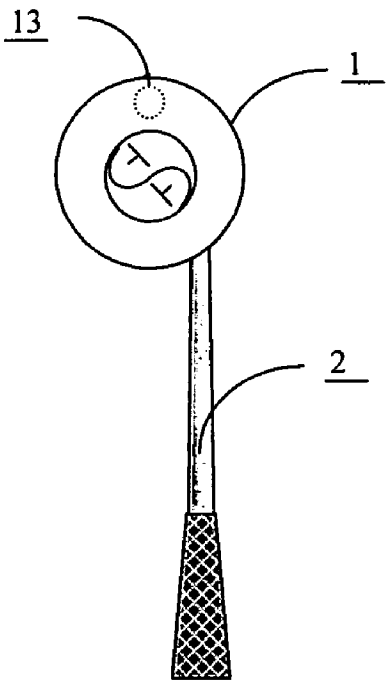
Figure 3A:
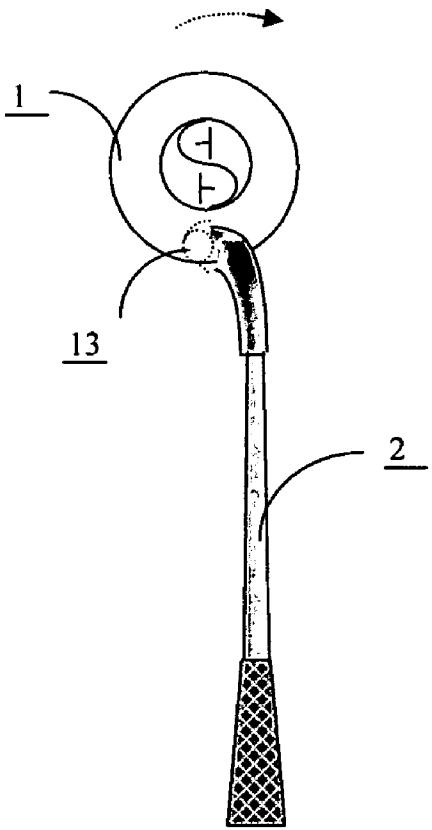
Figure 3D:
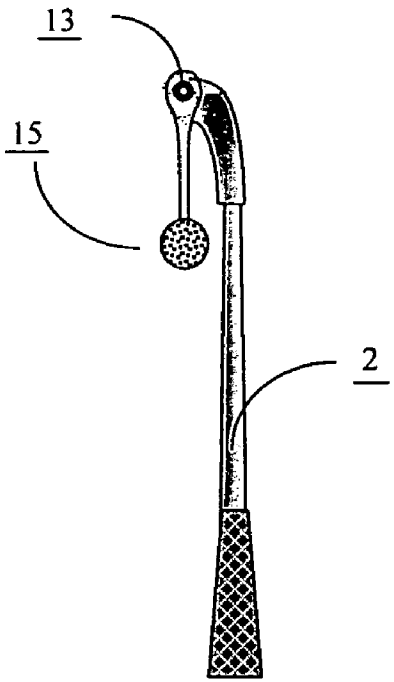
Figure 3C:
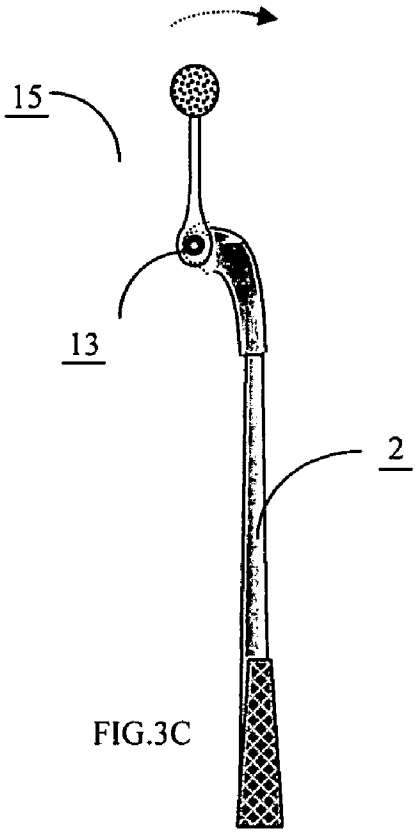
Figure 4C:
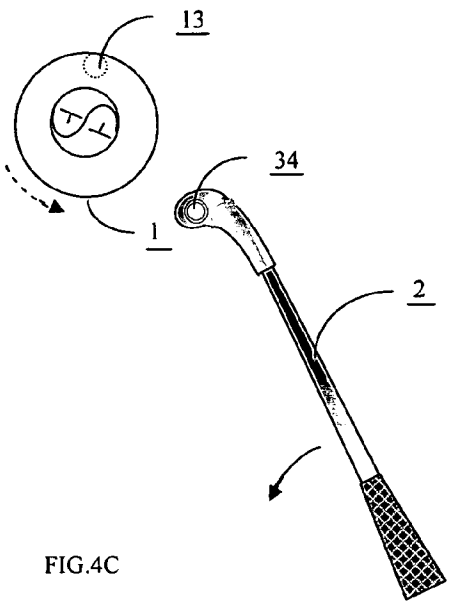
Figure 4A:
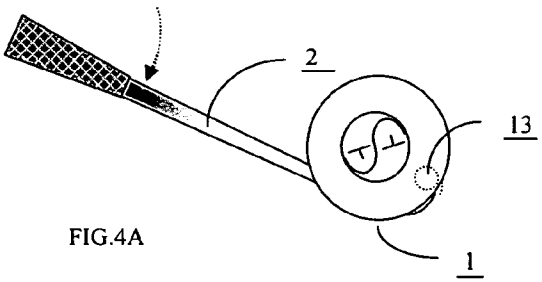
Figure 4B:
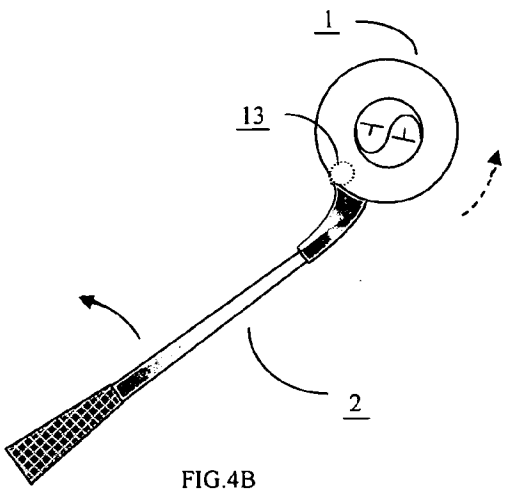
Figure 4F:
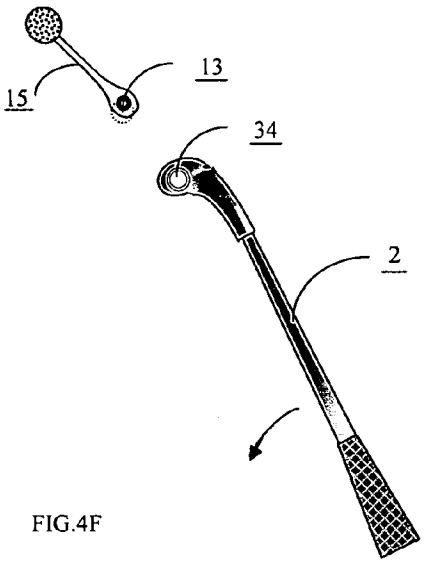
Figure 4D:
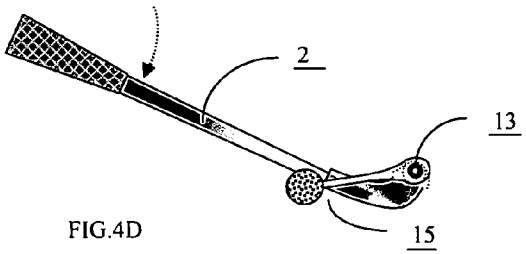
Figure 4E:
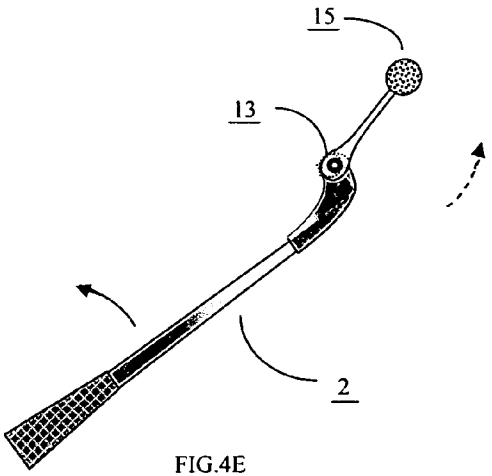

As shown in FIG. 2M, the portable wind-bell-chain golfrisbee basket adopts the lock screw technology. There are a circular wedge 187*w* on the female screw 187 and a circular wedge slot 188*w* on the male screw. On the circular wedge 187*w*, there are multiple cut 187*c*. As the female screw 187 rotates in the engaging direction, the wedge slot 188*w* squeezes the wedge 187*w* toward the center of the screw 187 to lock the pole passing the screw. As shown in FIG. 20 and FIG. 21, the wedge slot 1831*w* squeezes the wedge 1830*w* to engage and lock the extension pole 1801. As shown in FIG. 2P and FIG. 2E, the wedge slot 1843*w* squeezes the wedge 1842*w* to engage and lock the stand pole 1831.

Releasing the lock of the compact lock screw mechanisms, the reverted umbrella golfrisbee basket 18*wcp* with the wind-bell-chain is easily retracted to a portable size. As shown in FIG. 21, FIG. 2J and FIG. 2A, rotating the female screw 1830 in the disengaging direction, the lock of the supporting pole 1801 is released. The supporting pole 1801 can be slided into the stand pole 1831. As shown in FIG. 2A and FIG. 2D, the ribs 1821 are retracted to a bundle as the umbrella does. As shown in FIG. 2E, FIG. 2F and FIG. 2A, rotating the female screw 1842 in the disengaging direction, the lock of the stand pole 1831 is released. As shown in FIG. 2A and FIG. 2F, the stand leg 1841 are rotated downward and retracted to a bundle as the umbrella does. Then the stand 184 can be slided upward inside the wind-bell-chain 181. With the lock screw and the rotating ribs and stands, the golfrisbee basket is easy to collapse to small package to carry along.

As shown in FIG. 2Q, we can easily modify the portable wind-bell-chain golfrisbee basket 18*wcp* to be the fixed golfrisbee basket 18*wcf*. For the fixed golfrisbee basket 18*wcf*, the stand 184 and the stand pole 183 are not needed. As shown in FIG. 2A, FIG. 2P and FIG. 2J, the support pole 1801 is longer. The support pole 1801 is modified with the addition of a pan as the lock screw 1830 does.

As shown in FIG. 2R, it is the alternative way and the simplest way to modify the portable wind-bell-chain golfrisbee basket 18*wcp* to be the fixed golfrisbee basket 18*wcg*. It is just to take away the stand 184 and buries the stand pole 1831 in the ground directly.

Comparing our invention of the wind-bell-chain reverted umbrella golfrisbee basket 18*wcp* with the conventional disk golf basket, the conventional disk golf basket is very bulky and heavy. Without the free roll mechanism of the universal joint type ball 18010, the conventional disk golf basket is constituted of a large bundle of heavy steel chains. As the flying disk hit on the conventional disk golf basket, the impact will cause the damage of the disk. Therefore, the putting disk of the disk golf has thick rim to increase the contact area to reduce the damage of the disk. Our wind-bell-chain reverted umbrella golfrisbee basket is light and swiveling. It is light and foldable that it is easy to carry as the portable golfrisbee basket. The flying disk hits on the wind-bell-chain reverted umbrella golfrisbee basket, the flying disk will not have damage.

The large bundle of the steel chain of the conventional disk golf basket has no excitation as the putting of the golf ball. The thick rim of the putting disk reduces the performance of the flying disk's flying range a lot. With our wind-bell-chain invention, the section of the wind-bell-chain 181 is as small as the hole of the conventional golf sport does. The putting of golfrisbee disk is as exciting and challenging as the putting of the golf ball does. The golfrisbee 1 doesn't need to have the thick edge that the golfrisbee 1 doesn't lose the performance of flying range. The golher can have birdie, eagle or hole-in-one without the worry of the damage of the golfrisbee disk 1.

FIG. 3 is an elevation view of the mounting operations of the golfrisbee 1 and golfball 15. As shown in FIG. 3A, the golfrisbee 1 is mounted on the head 11 of golh club 2. Then the golfrisbee 1 is rotated 180 degrees to dangle on the head 3 of golh club 2 as shown in FIG. 3B. As shown in FIG. 3C, the golfball 15 is mounted on the head 3 of golh club 2 with the adaptor 13. Then the golfball 15 is rotated 180 degrees to dangle on the head 3 of golh club 2 as shown in FIG. 3D.

FIG. 4 is the top view of the swiveling operations of the golfrisbee 1 and the golfball 15. As shown in FIG. 4A, the golh club 2 is swiveled back to be ready to throw the golfrisbee 1. As shown in FIG. 4B, due to the eccentric force, the golfrisbee 1 rotates. As shown in FIG. 4C, the golfrisbee 1 takes off and flies in the sky. As shown in FIG. 4D, the golh club 2 is swiveled back to be ready to throw the golfball 15. As shown in FIG. 4E, due to the eccentric force, the golfball 15 pivotally rotates on the golh head. As shown in FIG. 4F, the golfball is thrown into the sky.

Figure 5C:
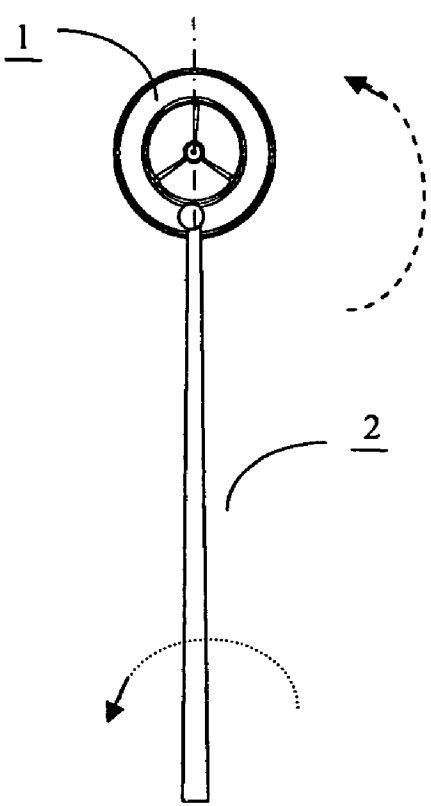
Figure 5B:
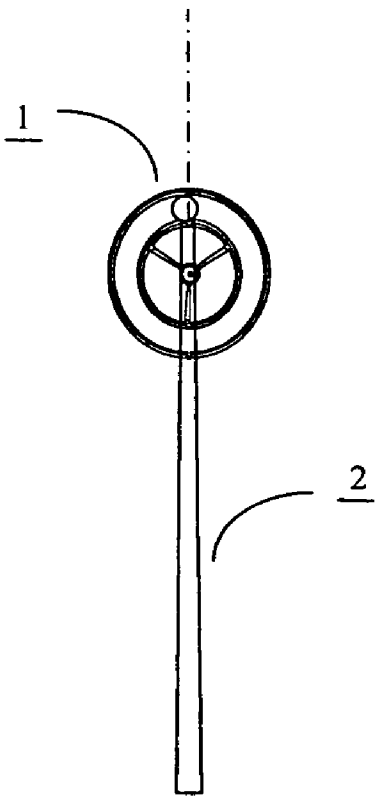
Figure 5A:
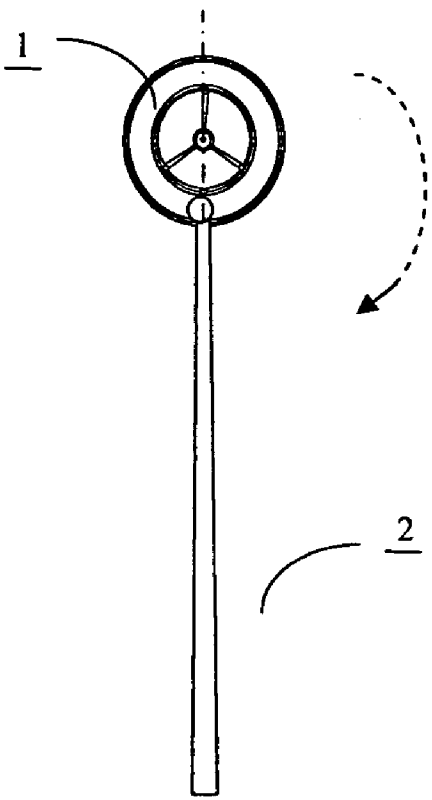
Figure 5D:
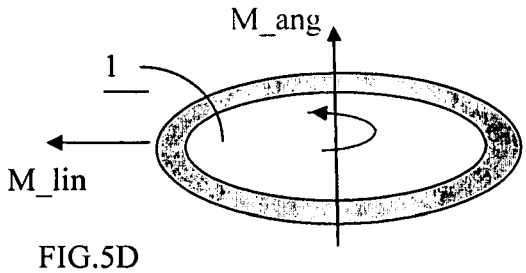
Figure 5E:
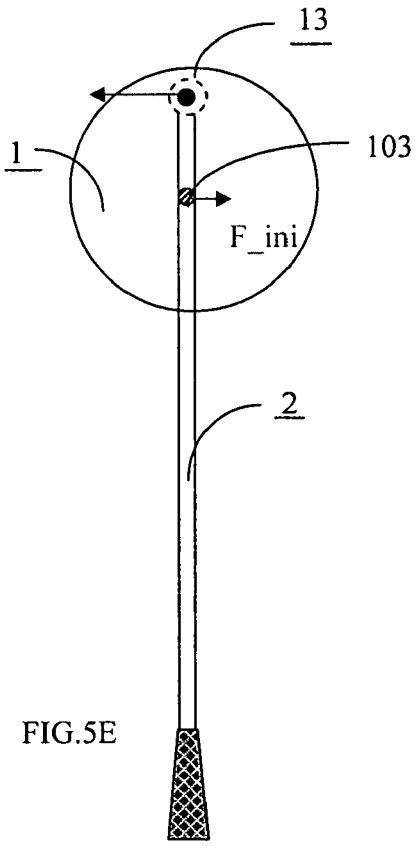
Figure 5F:
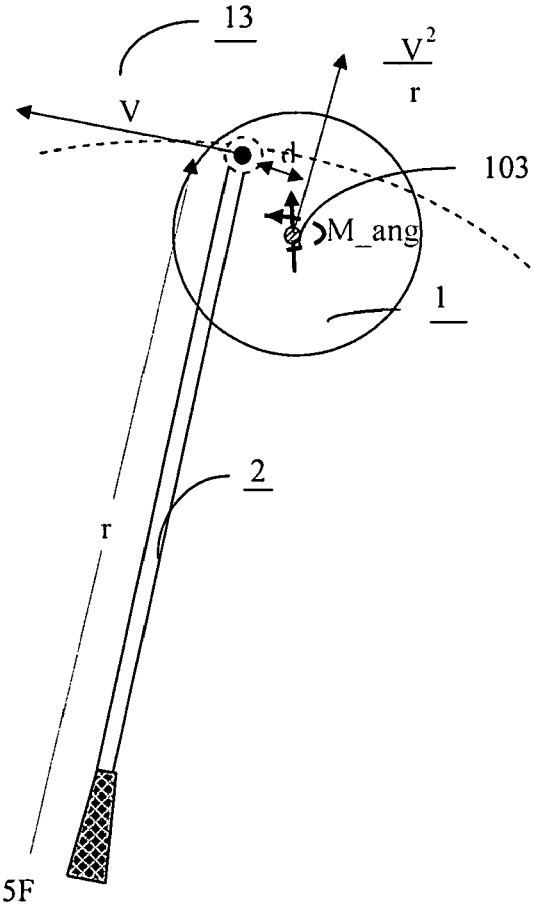
Figure 5G:
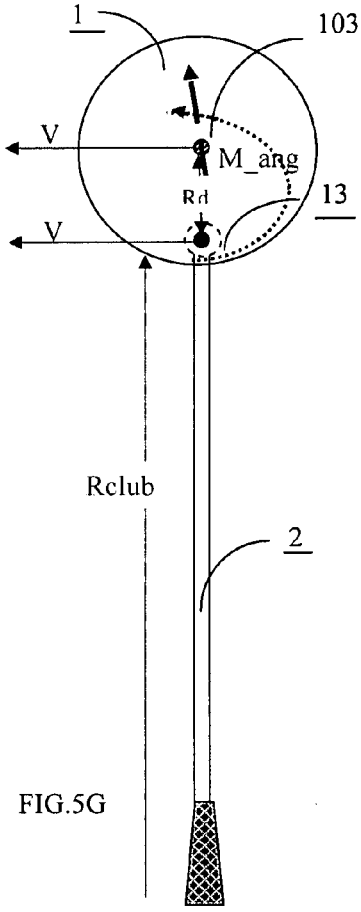
Figure 5H:
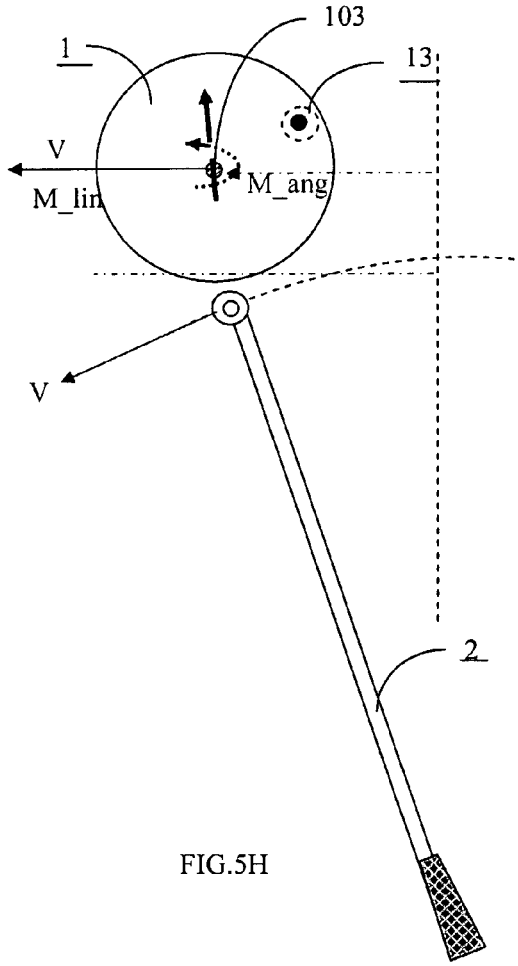
Figure 5I:
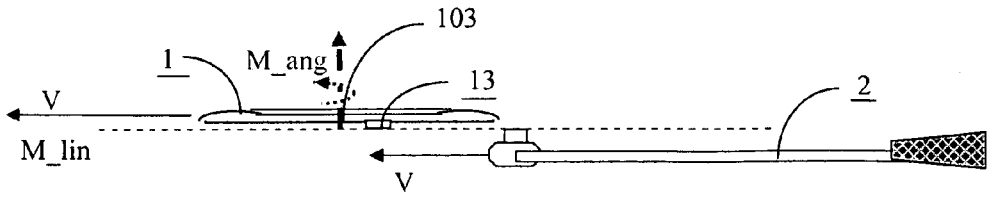
Figures 6B, 6C, 6D:
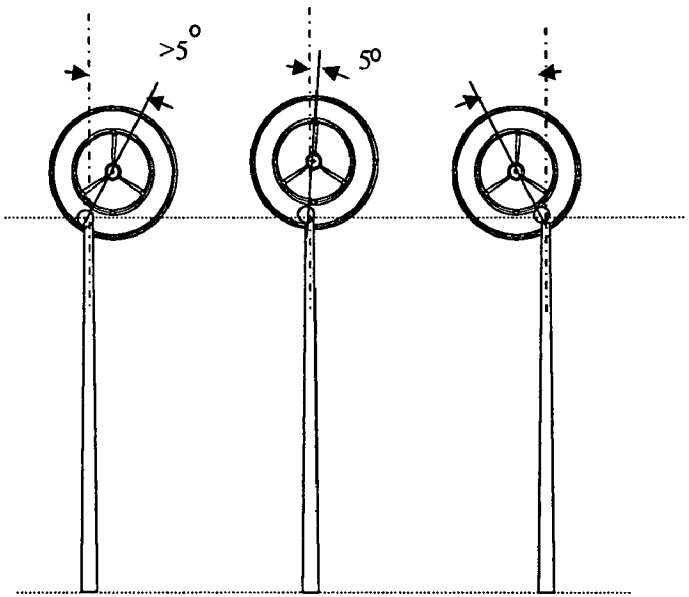
Figure 6A:
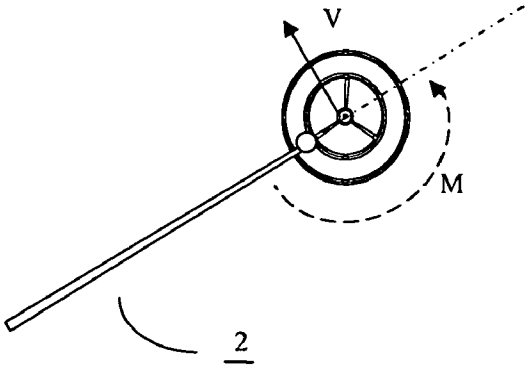

From FIG. 4 to FIG. 6, the mechanics of the golh club operations are analyzed in details. FIG. 6A is to illustrate the most important principle of the golh sport. The mounting golfrisbee position is the same as the launching golfrisbee position which is at the vertical straight extension line of the golh club. FIG. 5A shows the golfrisbee 1 is mounted on the head of the golh club 2 at the extension of the vertical straight line of the golh club 2. FIG. 5B shows the golfrisbee 2 rotates 180 degrees and dangles on the head of golh club 2. FIG. 5C shows the golfrisbee rotates 180 degrees due to the eccentric force of the swiveling circle of golh club 2. The golfrisbee launches to fly at the same position of the mounting golfrisbee 1.

The Frisbee flying in the air to keep its flying direction and balance, it must rotate to have the gyroscopic force to maintain its flying stability. To make the flying disc to rotate during the swiveling of pole or arm, the pivotal rotation center must not be coincident with the center of the gravity of the flying disc. This is referred to be the eccentric of the flying disc. For example, Swiveling arm to launch the flying disc, the finger holding the disc at the rim and the wrist is the pivotal center. The center of gravity of the flying disc is the rotational center. The rotational center of disc is not coincident with the pivotal center—the wrist. Similarly, swiveling club to launch the flying disc, the screw 13 at the rim of the disc is the pivotal center. The center or center of gravity of the flying disc is the rotational center. The rotational center of disc is not coincident with the pivotal center. It is referred that the pivotal center is eccentric to the rotational center.

As shown in FIG. 5D, there are two indexes to measure the flying performance of the flying disc: the linear momentum of the flying disc and the angular momentum of the flying disc. To have the larger flying stability, the flying disc needs to convert the energy of swiveling club to be the rotational angular momentum of the flying disc to have the gyroscopic force to stabilize the flying directional control. To have the longer flying distance, the flying disc needs to convert the energy of swiveling club to be the linear momentum of the flying disc to have the larger linear momentum and the larger kinetic energy to fly the longer distance.

As shown in FIG. 5E, to convert the energy of swiveling club to be the rotational momentum of the flying disc, the flying disc must have the conversion mechanism to convert the swiveling club energy to be the rotational momentum of the flying disc. The converting mechanism is the eccentric alignment of the rotation axis 103 of the center of the gravity and the pivotal rotation axis 13 of the flying disc 1 on the club head. Here, we mention the center of the gravity 103 and the pivotal rotation axis 13 are not coincident to be eccentric, i.e., Rd is larger than zero. Furthermore, the larger the eccentricity Rd is, the better performance the flying disc is. The largest eccentricity Rd is the radius of the flying disc. So the pivotal axle 13 is at the rim of the flying disc. As shown in FIG. 5E and FIG. 5F, through the Eccentricity of the pivotal axis 13 and the rotational axis 103, it converts the energy of swiveling pole to the momentum applying to flying disc. Converting to the angular momentum of flying disc, it builds up the gyrostatic force to stabilize the fly of flying disc.

As shown in FIG. 5G and FIG. 5H, the flying disc takes off from the club head with the maximum angular momentum and maximum linear momentum. The angular momentum M_ang of flying disc is proportional to the product of the product of (the radius of the flying disc rotation)×(the radius of the swing of the pole)×(the angular velocity of the swing of the pole of club)

$$M_ang \alpha Rd \times Rc \times \omega club$$

where Rd is referred to be the eccentric distance. Rd is the distance between the pivotal center and the rotational center of flying disc. The maximum eccentric distance Rd of the flying disc is the radius of the R_disc. So the pivotal center of the flying disc is at the rim of the flying disc.

The maximum radius of the swing of the pole R_c is the length of the club R-club plus the arm length $$Rc = R\ club + R\ arm$$

The linear momentum of flying disc is proportional to the product of the product of (the radius of the swing of the pole×the angular velocity of the swing of the pole of club)

$$Linear\ Momentum \alpha R_c \times \omega club$$

The rotational angular momentum of disc is proportional to the (V2/Rc)=(Rcω2); the linear momentum is proportional to the (Rcω). Both angular momentum and linear momentum of flying disc is proportional to the length of club pole R. The longer the club pole, the better the flying disc performance.

To improve the flying performance of flying disc, the swiveling pole must be better than the swiveling arm in performance. The performance must be proportional to the swiveling radius. For the swiveling arm, the swiveling radius is the arm length. For the swivel club, the swiveling radius is the sum of the arm length pulsing the club length. The larger the angular momentum and the linear momentum of the flying disc is, the longer distance the flying disc will fly. So, the throwing of the flying disc with the swing golf club has the much better performance than the throwing of the flying disc with the arm only. The longer the length the club is, the larger the linear momentum is, the larger the distance the flying disc will fly.

Furthermore, to disengage the flying disc from the club head, it must have the disengaging mechanism. The eccentric force is generated by the eccentric alignment of the rotational center 103 and pivotal center 13. Having the conversion mechanism converting from the swivel of the club pole to the rotation of the disc, the detaching mechanism is based on the rotation of disc. Comparing FIG. 5E with FIG. 5G for the flying disc 1 having the swiveling club 2 induced rotational capability the disengaging mechanism is the rotational directional lock and unlock mechanism 13. As the flying disc pivotally rotates at the position having the maximum tangent velocity of swiveling club as shown in FIG. 5G, the engaging-disengaging mechanism will unlock and release the flying disc to fly. The eccentric alignment of the pivotal club head and the center of golfrisbee causes the rotation of the disc. The eccentricity converts the swivel of club to be the rotation of the disc. The automatic rotation of fly disc can change the directional relation between the flying disc 1 and the club 2 that the directional detach mechanism 13 can be implemented. The screw 13 serves as the directional engage/lock detach/release mechanism. So the eccentric alignment is the essential to both the rotation of disc and directional detachment mechanism.

As shown in FIG. 5G, FIG. 5H and FIG. 5I, having the directional unlock and detaching mechanism, as the flying disc 1 takes off at the optimum position with the maximum rotational momentum and linear momentum, the flying disc is in the plane being parallel to the swiveling club.

Why the golh club 2 throwing golfrisbee disk 1 has such superior ultra long range flying capability? For the other inventions, their poles usually have the moving mechanical part and the clamping force of the mechanical part causes the disk to have an unsmooth take-off. Their disk flying direction is in the radial direction of the swiveling circle or in line with the swiveling pole. Our golfrisbee disk 1 flying direction is in the tangent direction of the swiveling circle of the golh club 2. Furthermore, their eccentric force of the pole swing doesn't generate the rotating momentum of the flying disk. Comparing with other designs, our invention has the following six important characteristics. The first characteristic is to use the eccentric force of the swivel of the golh club to build up the angular momentum of the flying disk. The golfrisbee disk rotates as it takes off from the golh club. The second characteristic is the flying direction of the golfrisbee is in the tangent line direction of the swiveling circle of the golh club. The third characteristic is the clamp-free of the screw mechanism that the golfrisbee is easily to smoothly take off. The fourth characteristic is there are no moving mechanic parts in the engaging and releasing of the golh head and golfrisbee. The fifth characteristic is the golfrisbee flying plane and rotating plane are in parallel to the golh club swiveling plane. The sixth characteristic is the golfrisbee flying plane and flying direction are in the plane of the golfrisbee disk plane. To be compatible with the superior ultra long range throwing capability, the golfrisbee disk must have the superior aerodynamic design of the rotating airfoil design. The superior launching way and the superior airfoil design of the golfrisbee design make the golh sport have the ultra-long flying distance and superior performances.

The golh is a sport comprising a swivel means of golh club 2, a flying means of golfrisbee 1 and a hanging means of golfrisbee basket 18*wcp*. The golfrisbee 1 is one kind of the flying object only. The golh club 2 can throw many different flying objects such as disk, ring, ball, boomerang, etc. The fitting screw is for flying object pivotally mounted on the club head of golh club 2. The pivotal mount is eccentric to the center of the flying object. The flying object pivotally rotates due to the eccentric force induced by the swivel of club 2. As shown in FIG. 3, the rotation of the flying object is in parallel to a plane of the swivel of the golh club. The fitting screw 13 is pivotally rotating on the club head 34 as the golh club 2 is swiveled with hands. The flying object with the fitting screw 13 is pivotally mounted on the club head 34. The fitting screw 13 has frictionless lock-and-release with club head 34. The flying object is launched to fly based on the directional relation between the club head 34 and fitting screw 13. The club head 34 is located at the end portion of the pole and the flying object is mounted at the end of the club 2. The flying object rotates due to the eccentric force of the swivel of club 2 that the fitting screw 13 pivotally rotates to a position to unlock the frictionless lock with the golh club head 34. The flying object is released and launched to fly.

The fitting screw 13 and club head 34 not only serve as a pivotally rotation but also serve as a directional lock and release. Based on the rotational direction, the pivotal mount of the flying object is locked or released. With the directional lock-and-release mechanism being embedded between the club head 34 and the fitting screw 13, swiveling the pole of golh club 2, the flying object automatically rotates toward outside of the swiveling circle due to the eccentric force. For the directional lock-and-release mechanism, the automatic rotation of the flying object changes the directional relation with the club head 34 from lock to release. The head 34 releases the fitting screw 13 to launch the flying object to fly, FIG. 6A shows the dynamics of the swiveling golh club 2 at the launching point. At the launching position, the golfrisbee 1 has the tangential velocity V and the angular momentum M. Swiveling the golh club 2, momentum and eccentric force transfer o the flying object. It rotates the flying object to a new direction to release the lock. With the momentum transfer, the flying object is driven to fly in a long distance with a swivel of the golh club 2. The eccentric force causes the pivotal rotation and generates gyroscopic force to stabilize flying object's flying. The directional lock-and-release mechanism is made of fitting screw 13 and club head 34. The pivotal rotation of the flying object causes the lock-and-release mechanism from lock to release.

FIG. 6 illustrates the selection of the optimum launching point. As shown in FIG. 6B, if the golfrisbee 1 launches before it arriving the extension line of the club pole more than 5 degrees, it is too early to launch the golfrisbee 1. As shown in FIG. 6C, if the golfrisbee launches within 5 degrees before it arrives the extension line of the golh club 2, it is the optimum point to launch the golfrisbee 1. As shown in FIG. 6D, if the golfrisbee launches after it arrives the extension line of club pole, it is too late to launch the golfrisbee 1. There is a very narrow window of 5 degrees for the optimum operation to launch the golfrisbee disk. Swiveling the golh club to launch the golfrisbee disk at the optimum point which has only 5 degrees of optimum operational window, it is the art of the golh.

Figures 7A, 7B:
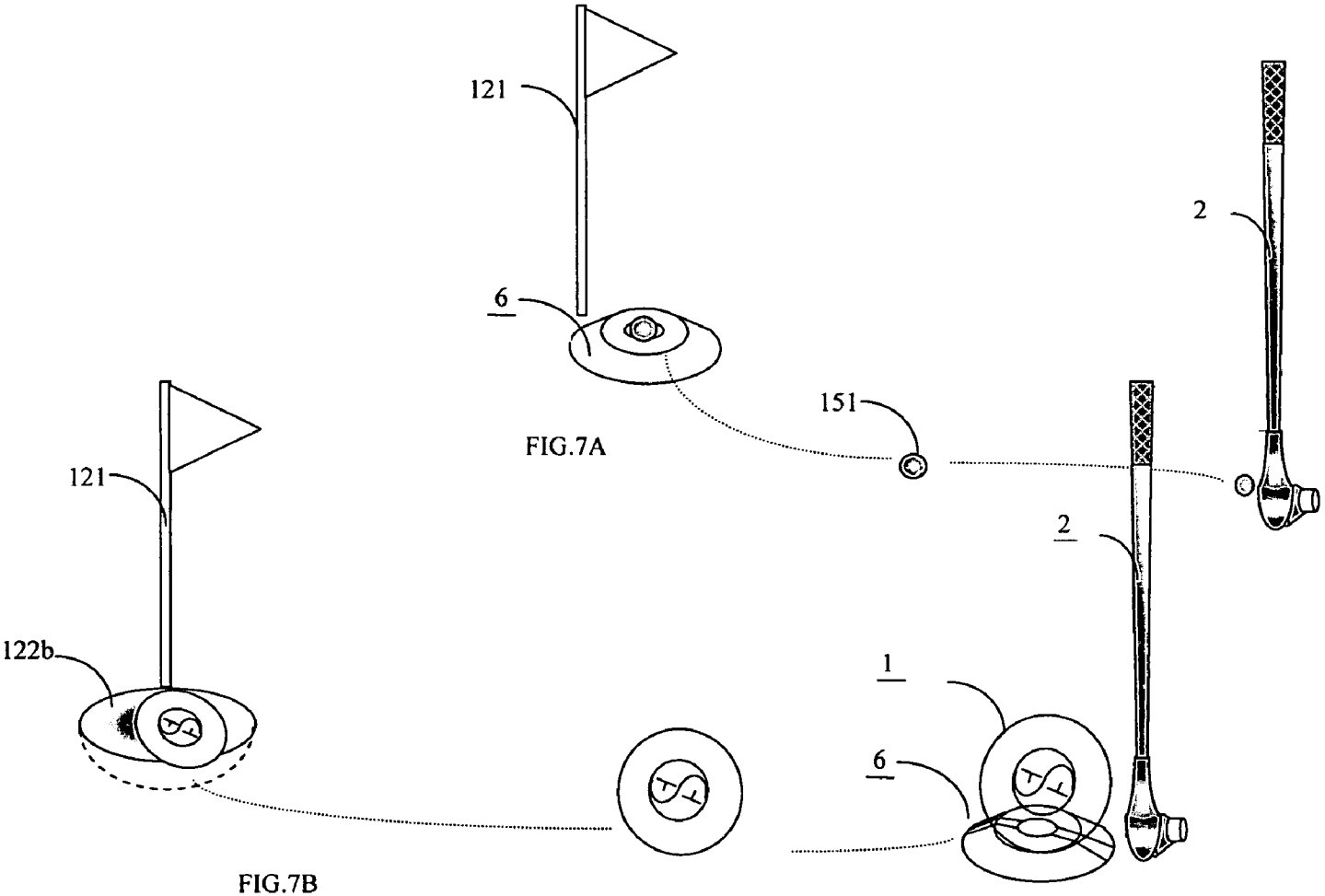

In the course golh, the golh is the hybrid sport constituted of the flying golfrisbee, flying golfball and rolling ball. The golh can also play in the park as the park golh. However, the park golh is limited to the flying golfrisbee and the rolling ball. Unless you are outside the plan grass area, you can use the flying disk to make the long drive to fly. If the golher putt with golfrisbee and the golfrisbee falls outside the golfrisbee basket in the Green area, then the golher has to putt the ball to roll into the hole, i.e. putting Green. In park golh, as the object flying in the sky, it is the flying disk. As the object rolling on the ground, it is the rolling ball. In the strong wind, the goher may use the golfball. To make the dogleg turn of the flying path, the goher may use the boomerang golfrisbee or boomerang. As shown in FIG. 1A and FIG. 7A, from long drive to putting, the golher changes the golfrisbee to golf ball. In golh, the golher does not need to change club. The same club can either launch the golfrisbee or putt the golfball. In the park golh, you cannot play the flying golfball or golf ball in the park. The golh can be played in the park as the flying disk being played in the park. However, you can fly disk in the park. Park golh is safe to play in the park and it is invented for the Olympic golf sport.

FIG. 7 shows the swiveling golh club 1 to put the ball and golfrisbee to roll. The head of the golh club 2 is in the shape of the head of golf club. One side of the golh club head is to launch the flying objects to fly and the other side is to putt the ball 151 as conventional golf club does. FIG. 7A shows the ball being putted with club 2 to roll into a universal portable hole 6. In golf, from long drive to putting, the golfer changes from wood club to steel club. The golf ball does not change. In golh, from long drive to putting, the golher changes from golfrisbee to golf ball. FIG. 7B shows the golfrisbee 1 seats on the universal portable hole and is putted with golh club 2 to roll into a portable hole 6.

Figures 25A, 25B, 25C:
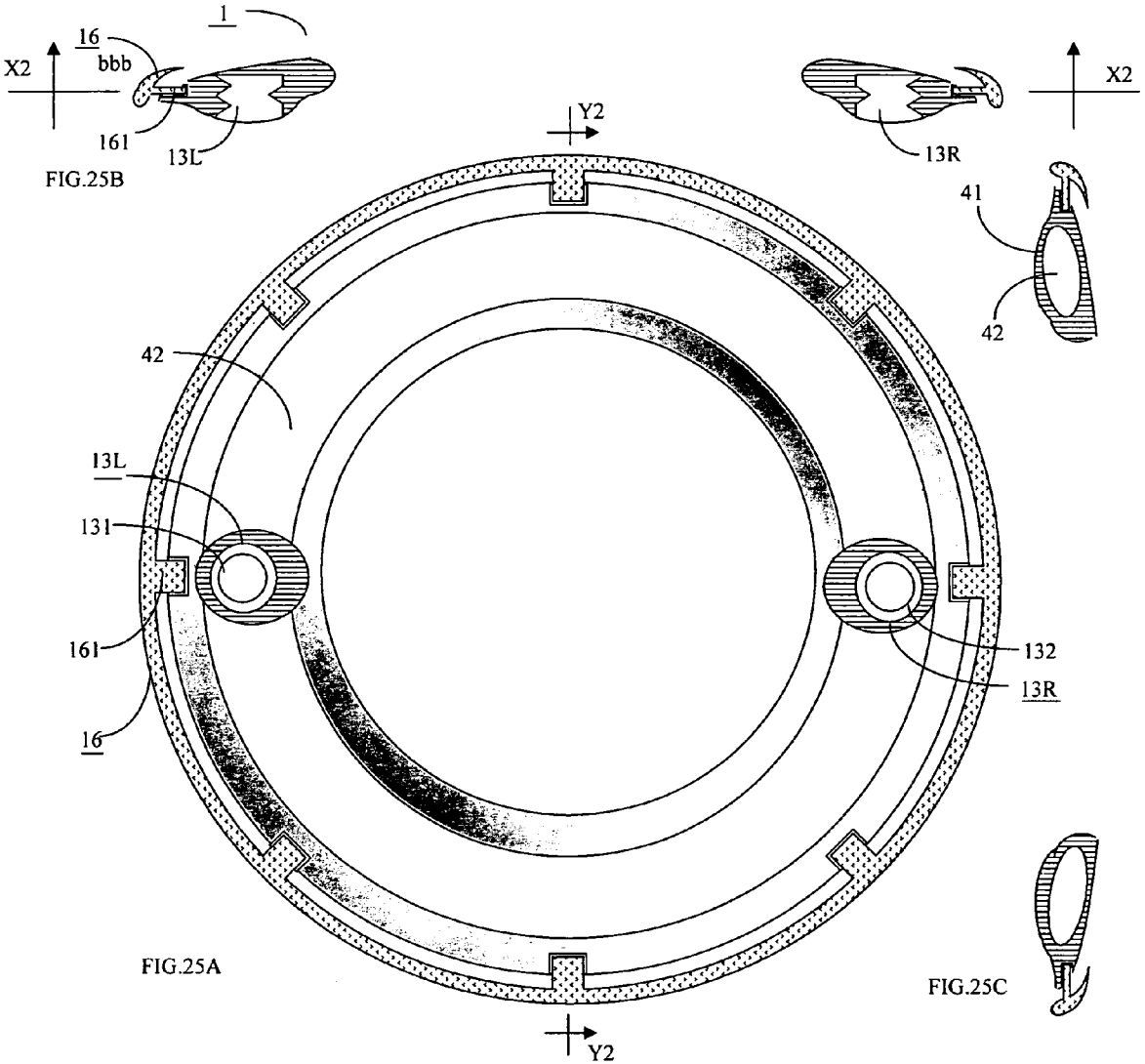
FIG. 25 is the section view of the golfrisbee diskring; (A) is the bottom view of the golfrisbee taken along the line X2—X2 in FIG. 25B; (B) is the horizontal section view; (C) is the vertical section view taken along the line Y2—Y2 in FIG. 25A.

FIG. 8 and FIG. 9 show the basic golh set which includes the golfrisbee 1, golfball 15 and golh club 2. As shown in FIG. 8, it shows the basic set of the golh. The golh is the golf hybrid of flying disk and ball. The disk 1 in golh sport is referred as golfrisbee 1. The ball in golh sport is referred as golfball 15. The ball in the conventional golf sport is referred as golf ball. Both golfrisbee 1 and golfball 15 are derived from the same club-swiveling throw art. The golfrisbee 1 or golfball 15 is thrown into the sky with the golh club 2 swiveling. The golfrisbee has many kinds of different designs. As shown in the FIG. 23, it shows the helicopter type boomerang wing segment 17. As shown in FIG. 25, it shows the UFO disk type design.

Figure 8A:
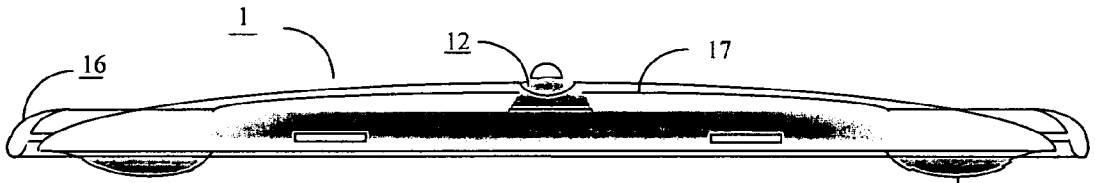
Figure 8B:
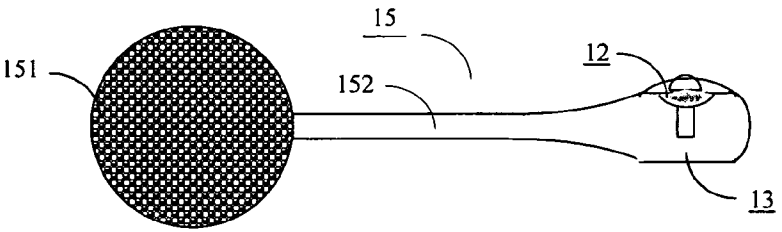

FIG. 8B shows golfball 15 which uses the same launching mechanism as golfrisbee 1 does. The flying object is a golfball 15. The golfball 15 comprises a ball 151 and an arrow stick 152. The fitting screw 13 is mounted on one end of the stick 152. The other end of the stick 152 is inserted in the ball 151.

Figure 8C:
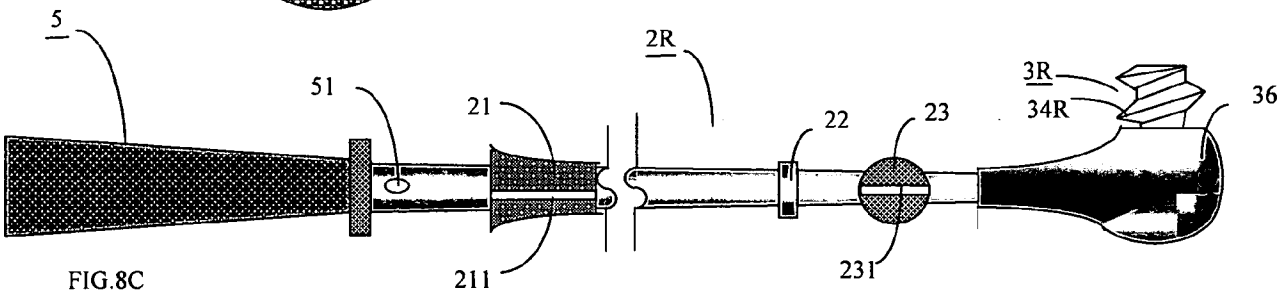
Figure 8D:
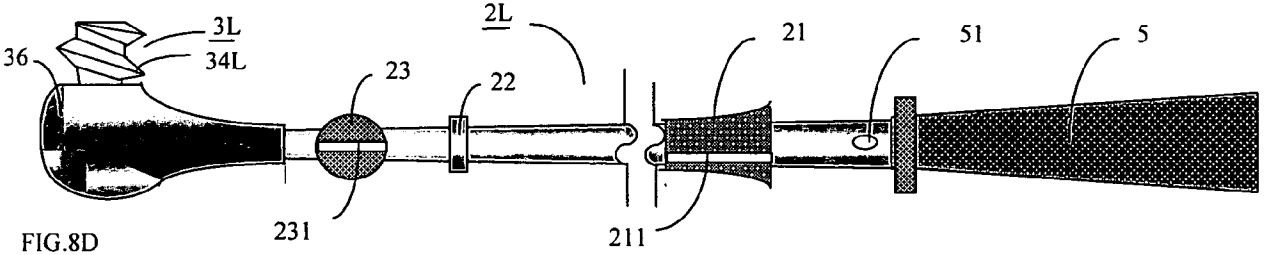

FIG. 8C is the right-hand golh club 2R; FIG. 8D is the left-hand golh club 2L. The weight 23 is to train the golher to develop the golh muscle. The slot 231 is to have the weight 23 to be mounted on the golh club. The fixed handle 5 is located at the end of the golh club. The sliding handle 21 is to have the natural slow-to-fast swing movement. The slot 211 is to have the sliding handle 21 to be mounted on the golh club.

Figure 8E:
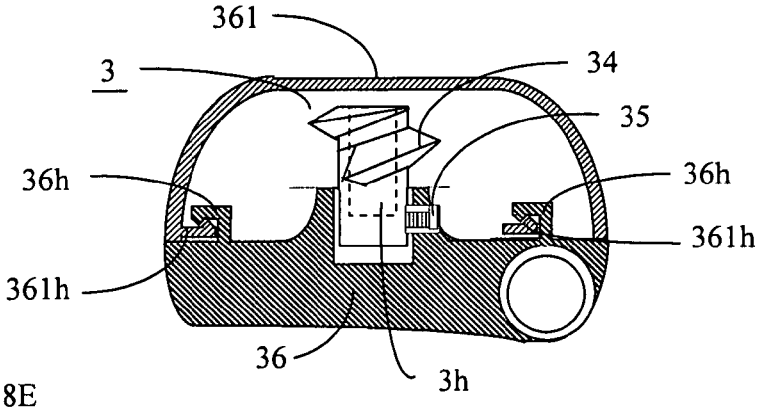
Figure 8F:
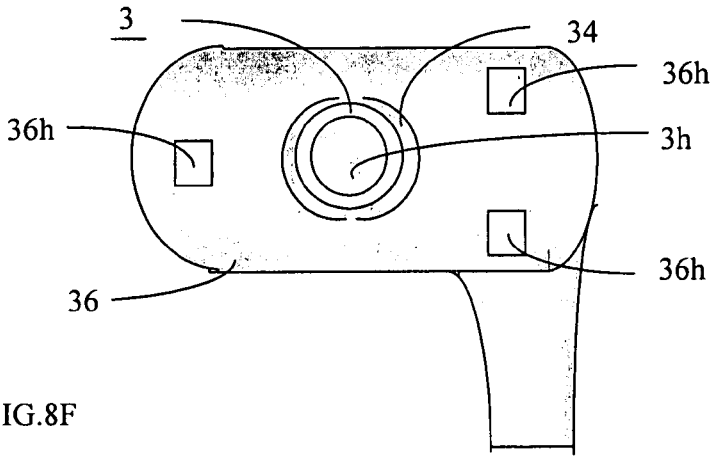
Figure 8G:
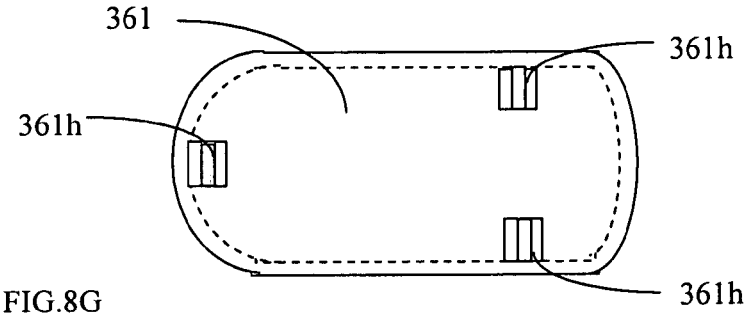
Figure 9A:
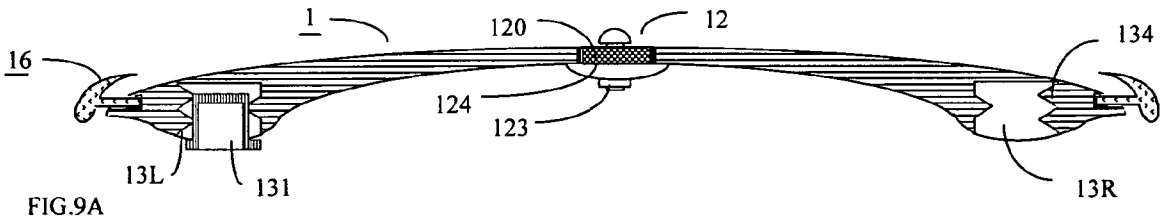
Figure 9B:
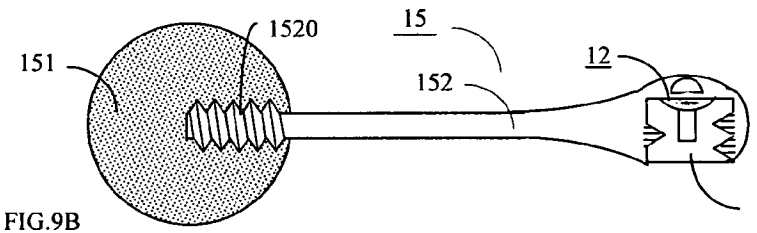
Figure 9C:
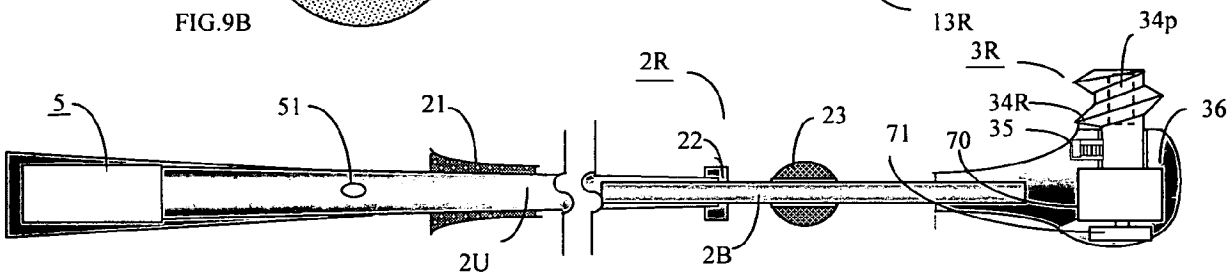
Figure 9D:
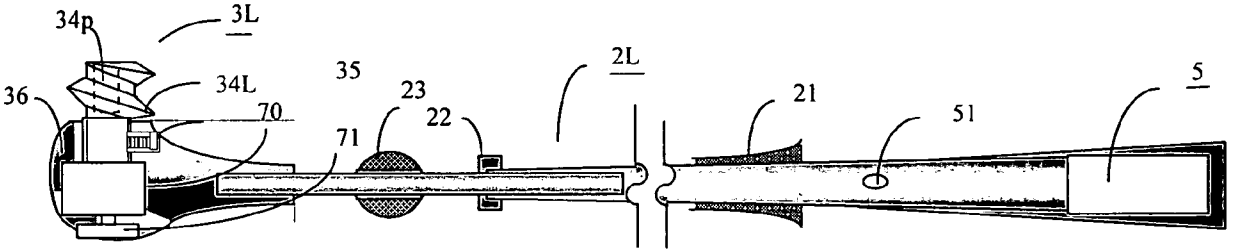

As shown in FIG. 8E and FIG. 8F, the screw 34 is made of a pair of semi-circle teeth. There is an indented hole 3*h* on the screw 3 to adapt the light means 12 as shown in FIG. 9B, etc. Since the golfrisbee sport adopts the screw mechanism to swivel and launch the golfrisbee to fly with the golh club, we need to protect the screw mechanism. As shown in FIG. 8E, FIG. 8F and FIG. 8G, the dust cover 361 sliding mounts on the golh head 36 to protect the screw 3 from the dust. As shown in FIG. 8F and FIG. 8G, mounting the dust cover 361 on the golh head 36, then slides the dust cover 361 sideward to lock the dust cover 361 with club head 36. The dust cover hooks 361*h* engage with and are locked with the golh head hooks 36*h* as shown in FIG. 8E.

FIG. 9 is the section view of the golfrisbee and the golh club. The golfrisbee is in the UFO shape with right-handed screw cap 13R and left-handed screw cap 13L. This is the basic model of the golfrisbee 1. Due to the co-existence of the screw caps 13R and 13L, the weight of golfrisbee 1 is well balanced. The dust cover 131 is to protect the screw 13R and 13L from the dust. Due to the weight balance, it does not have the wobbling phenomena that the flying distance is much longer than the unbalanced flying disk.

Figures 10E, 10F, 10G, 10H:
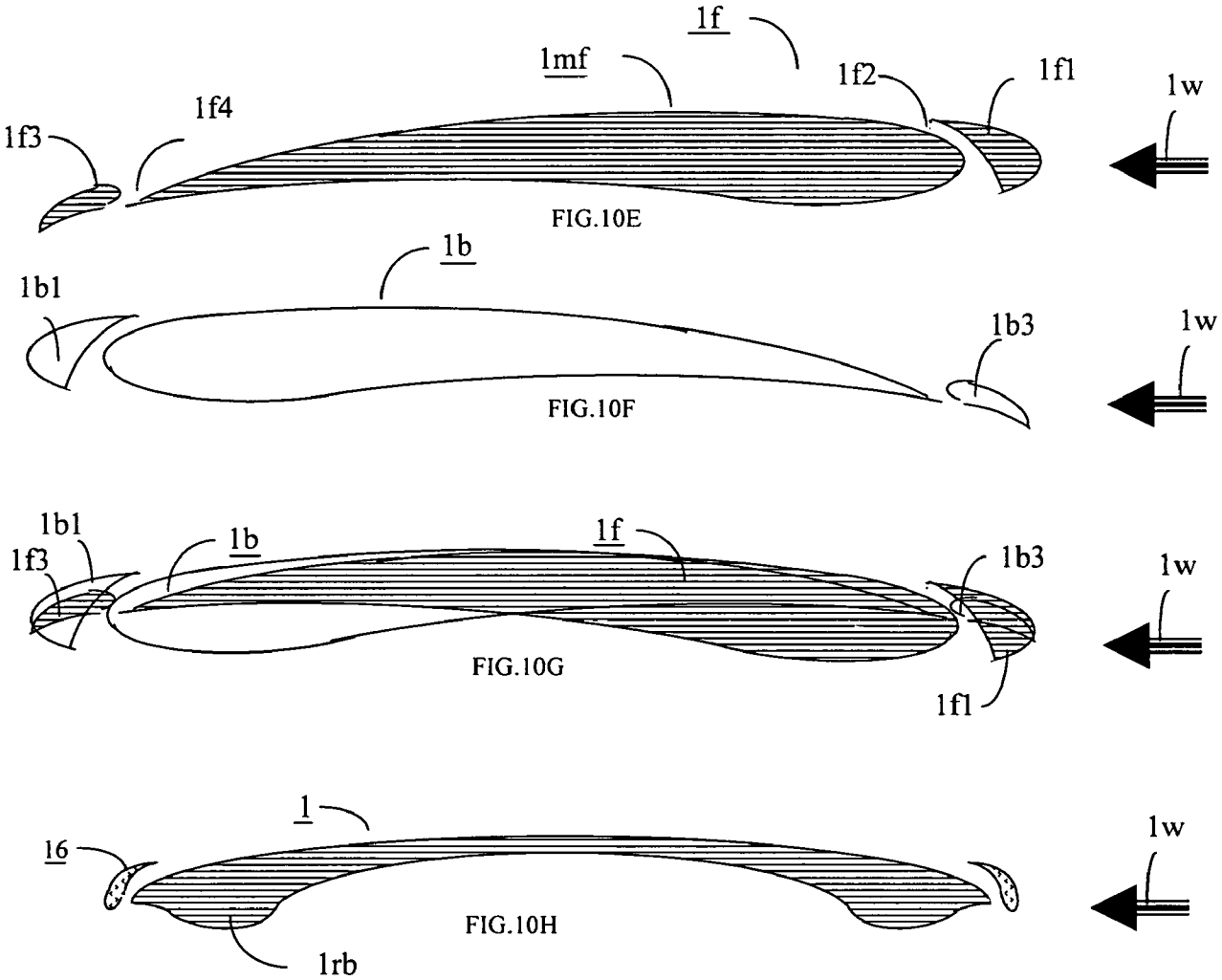

Furthermore, the screw caps 13R and 13L are embedded in the body itself. Since the screw cap 13R and 13L are located at the rim. To embed the screw cap 13R and 13L in the body of the golfrisbee, the rim of the golfrisbee has the ring band 1*rb* structure as shown in FIG. 10D and FIG. 10H. The ring band 1*rb* is generated from the universal directional wing as shown in FIG. 10. Since the golfrisbee is not thrown with hand, it is not necessary to have the edge for the hand holding and throwing. The golfrisbee is launched with the golh club; it does not need the hand holding vertical edge of flying disk. It has the smoothly curved design in the middle portion of the bottom of golfrisbee. It reduces the aerodynamic drag force that the golfrisbee can fly longer and further. The left-hand screw 34L is fit in the left-hand cap 13L; the right-hand-screw 34R is fit in the right-hand cap 13R. Except the left-hand screw 34L, the structure and operation of the left-hand golh club 2L are the same as the right-hand golh club 2R.

The right-handed screw 3R has the right-handed screw 34R notched on its top end. The bottom of the right-handed screw stub 3R is pivotally mounted in the club head 36. The screw 3R is locked with the locking screw 35. For the fixed cap 13R of one golfrisbee 1, the rotation of launching screw 3R is to adjust for the optimum launching position as shown in FIG. 6C. To launch the golfrisbee with golh club properly, the allowance of angle of the screw 3R rotation is only 5 degrees.

The slotted skirt 16 is the overlap of the slotted flap 1*f*3 and the slotted slap 1*b*1 or the overlap of the slotted flap 1*b*3 and the slotted slap 1*f*1 of the universal directional wing as shown in FIG. 10G and FIG. 10H. The skirt 16 introduces the side stability without the loss of the dogleg fly capability. Furthermore, the slotted skirt 16 serves as the bumper to protect the people from being hit. The slotted skirt 16 has the bumper design to play safe in the park. The slotted skirt 16 made of the foam material has the slotted opening space between the golfrisbee main plane and the skirt 16. The slotted skirt 16 of the golfrisbee 1 has the function of the long-range stability of the spoiler rim; however, the skirt does not have the drag caused by the spoiler rim as the Aerobie disk does. Theoretically, the farthest distance comes from throwing angle at 45 degrees. To throw 45 degrees, it is not necessary to throw the flying disk level. With the slotted skirt 16, the golfrisbee can throw at high angle of attack to have the flying path of 45 degrees.

For the conventional flying disk, the handhold vertical edge of conventional flying disk generates a lot of drag at the large angle-of-attack. The golfrisbee 1 has no handhold vertical edge that it can launch at any angle-of-attack. With the aerodynamic smooth airfoil design, thin ring structure and launching with the golh club, the golfrisbee will be the new Guinness World Record to set Golfrisbee to be the manpower throwing Worlds farthest thrown object.

FIG. 9B is the partial exposed cross-section of the golfball. The golfball 15 has one handle 152 with the screw 1520 to screw in the ball 151. The ball 151 is similar to the conventional golf ball. A light and/or sound device 12 are installed in the middle of the female screw 13R. Therefore, the male screw 3R has a hole in the middle portion to adapt the light and/or sound device 12.

The extension club locker 22 is optional. To adjust the length of golh club, the golh club has two segments. The locker 22 has the structure as shown in FIG. 2M. Releasing the extension club locker 22, the lower segment 2B is slidable in the upper segment 2U. Locking the extension club locker 22, the lower segment 2B is locked in the upper segment 2U. The length of golh club is adjusted to be the ideal club length of the golher.

The rotational motor 70 is optional. In the most popularly used basic golh club 2, the rotational motor 70 does not need at all. The operation of the basic golh club completely relies on the swivel of club with hands. To use the rotational motor, the locking screw 35 is released to allow the screw 34R to have the free rotation. The rotation motor index 71 is the stopping position of the rotational motor 70 for the optimum launch point as shown in FIG. 6C. The battery 5 embedded in the handle is to supply the power to the rotation motor 70. The switch 51 is to turn on and turn off the rotation of the rotation motor 70. There is turn-on process and turn-off process. For the turn-on process, the battery power is first on, and then the rotation motor 7 starts to rotate. For the turn-off process, the motor rotator first stops the screw 34R at the position prescribed by the index 71 for the optimum launch point in FIG. 6C. Then the battery power is shut down.

Swiveling the golh club 2 to launch the golfrisbee, the golfrisbee 1 rotates on the golh club 2 with the golh club head 34 being the pivotal center. It builds up the angular momentum. The rotational radius is large. As the golfrisbee takes off, the center of rotation is at the center of the golfrisbee. The rotational radius becomes small. According to the conservation of angular momentum, the rotation speed of the golfrisbee will become faster. The effect is similar to the ballet dancer shrinking her hands in front of her chest to speed up the spin speed. Therefore, the golfrisbee is referred to be the sky ballet. To increase the spinning effect, the ring band mass is reduced and the center mass is increased with the addition of weight 12 as shown in FIG. 9.

Figures 11A, 11B:
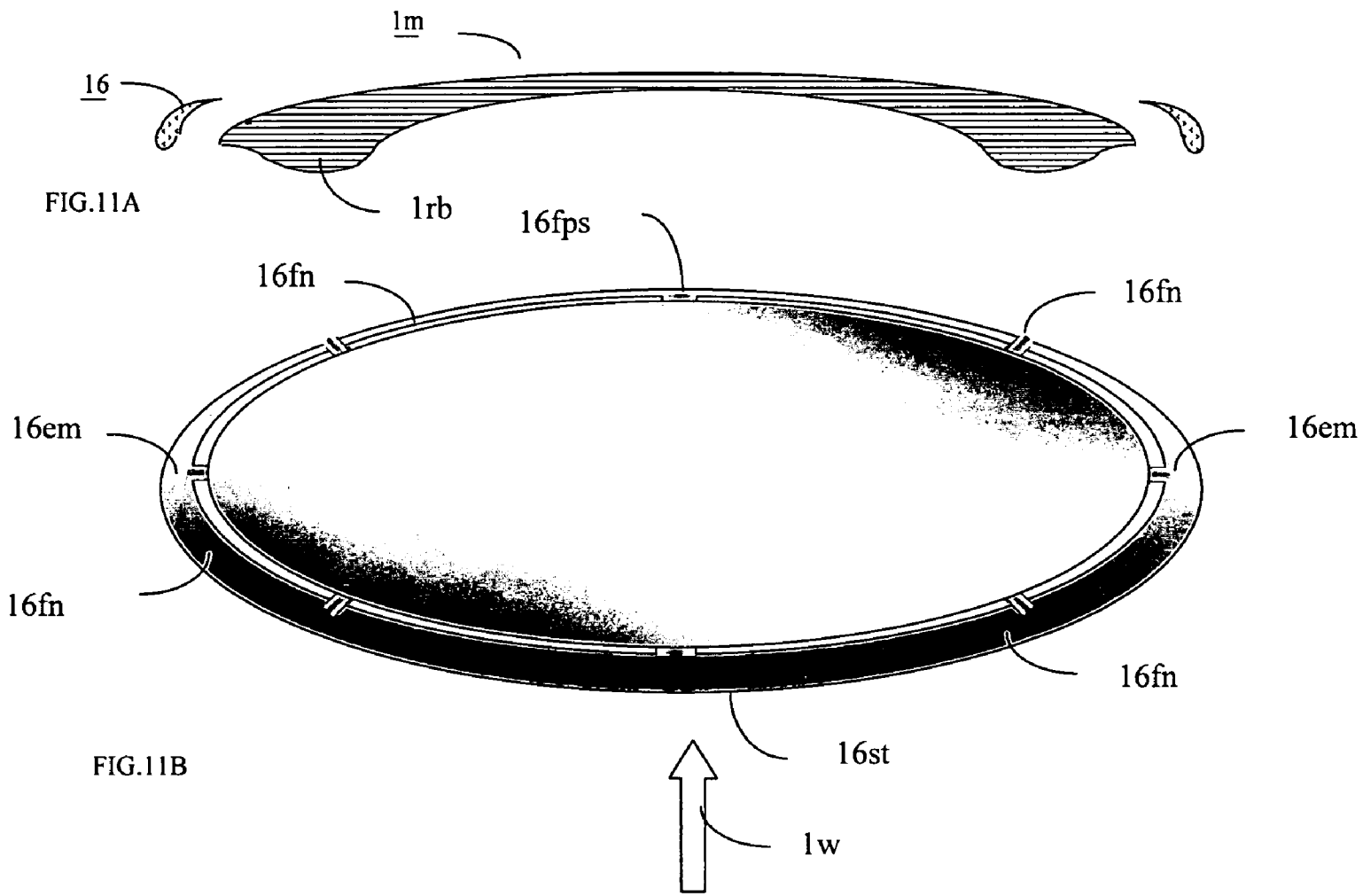
Figure 11C:
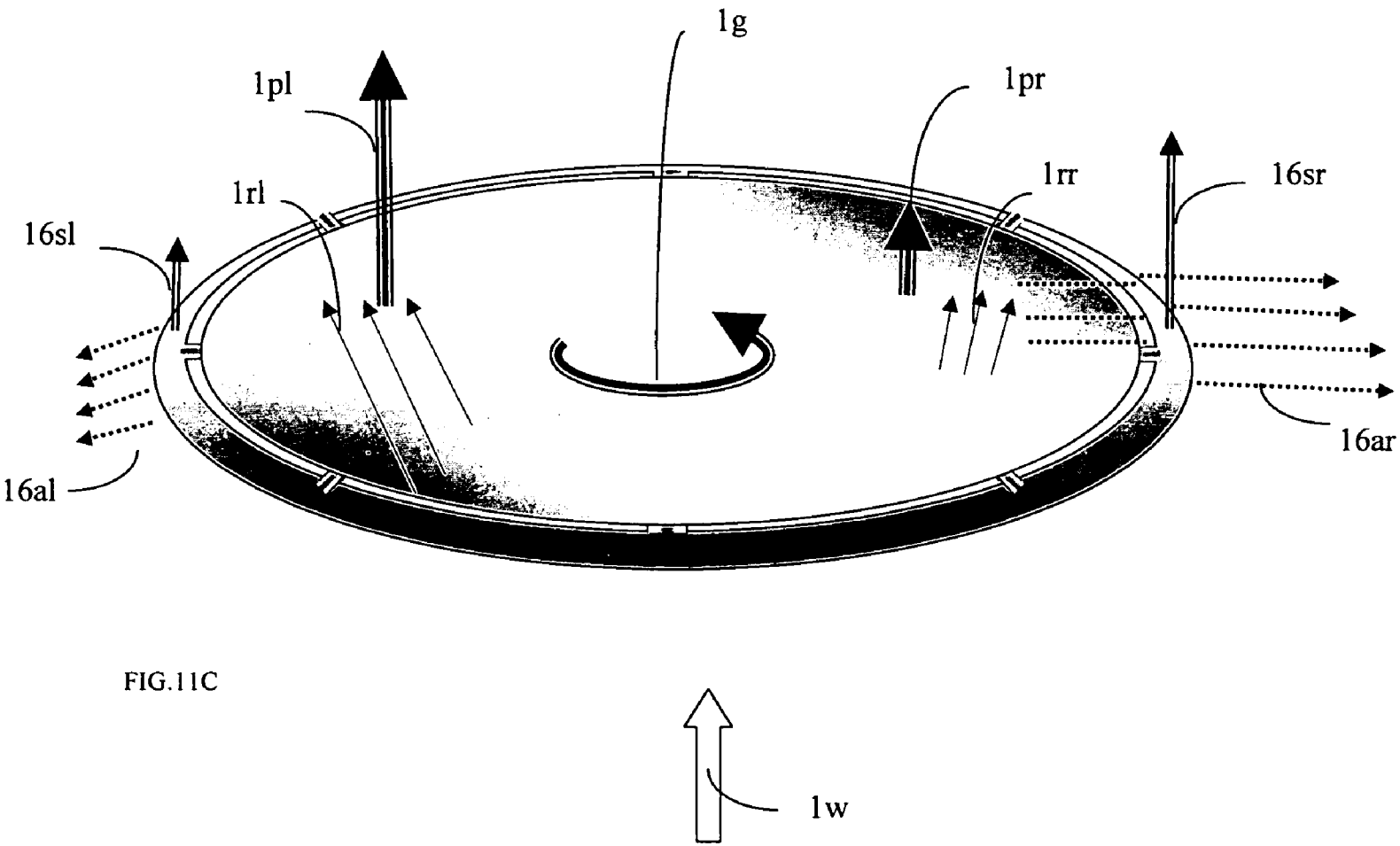
Figures 12A, 12B:
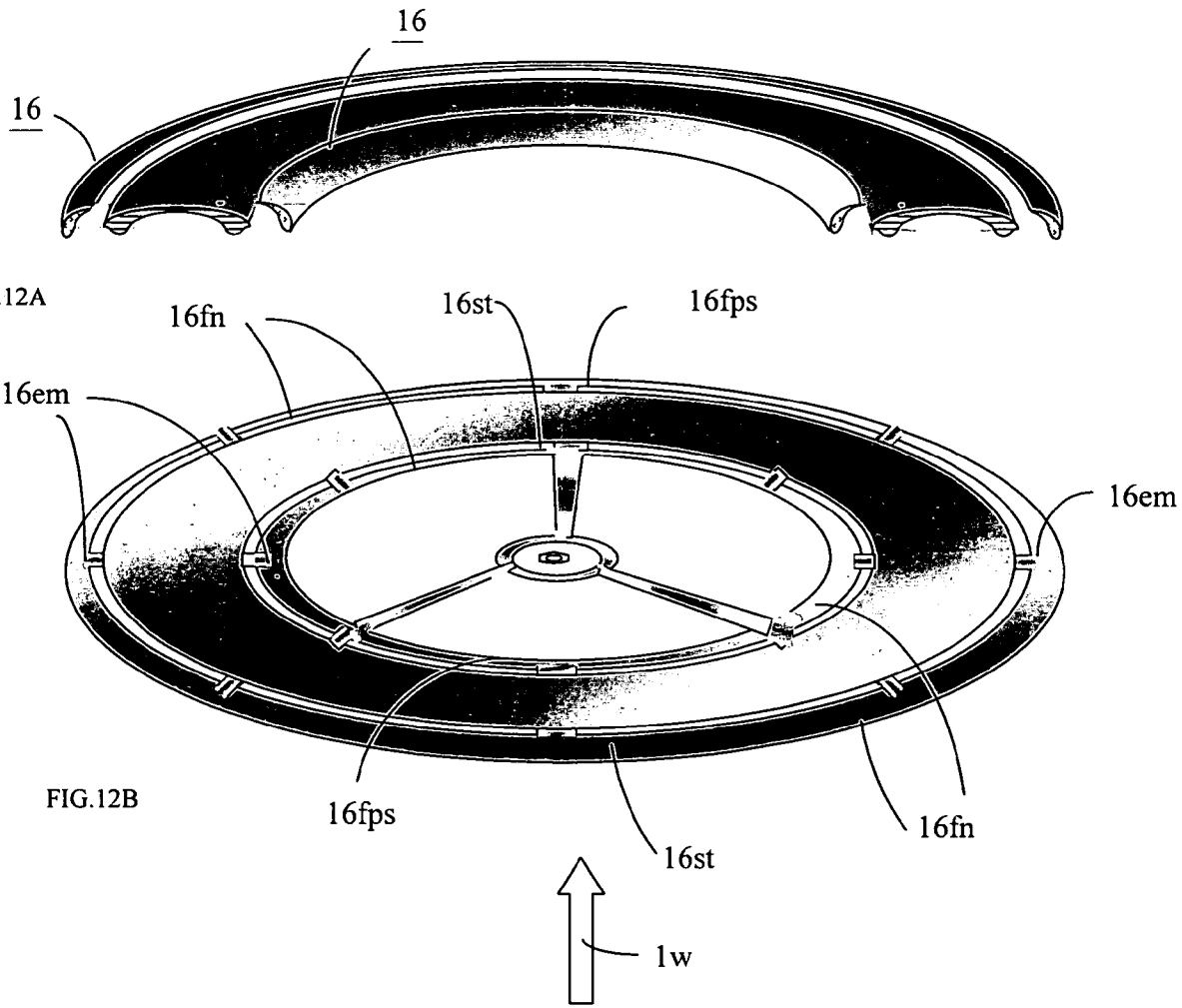
Figures 23A, 23B, 23C:
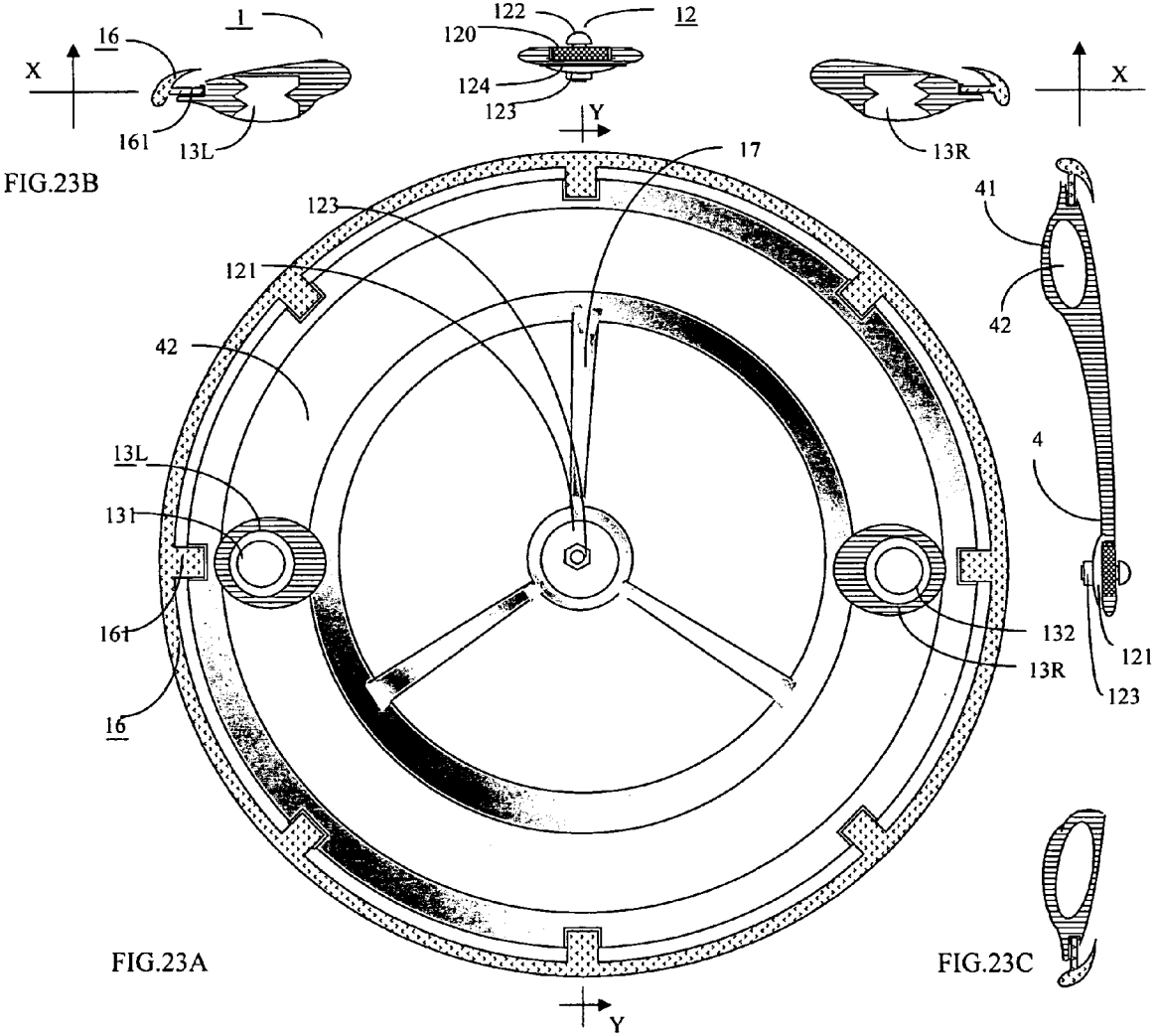
Figure 23E:
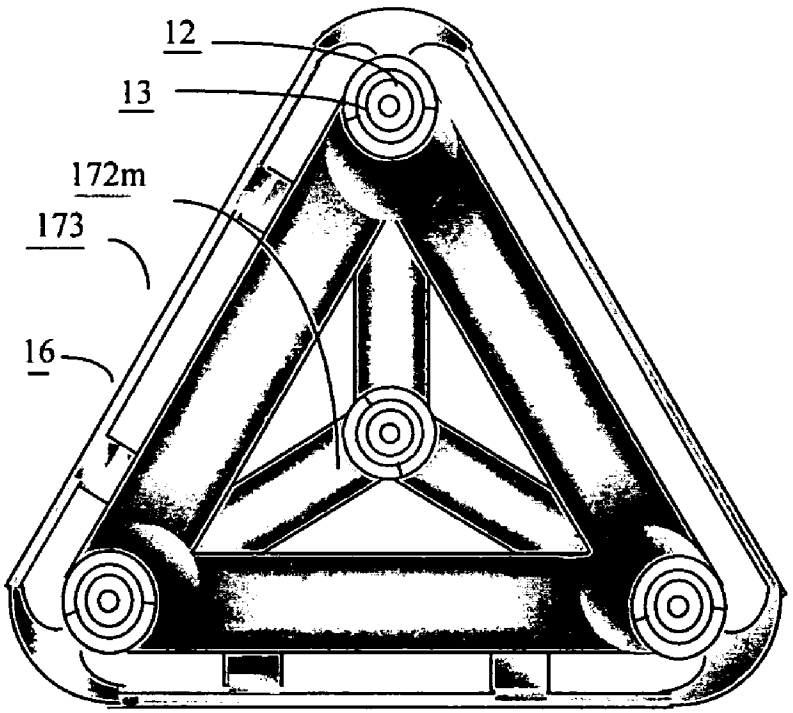
Figure 23D:
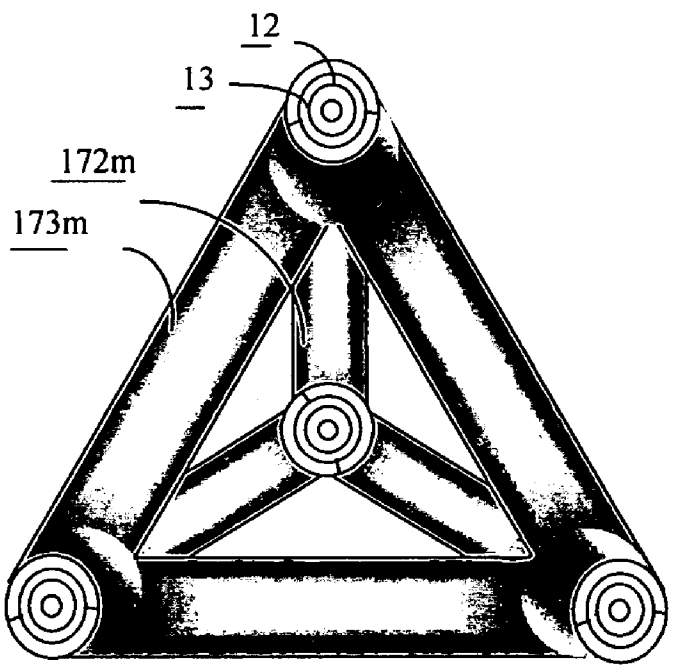
Figures 23F, 23G, 23H:
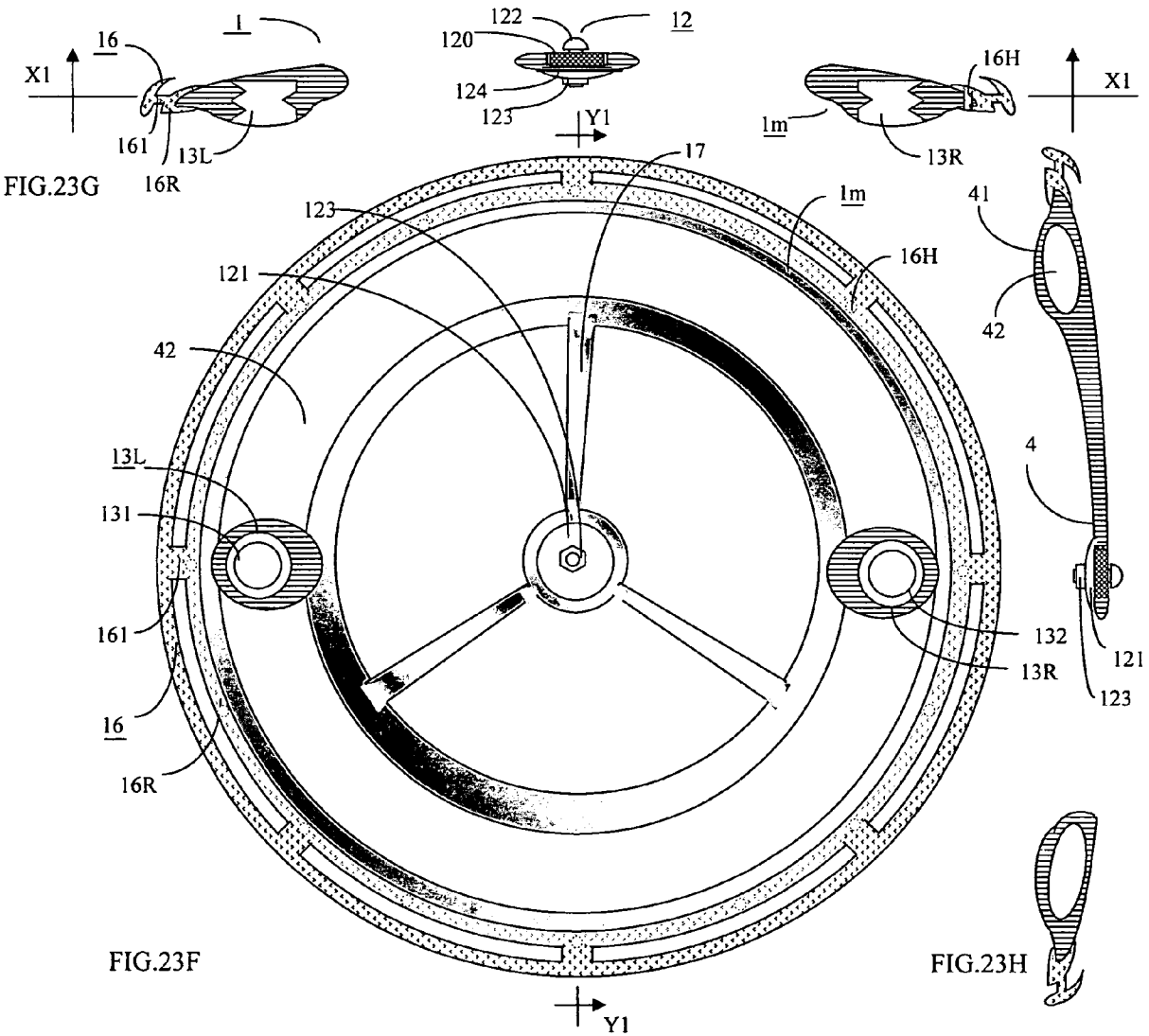
Figures 24A, 24B, 24C:
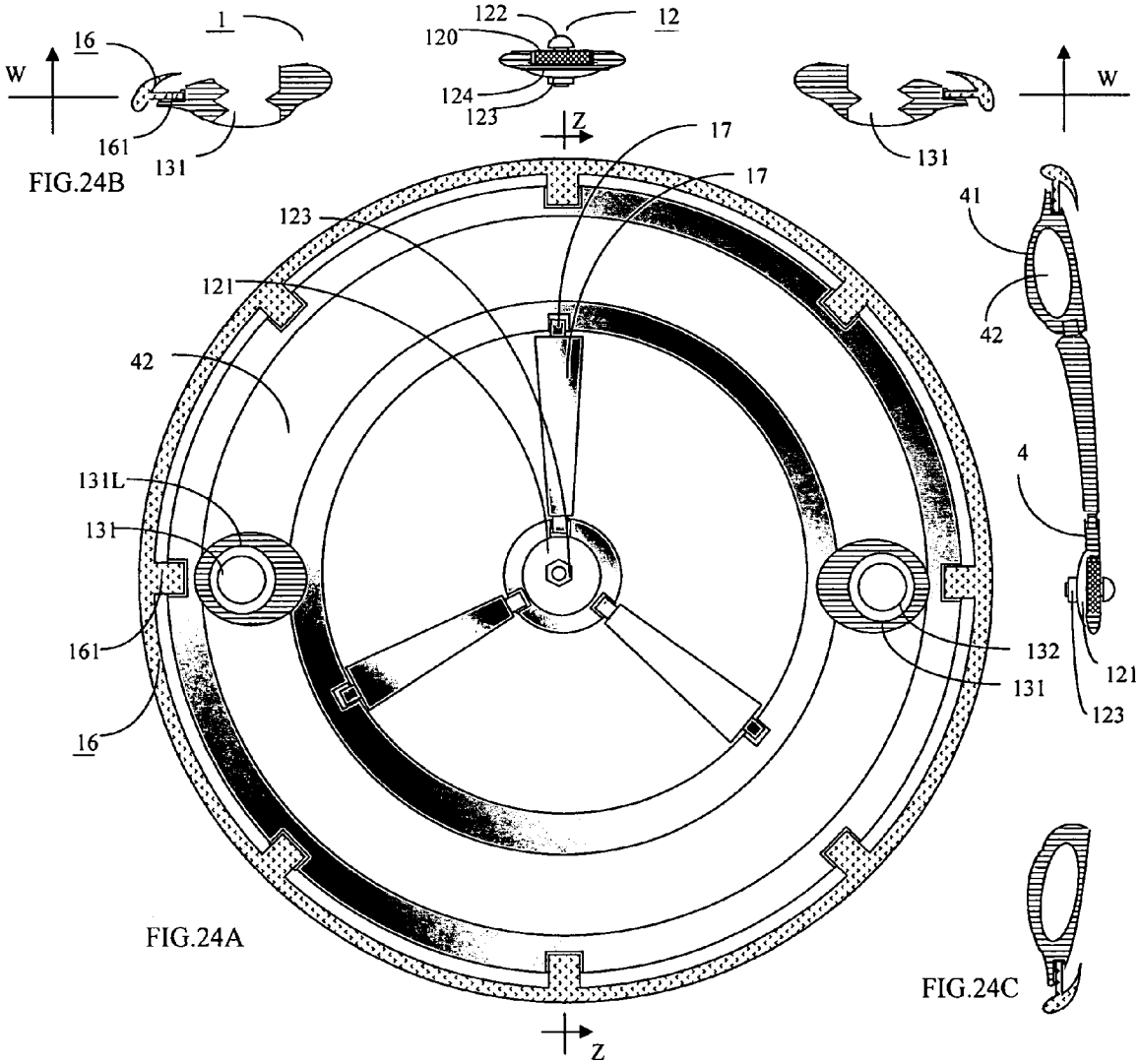

The golh sport is constituted of three core technologies—the universal directional flying wing, the swiveling club and wind-bell-chain technologies. As shown in FIG. 8A and FIG. 24A, the golfrisbee 1 is the merge of the technologies of disk, ring, and boomerang and helicopter wing. Since the golh is a brand new sport, so we introduce the innovation of golh product step by step as shown from FIG. 10 to FIG. 26. It is noted that FIG. 9A is the view of the golfrisbee as shown in FIG. 11B; FIG. 8A is the view of the golfrisbee as shown in FIG. 12B.

The design of the ultra long flying disk is much different from the conventional flying disk and Frisbee. To keep the golfrisbee 1 horizontal status to fly for the ultra long distance, the golfrisbee rotates and uses the gyroscopic force to stabilize the horizontal flight status. Furthermore, for the ultra long distance flying disk of golfrisbee 1, the low drag force airfoil of the wing and the side stability are the most important issues. Without the side stability, the golfrisbee 1 will roll in the side direction then lose the lift force and falls to ground.

To play the golh in the golf course, the golh and golfrisbee technologies have to be compatible with the golf and ball technology. The swing of golh club is similar to the swing of golf club. The long-drive flying distance has to be compatible. As shown in the following table, the long drive flying capability of golfrisbee is about the same as flying golf ball.

Technology Compatibility between Golfrisbee & Golf ball

| | Golf Ball | PDGA Disc | Aerobee Disc |
|---|---|---|---|
| the long drive record | 1200 ft. | 712 ft. | 1,333 ft |
| average | 900 ft. | | |

For the conventional flying disk, the flying distance is much less than the conventional golf ball. Recently, the disk technology makes a lot of progress. It makes the disk be played in the golf course. The golf course can be modified to be the golh course.

Therefore, the golfrisbee 1 has the special design to have the long range flying capability. All the shape of the golfrisbee 1 has the streamline design for integrity. There is no abrupt line segment or sections as most of the flying disk and ring do. With the golh club 2, it will be the human power farthest throw in the world. Furthermore, the golfrisbee 1 is designed to be safe to play as the conventional flying disk does.

So far, there is no flying disk using the aerodynamic airfoil as shown in FIG. 10A in its design. The golfrisbee is the first to apply the wing theory of the aerodynamics to design. As shown in FIG. 10A, being relative to the wind direction 1*w*, as the conventional uni-directional flying wing with airfoil 1*mf* flies in the wind with the tip forward, the wing with airfoil 1*mf* is flying in the forward direction. As shown in FIG. 10*b*, being relative to the wind direction 1*w*, the conventional wing with airfoil 1*mb* cannot fly in the backward direction. However, the golfrisbee is rotating during the flight to maintain its horizontal flying status. The golfrisbee must fly in both forward direction and backward direction. Actually, for the rotationally flying golfrisbee, the golfrisbee needs the universal directional flying capability. For simplicity, we use bi-directional flying wing to make the analysis and design for the universal flying To fly in both forward direction and backward direction, as shown in FIG. 10C, the forward flying wing with airfoil 1*mf* and the backward flying wing with airfoil 1*mb* are overlapped. The forward wing 1*mf* and the backward wing 1*mb* are adjusted to have the maximum overlap of the upper curvatures. Then the transitional smooth curvatures are connected between the forward wing 1*mf* and the backward wing 1*mb*. The lobe 1*rb* is formed. As shown in FIG. 11, for the golfrisbee disk, the lobe 1*rb* becomes the ring band. The envelop of the overlapped wing, as shown in FIG. 10D, is the airfoil with main plane 1*m* of the bi-direction flying wing of the golfrisbee.

To increase the performance of the wing, the wing further has additional wing segments. As shown in FIG. 10E, the wing with airfoil 1*f* is constituted of main plane 1*mf*, slat 1*f*1, slat slot 1*f*2, flap 1*f*3, and flap slot 1*f*4. The slotted slat 1*f*1 is the auxiliary airfoil fitted to the leading edge of the wing. At high angles of attack, the angle of attack of the slotted slat 1*f*1 being less than that of the main plane 1*mf*, there is a smooth air flowing over the slotted slat 1*f*1 which tends to smooth out the eddies forming over the wing 1*f*. The slotted slat 1*f*1 is fitted to the leading edge near the wing tip to improve lateral control. Slot 1*f*2 is the passageway built into the wing 1*f* a short distance from the leading edge. It is constructed in such a way that, at high angles-of-attack, the airflows through the slat slot 1*f*2 and over the wing 1*f*, tending to smooth out the turbulence due to eddies.

As shown in FIG. 11 and FIG. 12, the slotted slat 1*f*1 also serves as the wing fence at the position 16*fn*. In the conventional unidirectional flying wing, the wing fences are fin-like vertical surfaces attached to the upper surface of the wing to control the airflow. On swept wing airplane, the wing fence prevents the drifting of air toward the tip of the wing at high angles of attack. On straight wing airplane, the wing fence controls the airflow in the flap area. In both cases, the wing fence gives better slow speed handling and stall characteristics.

As shown in FIG. 10E, the slotted flap 1*f*3 is a high-lift device which increases the camber of the wing 1*f* and increases the effective wing area. The use of slotted flap 1*f*3 gives better take-off performance and permits steeper approach angles and lower approach and landing speeds. The flap slot 1*f*4 makes the flap to be slotted flap 1*f*3. The Slotted flap 1*f*3 produces lift in excess of drag.

Since the golfrisbee rotates during flight, as the wing 1*f* rotates 180 degrees, the wing tail become wing tip as shown in FIG. 10F. To make the golfrisbee to fly with wing tail as it does with the wing tip, we need to make the innovation of the wing. As shown in FIG. 10G, the forward wing 1*f* and backward wing 1*b* are overlapped together. As shown in FIG. 10H, the cross section of the universal directional flying golfrisbee wing 1 is the envelope of the forward wing 1*f* and backward wing 1*b* as shown in FIG. 10G. The skirt 16 serves as both slotted slat 1*f*1 and slotted flap 1*f*3 as the conventional wing slat and flap do.

This bi-directional wing can be generalized to be the plural directional wing and the universal directional wing. A plural directional wing has a plural directional flying capability. As shown in FIG. 10 is the bi-directional wing.

The bi-direction wing can be extended to plural-direction wing to have flying capability in plural directions. For each flying direction, the plural-directional wing has a cross section to be the envelop of a forward direction of a uni-directional wing cross section 1*f* or 1*mf* and a backward direction of a uni-directional wing cross section 1*b* or 1*mb* as shown in FIG. 10C and FIG. 10G. There are transitional smooth curves between the forward direction of a uni-directional wing cross section and a backward direction of a uni-directional wing cross section. Each flying direction of the plural-direction wing has the cross section as shown in FIG. 10D and FIG. 10H.

For the rotational flying disk, we need to have the universal direction ring. As shown in FIG. 11, it shows that the golfrisbee disk having the universal directional flying capability is equivalent to have the rotational flying capability. For the rotationally flying disk, the disk needs to have the universal direction flying capability. The universal direction flying wing is in a disk shape. At any section view crossing a center of the disk, the disk has wing cross section to be the envelop of the forward direction of a uni-directional wing 1*f* and the a backward direction of a uni-directional wing 1*b*, There are smooth transitional curves between the forward direction of a uni-directional wing 1*f* and the backward direction of a uni-directional wing 1*b*. For the high performance uni-direction wing, it further comprises a slotted slat 1*f*1 and a slotted flap 1*f*3. The envelope of the forward uni-directional wing and the backward uni-directional wing forms a disk 1*m* made of the main planes and the slotted skirts being the overlap of the slotted slat 1*f*1 and the slotted flap 1*f*3. As shown in FIG. 11B and FIG. 12B, being relative to the wind direction 1*w*, at the position 16*st*, the skirt serves at the slotted slat 1*f*1; at the position of 16*fps* the skirt serves as the slotted flap 1*f*3.

Furthermore, the skirt 16 serves as the empennage which is similar to the tail assembly of the conventional airplane. The empennage gives the side stability to the aircraft. The skirt 16 serves as the horizontal stabilizer and the vertical stabilizer or fin. As shown in FIG. 11B and FIG. 12B, at the position 16*em*, the skirt 16 serves as the vertical stabilizer. At the position 16*fps*, the skirt 16 serves as both flap 1*f*3 and the horizontal stabilizer. As the skirt 16 serves as the horizontal stabilizer, the skirt 16 is used to prevent the golfrisbee from pitching up or down. As the skirt 16 serves as the vertical stabilizer, the skirt 16 is used to prevent the golfrisbee from yawing in side direction. It serves to offset the tendency of the golfrisbee to roll in the side direction. As shown in FIG. 11C, the principle behind the skirt operation is the compensation of the difference of lift force with the difference of the downwash airflow. As the wind 1*w* blows on the golfrisbee 1, due to the rotation of the golfrisbee 1, one side flow 1*r*1 has the higher relative wind speed than the other side 1*rr*. According to the Bernoulli Law, the difference of relative wind speed over the main plane 1*m* generates the different air pressures that the lift forces 1*pl* and 1*pr* on two sides are different. Due to the viscosity of boundary flow over the main plane 1*m*, the absolute airflow speeds 16*al* and 16*ar* on two sides are different. The airflows hit on the skirt 16 and flow downward with different speeds. The different speeds airflow generates the different forces 16*sl* and 16*sr*. The momentum caused by the difference of the lift forces 1*pl* and 1*pr* will be compensated with the momentum caused by the difference of the forces 16*sl* and 16*sr*. Therefore, the golfrisbee 1 can be kept to fly horizontal position for the ultra long distance fly.

The golfrisbee 1 has a skirt 16 serving as slat and flat. The skirt 16 has many different ways to implement. As shown in FIG. 23A, FIG. 23B and FIG. 23C, the skirt has the slot between the skirt 16 and the disk body 1*m*. As shown in FIG. 23F, FIG. 23G and FIG. 23H, the skirt 16 has the slot implemented as the slotted skirt. The skirt ring 16 has the ring band 16R wrapped around the edge of the main body of the golfrisbee 1*m*. To increase the bond between the main disk 1*m* and the skirt 16, there are the holes 16H punched through the edge of the main disk 1*m*. It is noted that all the skirt in this invention can be and actually is better to be implemented with this way. The skirt 16 has several functions.

(1) It serves as the bumper to protect both human and the golfrisbee itself. The skirt is made of the soft material such as foam rubber. The skirt 16 has the skirt hanger 161 extended into the golfrisbee body.

(2) The skirt 16 serves as the stabilizer at the side of the golfrisbee for the long-range flight as the empennage does.

(3) At the front of the golfrisbee, the skirt 16 serves as the guiding slot to guide the air flowing above the golfrisbee as the slot slat does. It reduces the drag force at the front end. This design is the subsonic airfoil design. It is completely different from the Innova Disk. The Innova Disk has the triangle front end being the supersonic airfoil design. However, for the supersonic wing to operate at the subsonic speed, it induces a lot of drag force.

(4) At the tail of the golfrisbee, the skirt 16 guides the airflow to wash downward to increase the lift and drifting distance as the slot flap does. On the contrary, in the Innova patent, the design of triangle rim will cause the air flowing up. It reduces the airlift force of the flying disk.

As shown in FIG. 12, the wing is in a ring shape wing. The ring shape wing has the section view crossing the center of the ring to be the overlap of forward direction uni-directional wing and backward direction uni-directional wing. There are smooth transitional curves between the cross sections of forward direction uni-directional wing and the backward direction uni-directional wing.

As shown in FIG. 12, the universal direction wing developed from the disk in FIG. 10H can be applied to the wing of the flying ring. The cross section of the golfrisbee ring is in the shape of the golfrisbee disk as shown in FIG. 10H and FIG. 11A. FIG. 12B is the isometric view of the FIG. 8A. As shown in FIG. 12B, for the front portion 16*st* of the ring, the outer skirt serves as the slat; the inner skirt 16*fps* serves as flat. For the rear portion of the ring, the inner skirt serves as the slat 16*st*; the outer skirt serves as the flat 16*fps*. At the right side and left side, both the outer skirt and inner skirt serve as the empennage 16*em*.

Figure 13A:
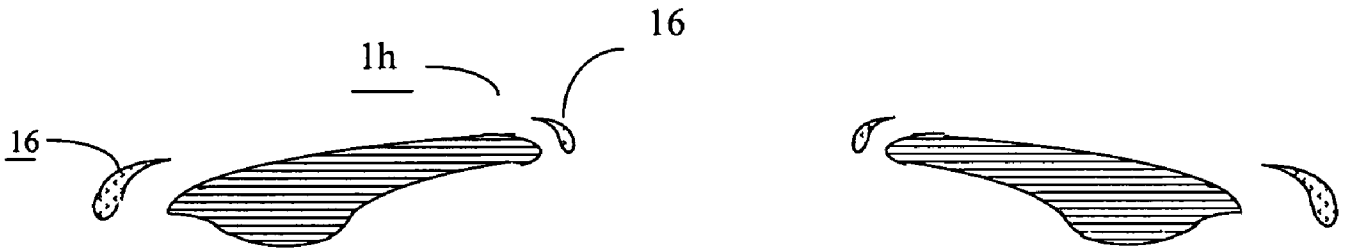
Figure 13B:
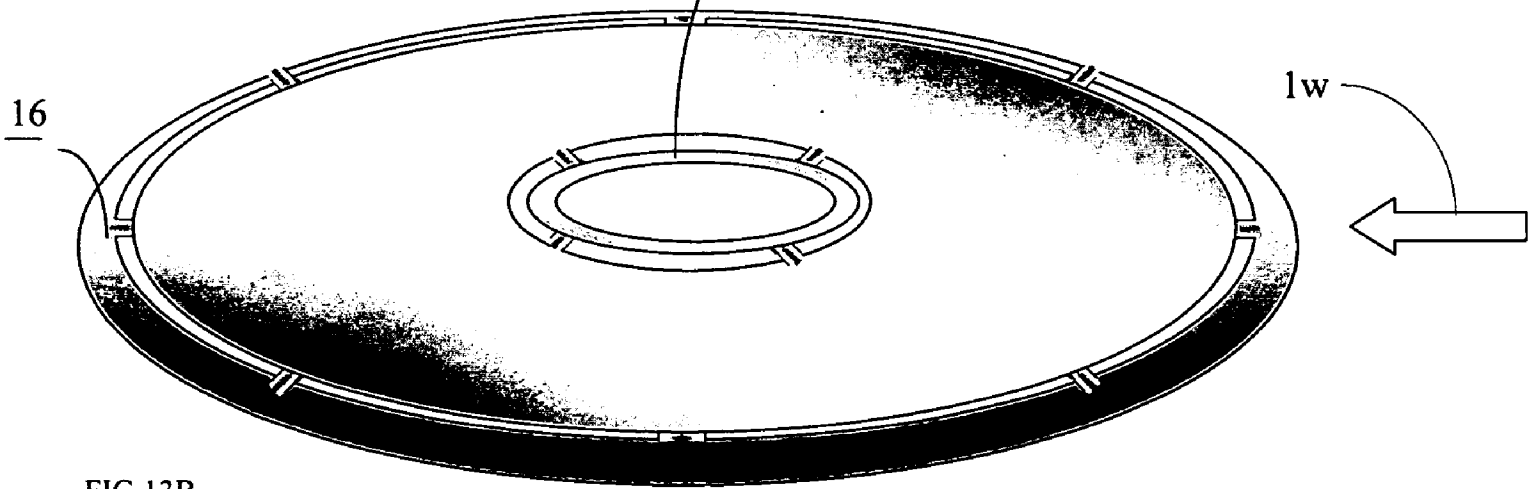

FIG. 13 shows the golfrisbee diskring 1*h* or golfdiskring 1*h* having the combination or hybrid of the golfdisk (golfrisbee disk) and golfring (golfrisbee ring) structure. The golfrisbee diskring 1*h* has a central hole. The skirt 16 is also installed along the rim of the central hole. To keep the flying stability of the flying disk, there is one golden rule: the radius of the disk cannot be more than 20 times of the skirt height. If the radius of the flying disk is larger than 20 times of the vertical height of the skirt, then the hole must be introduced to the center of the flying disk to keep the ratio of the span of the main plane to the skirt height being less than 20. If there is a hole in the disk, then it becomes a ring. However, the flying structure of ring is still the same as the disk. It is a wrong idea to differentiate the flying disk from flying ring. Actually, there is no distinguishable difference between the golfrisbee disk and the golfrisbee ring.

The second core technology of the golfrisbee is the swiveling club throwing technology. The swiveling club throwing technology not only throws the golfrisbee 1 but also throws the golfball 15, boomerang, etc. FIG. 14 shows the golh set made of the golfball 15 and golh club 2. The fit mechanism between the flying object and the head of golh club is screw. To reduce the air drag force, the fit screw of the flying object is the female screw 13 and the head of golh club 2 is male screw 3. The light and sound generator 12 is embedded in the female screw 13. There is one pore 34*p* in the screw head 3 to adapt the light and sound generator 12 as the golfball 15 is mounted on the screw head 3. The LED and battery can be embedded in the flying disk. Because the golh club does not hit on the flying disk and the flying disk has the soft landing, the LED and battery will be left unharmed. Having LED and sound generator 12, you can play golh in the snow golf course and/or in the night. The flying disks will softly land on the top of the snow pile.

Figures 14A, 14B, 14C, 14D:
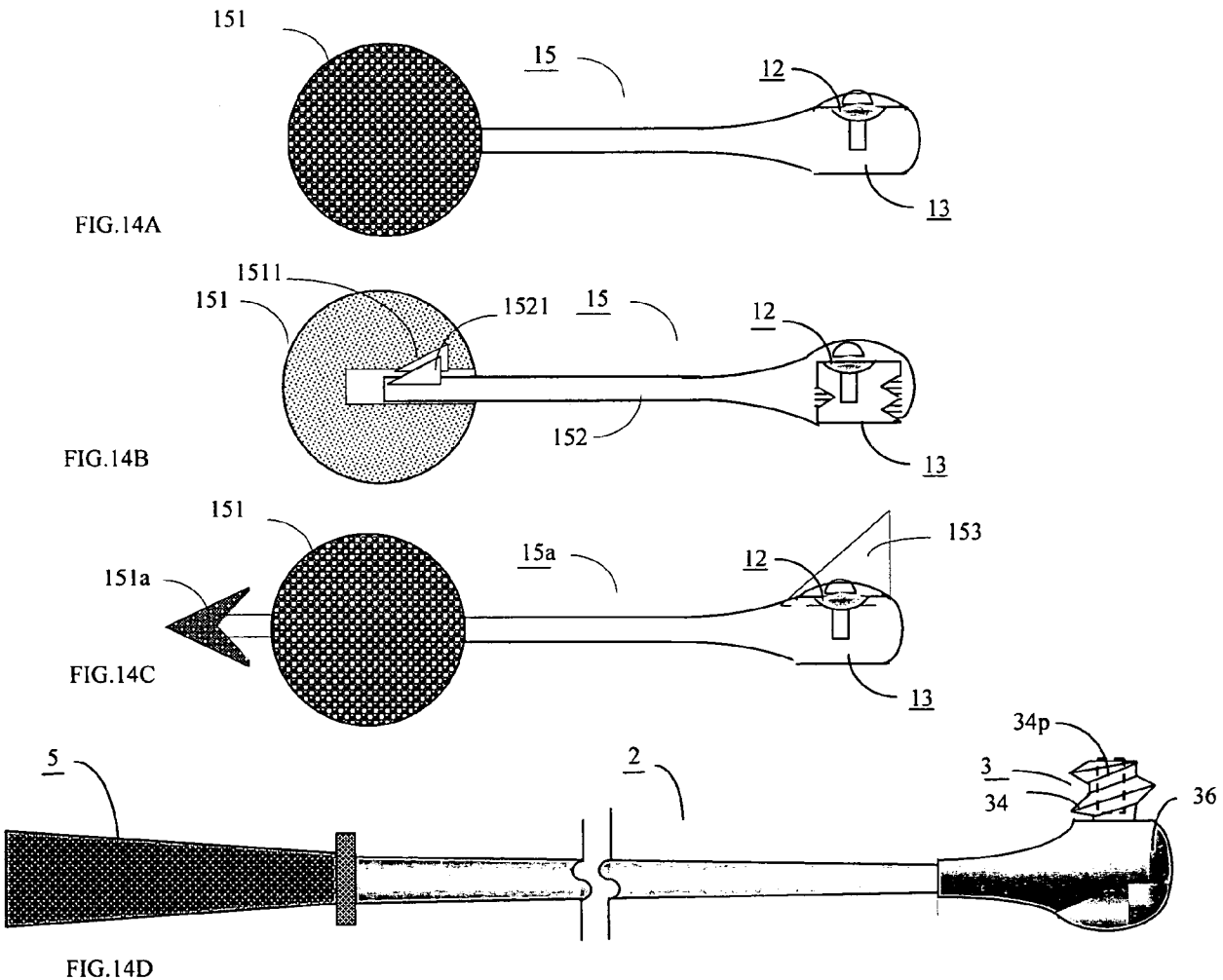

The golfball 15 is thrown with the golh club 2 as shown in FIG. 1A. The fast release latch 1521 is biased by a spring hidden in the bar 152. The fast latch 1521 fits in the notch 1511 in the ball 151 to lock the bar 152 with the ball 151. Twist the bar 152, the fast release latch 1511 will be suppressed and the bar 152 can be pulled out of the ball 151. Then the ball 151 can be putted to roll into the hole 6 as shown in FIG. 7A. As shown in FIG. 14C, there is one arrowhead 151*a* attached to the golfball 15. The fin 153 is to control the throwing direction of the golfball 15. As shown in FIG. 1E, the golfball 15 is thrown to fly and shoot at the target board 18*a*.

In general, the golh sport comprises of a flying object being thrown to fly with a swivel of a club 2 by hand. The golh club 2 is swiveled with hands to rotate the flying object to build up the rotating momentum and throw the flying object to fly. The golh club 2 is constituted of a pole and a head. The pole is swiveled with hands in a circle to throw the flying object to fly. The club head is for the flying object pivotally mounting on it. The flying object is thrown out to rotate and fly. The flying object can be boomerang 171 as shown in FIG. 15, the ball 15 and the disk 1 as shown in FIG. 1, etc.

FIG. 15 shows the swiveling golh club and the universal direction wing technology applying to boomerang 171. The flying object is a boomerang 171. The boomerang 171 comprises two branches jointing together at a central joint. The fitting screw 13 is mounted at the central joint. FIG. 15A and FIG. 15C are the applications of the swiveling golh club technologies to the boomerangs 171*m* and 171. As shown in FIG. 15A, the boomerang 171*m* is made of two branches and each branch has the cross section as shown in FIG. 10D. As shown in FIG. 15C, the boomerang 171 is made of two branches and each branch has the cross section as shown in FIG. 10H. As shown in FIG. 15E, the golh club 2 is swiveled backward to be ready to throw the golfrisbee boomerang 171. As shown in FIG. 15F, due to the eccentric force, the golfrisbee boomerang 171 rotates. As shown in FIG. 15G, the golfrisbee boomerang 171 takes off and flies in the sky.

Figure 15C:
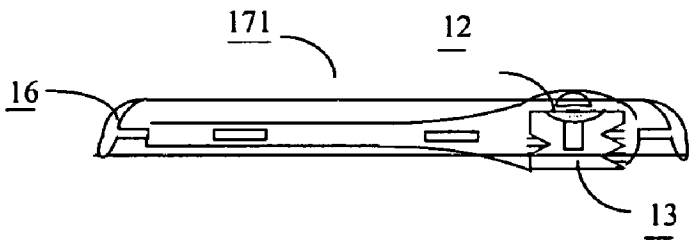
Figure 15D:
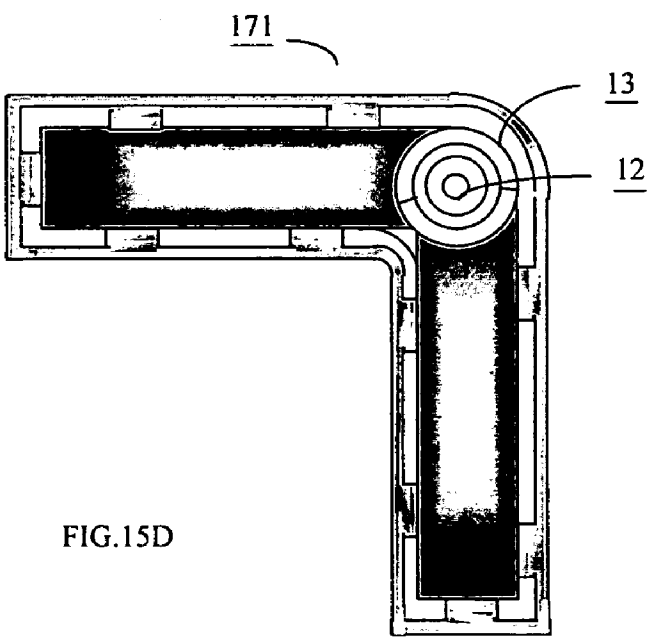
Figure 15A:
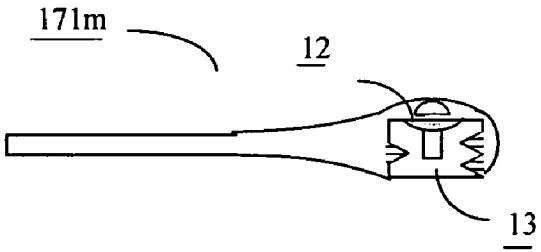
Figure 15B:
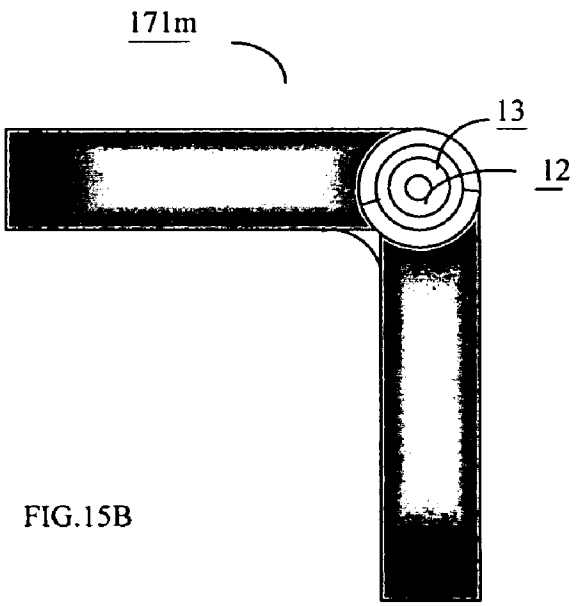
Figure 15G:
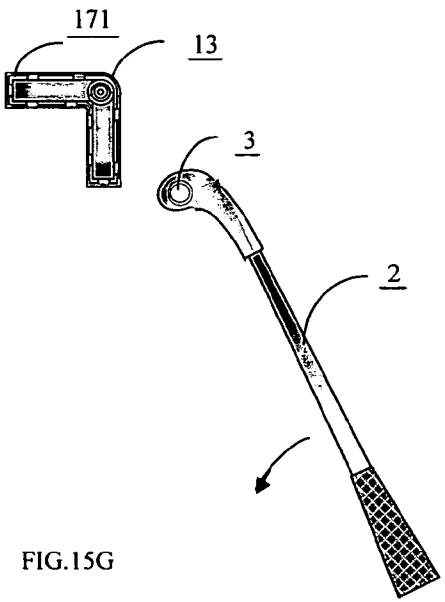
Figure 15E:
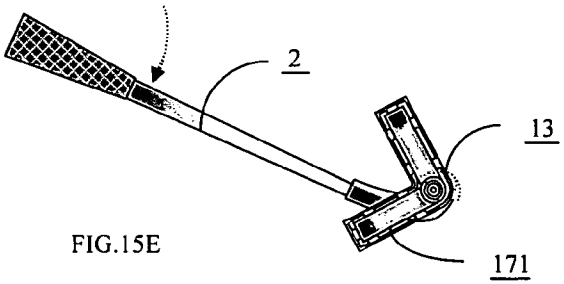
Figure 15F:
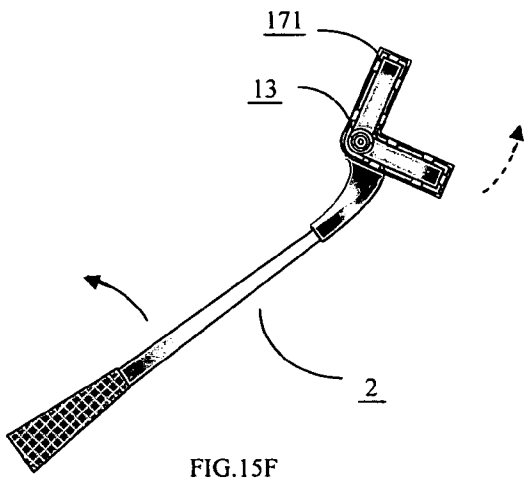
Figure 16D:
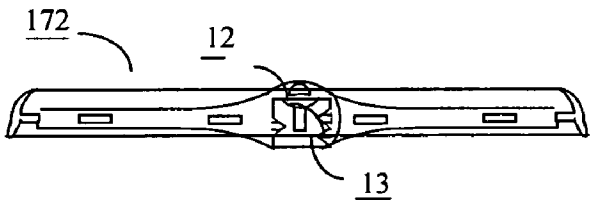
Figure 16E:
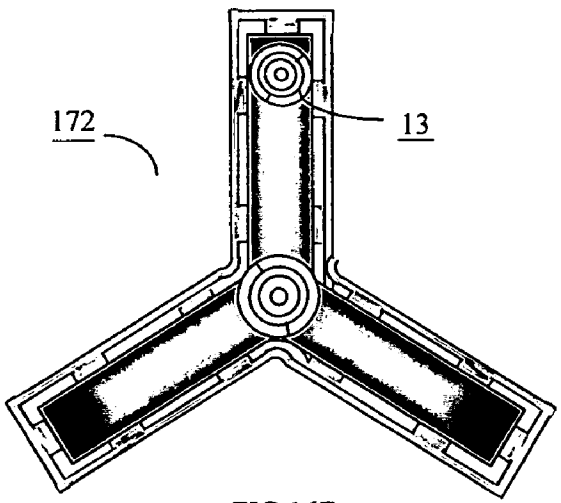
Figure 16A:
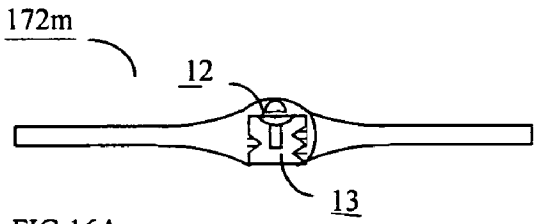
Figure 16B:
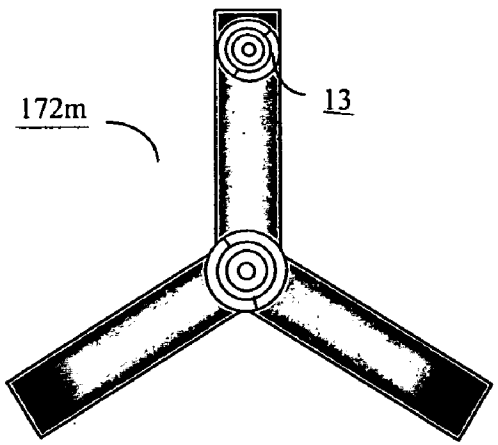
Figure 16F:
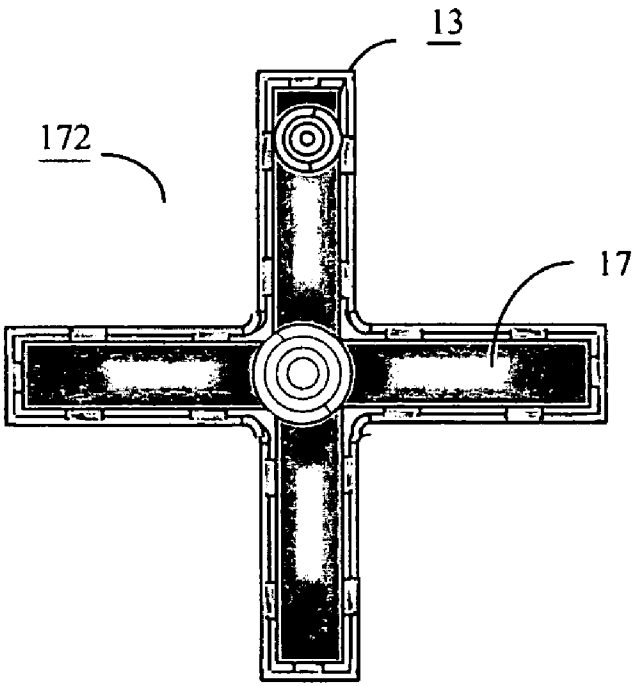
Figure 16C:
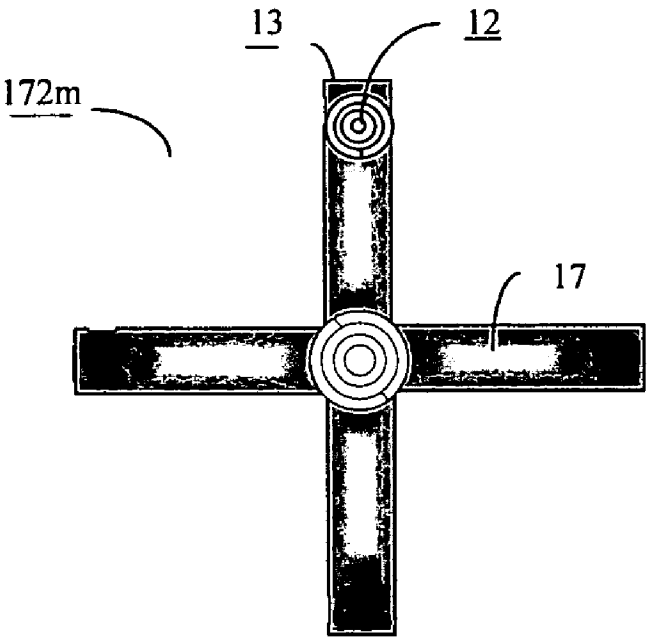
Figure 16I:
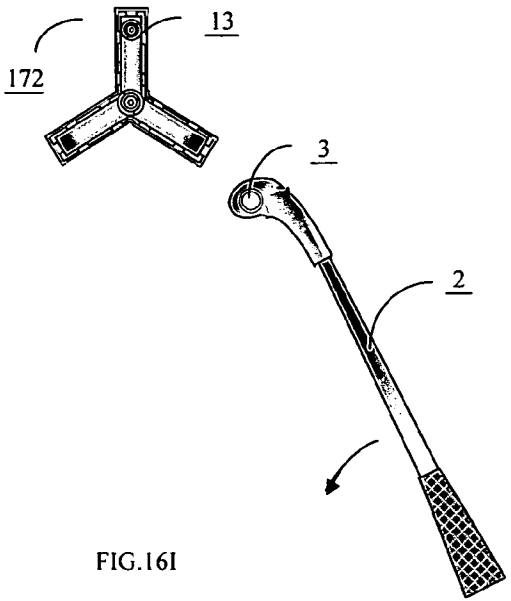
Figure 16G:
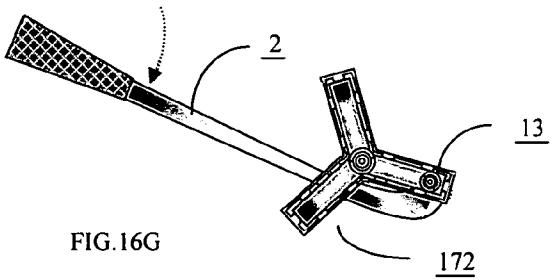
Figure 16H:
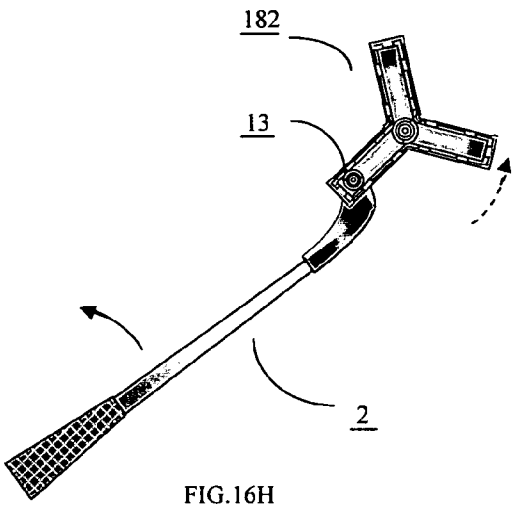
Figure 17A:
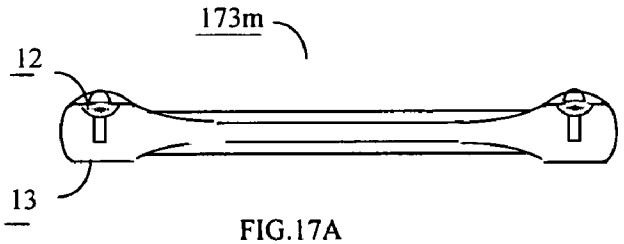
Figure 17B:
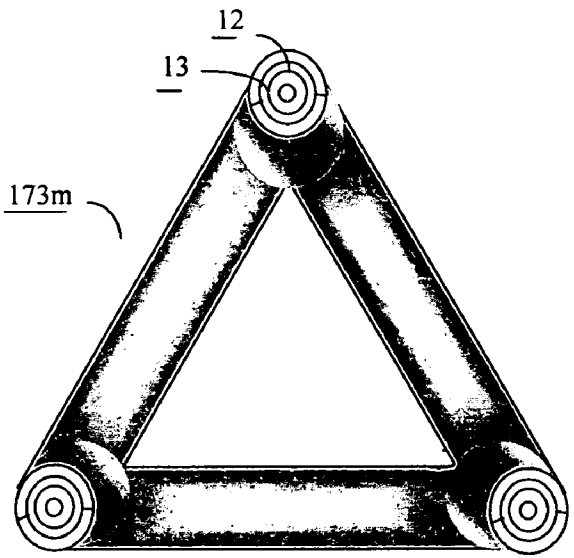
Figure 17C:
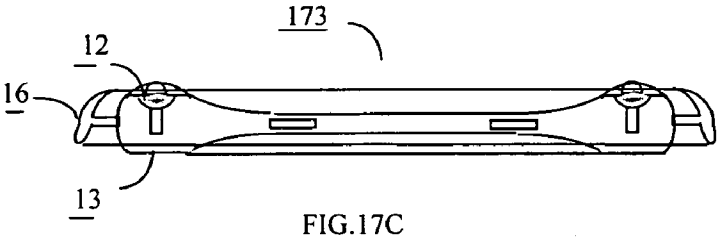
Figure 17D:
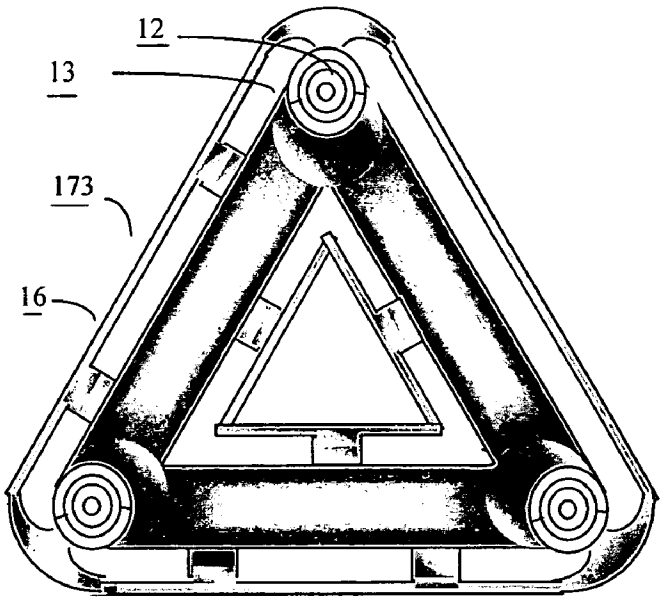
Figure 17G:
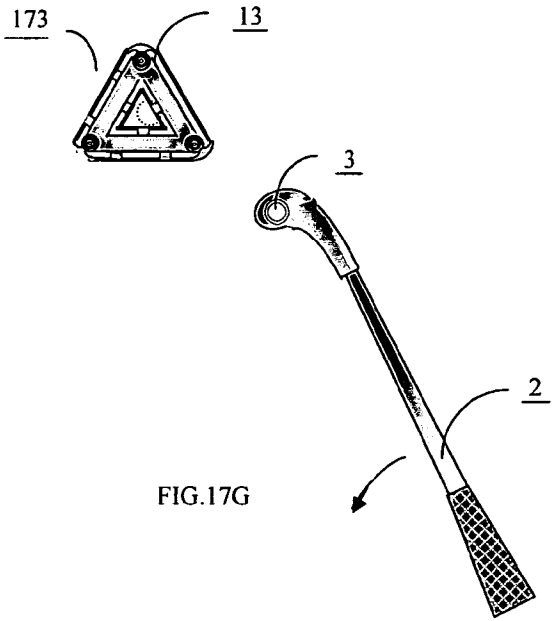
Figure 17E:
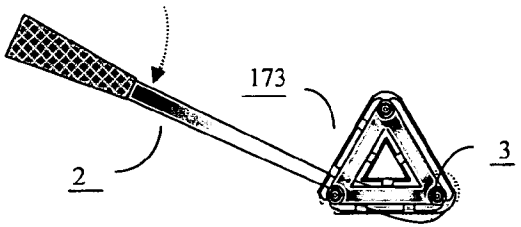
Figure 17F:
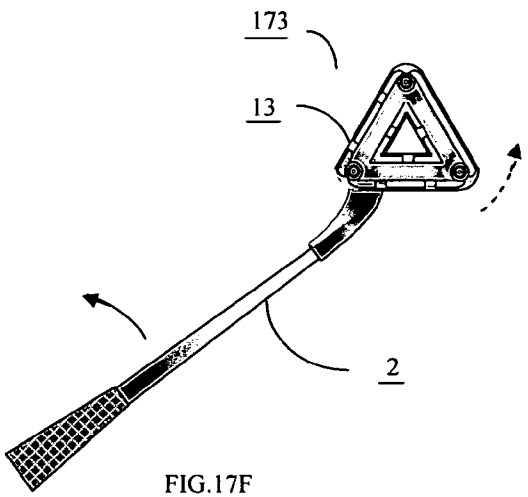

FIG. 16 shows the swiveling golh club and the universal direction wing technology applying to multi-boomerang 172. The flying object is a multi-branches boomerang 172, the boomerang 172 comprises multiple branches jointing together at a central joint. For the odd number of branches, the boomerang will turn and fly back. For the even number of branches, the boomerang will not turn. Adjusting the number of the branches, we can control the curvature of flying path. To have the eccentric force, the fitting screw 13 is mounted at ends of branches. FIG. 16A and FIG. 16C is the application of the swiveling golh club technologies to the tri-boomerang 172*m* and 172. As shown in FIG. 16A, the tri-boomerang 172*m* is made of three branches and each branch has the cross section as shown in FIG. 10D. As shown in FIG. 16C, the tri-boomerang 172 is made of three branches and each branch has the cross section as shown in FIG. 10H. As shown in FIG. 16E, the golh club 2 is swiveled back to be ready to throw the golfrisbee tri-boomerang 172. As shown in FIG. 16F, due to the eccentric force, the golfrisbee tri-boomerang 172 rotates. As shown in FIG. 15G, the golfrisbee tri-boomerang 172 takes off and flies in the sky.

FIG. 17 shows the swiveling golh club and the universal direction wing technology applied to polygon boomerang 173. The flying object is a polygon boomerang 173. The polygon boomerang 173 comprises branches jointing together to form a polygon. The fitting screw 13 is mounted at joints of the branches. For the odd number of edges, the polygon boomerang will turn and fly back. For the even number of edges, the polygon boomerang will not turn. Adjusting the number of the edges, we can control the curvature of fly path. FIG. 17A and FIG. 17C are the applications of the swiveling golh club technologies to the triangle boomerang 173*m* and 173. As shown in FIG. 17A, the boomerang 173*m* is made of three edges and each edge has the cross section as shown in FIG. 10D. As shown in FIG. 17C, the triangle boomerang 173 is made of three edges and each edge has the cross section as shown in FIG. 10H. As shown in FIG. 17E, the golh club 2 is swiveled back to be ready to throw the golfrisbee triangle boomerang 173. As shown in FIG. 17F, due to the eccentric force, the golfrisbee triangle boomerang 173 rotates. As shown in FIG. 17G, the golfrisbee triangle boomerang 173 takes off and flies in the sky.

FIG. 18 shows the swiveling golh club and the universal direction wing technology applied to golfrisbee disk 1*d*. The flying object is a disk 1*d*. FIG. 18A and FIG. 18C is the application of the swiveling golh club technologies to the golfrisbees 1*dm* and 1*d* made of flying disk. As shown in FIG. 18A, the golfrisbee 1*dm* has the cross section as shown in FIG. 10D.

Figure 18C:
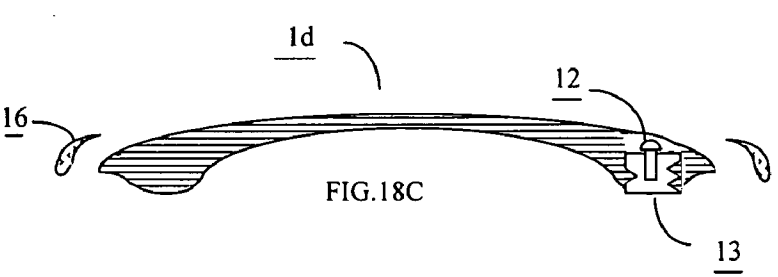
Figure 18A:
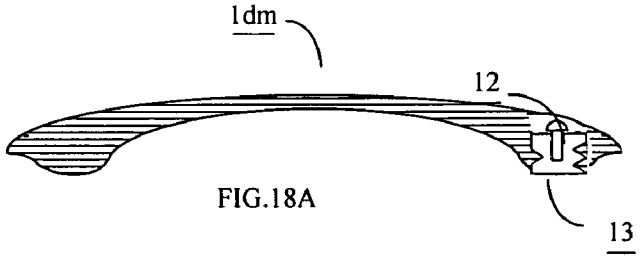
Figure 18D:
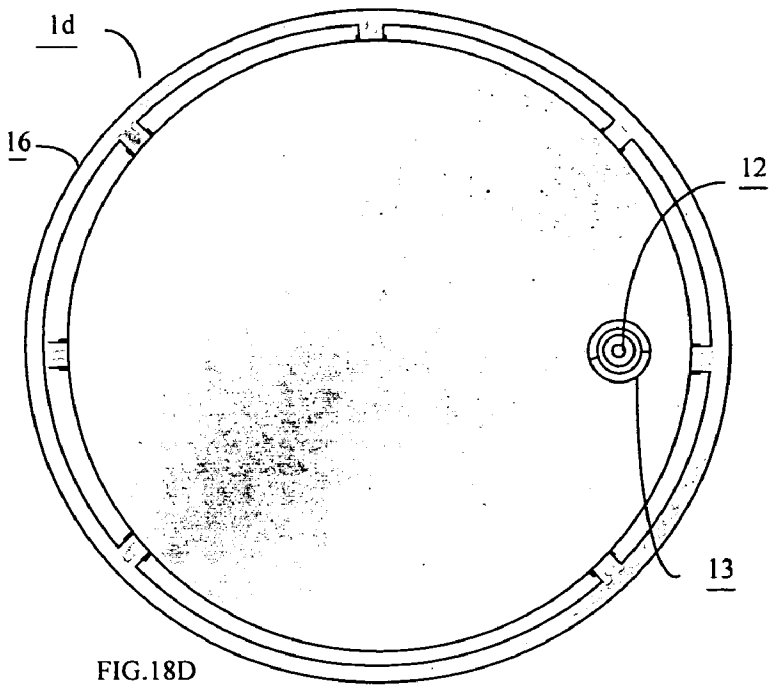
Figure 18B:
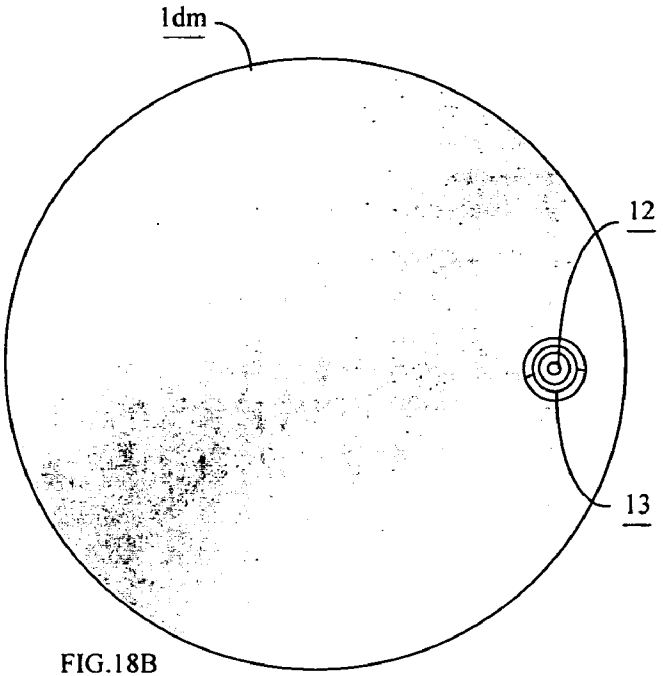
Figure 18E:
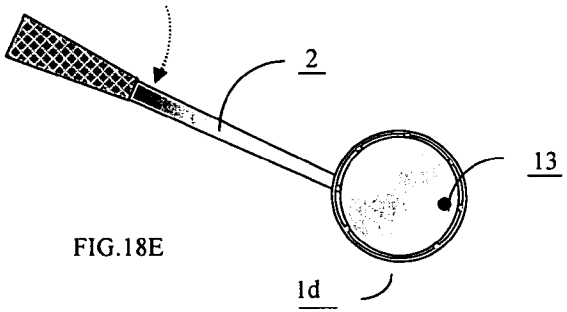
Figure 18F:
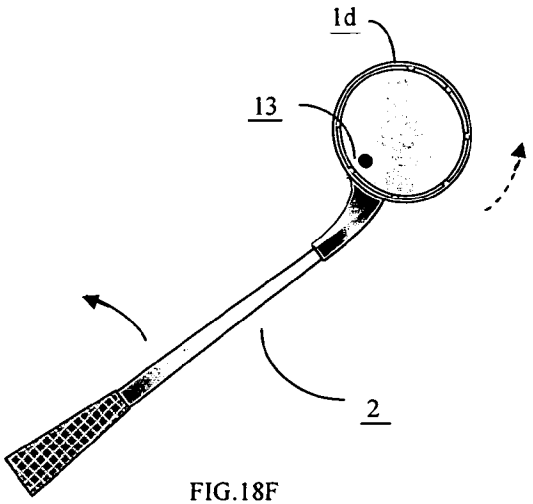
Figure 18G:
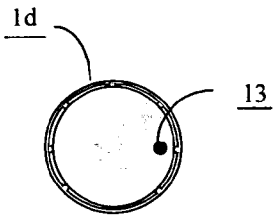
Figure 18G:
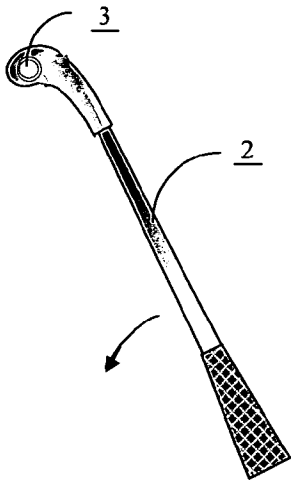
Figure 19C:
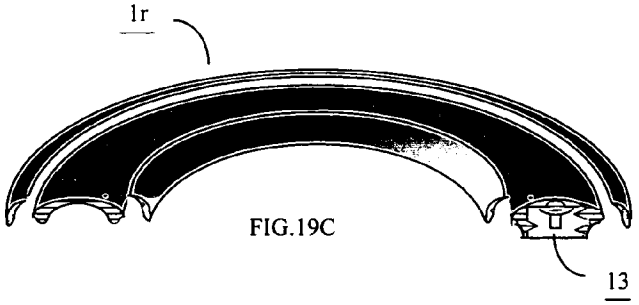
Figure 19A:
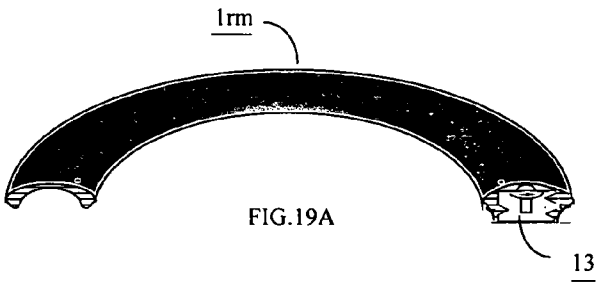
Figure 19D:
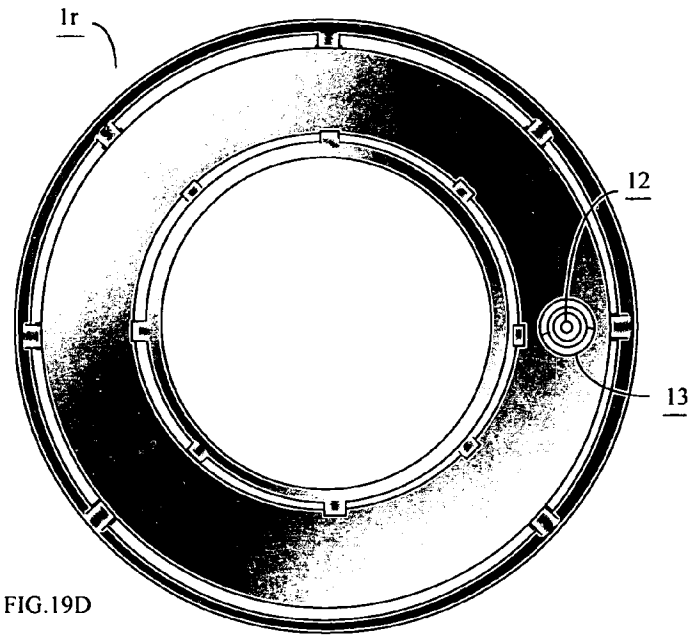
Figure 19B:
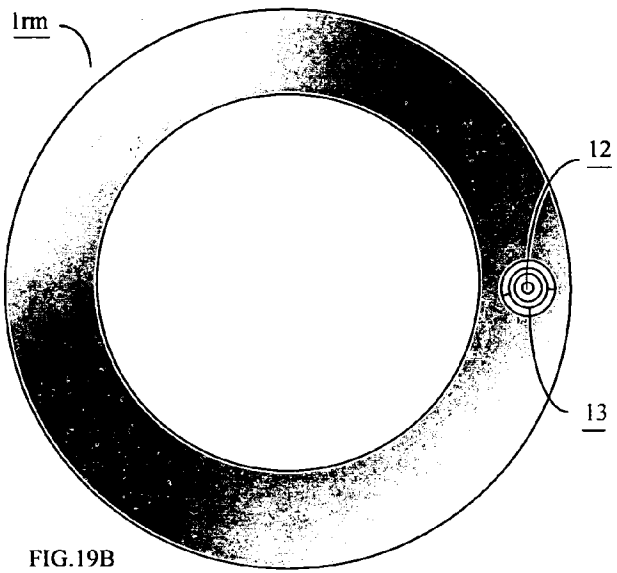
Figure 19G:
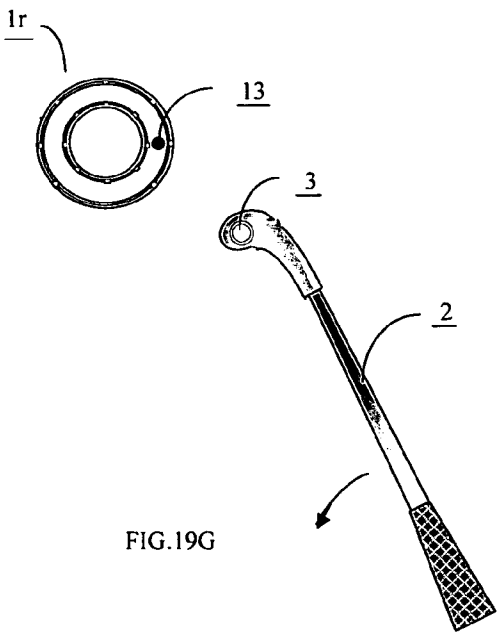
Figure 19E:
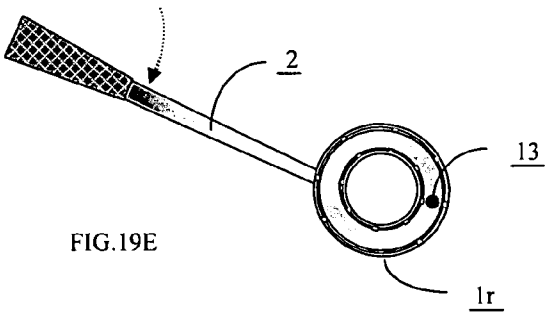
Figure 19F:
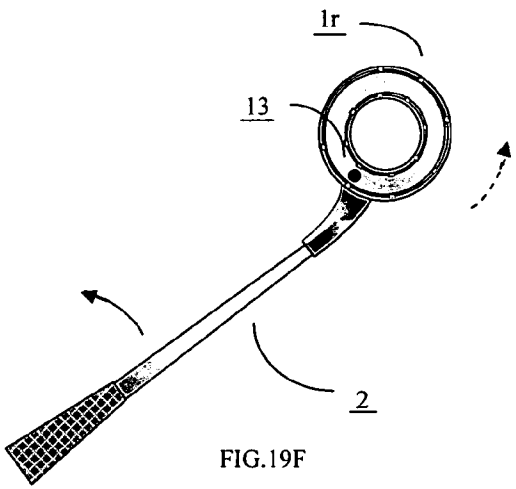
Figure 20A:
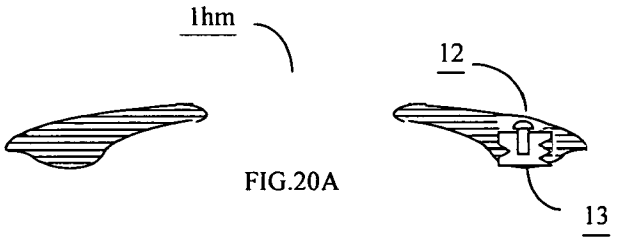
Figure 20B:
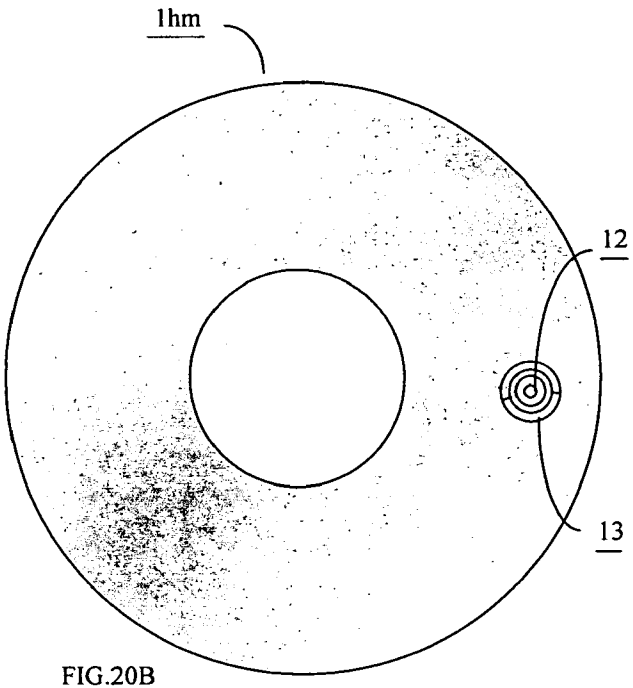
Figure 20C:
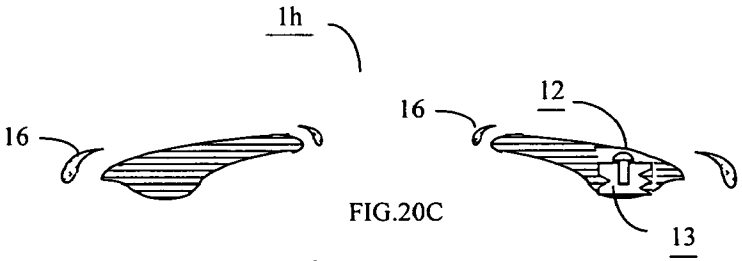
Figure 20D:
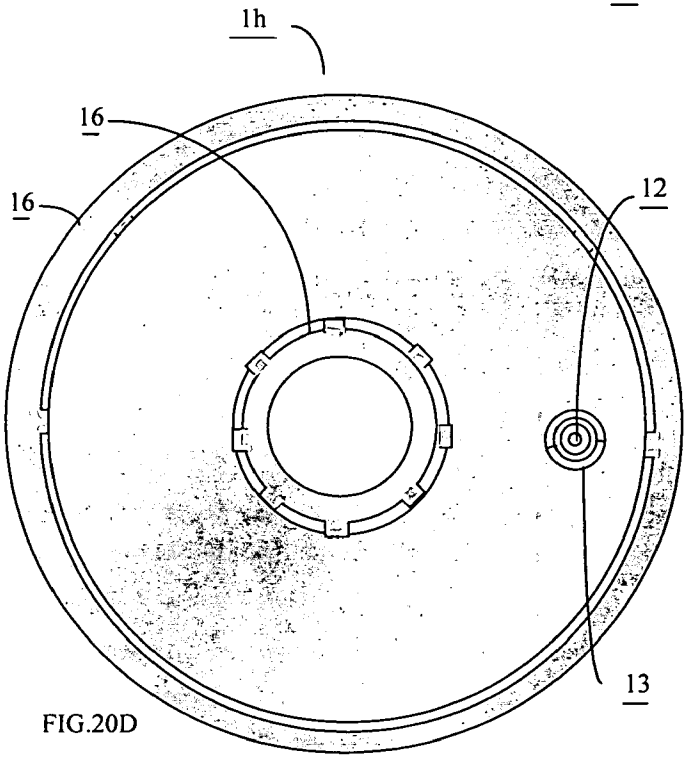
Figure 20G:
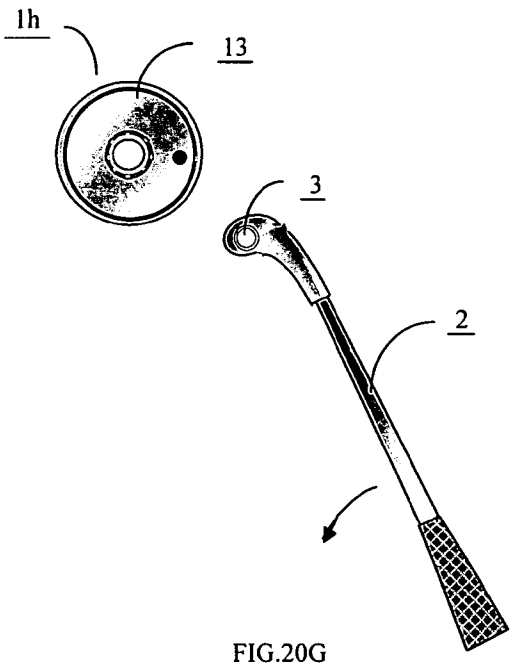
Figure 20E:
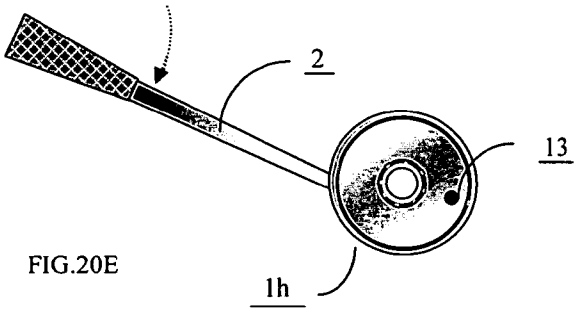
Figure 20F:
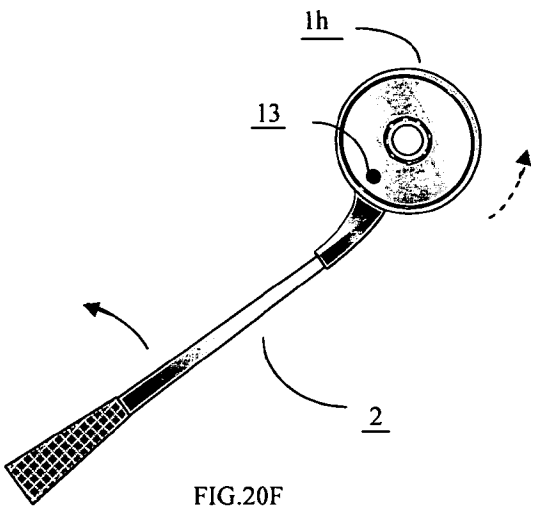

As shown in FIG. 18C, the golfrisbee 1*d* has the cross section as shown in FIG. 10H. A light and sound generator 12 is installed in the middle of female screw 13. The male screw 34 of club head is empty in the middle portion. The light and sound generator 12 is embedded in the cavity of female screw 13 not only to reduce air drag to increase throwing distance of flying disk but also having weight balance for the flying disk. Since the golfrisbee can have the sound device and light device installed, the snow golh and night golh has the long Drive capability with golfrisbee. The golh can be played in the snowy golf course to be snow golh. The snow golf course just needs to blow the snow away from the putting hole area to clean out a small area for putting the golf ball. With the golh, the snowy golf course can continue the operation in the winter season. As shown in FIG. 18E, the golh club 2 is swiveled backward to be ready to throw the golfrisbee disk 1*d*. As shown in FIG. 18F, due to the eccentric force, the golfrisbee disk 1*d* rotates. As shown in FIG. 18G, the golfrisbee disk 1*d* takes off and flies in the sky.

FIG. 19 shows the swiveling golh club and the universal direction wing technology applied to the golfrisbee ring 1*r*. The flying object is a ring 1*r*. FIG. 19A and FIG. 19C is the application of the swiveling golh club technologies to the golfrisbee rings 1*rm* and 1*r*. As shown in FIG. 19A, the golfrisbee ring 1*rm* has the cross section as shown in FIG. 10D. As shown in FIG. 19C, the golfrisbee 1*r* made of the ring has the cross section as shown in FIG. 10H. As shown in FIG. 19E, the golh club 2 is swiveled backward to be ready to throw the golfrisbee ring 1*r*. As shown in FIG. 19F, due to the eccentric force, the golfrisbee ring 1*r* rotates. As shown in FIG. 19G, the golfrisbee ring 1*r* takes off and flies in the sky.

FIG. 20 shows the swiveling golh club and the universal direction wing technology applied to golfrisbee diskring 1*h* made of the hybrid of the disk and ring. The flying object is a diskring 1*h*. FIG. 20A and FIG. 20C are the application of the swiveling golh club technologies to the golfrisbee diskrings 1*hm* and 1*h*. As shown in FIG. 20A, the golfrisbee diskring 1*hm* has the cross section as shown in FIG. 10D. As shown in FIG. 20C, the golfrisbee diskring 1*hm* has the cross section as shown in FIG. 10H. As shown in FIG. 20E, the golh club 2 is swiveled back to be ready to throw the golfrisbee diskring 1*h*. As shown in FIG. 20F, due to the eccentric force, the golfrisbee diskring 1*h* rotates. As shown in FIG. 20G, the golfrisbee diskring 1*h* takes off and flies in the sky.

The drag force determines the flying distance. The wobbling phenomena and the abrupt shape are the most important two aerodynamic drag factors. To eliminate the wobbling, the structure of golfrisbee is symmetrical. To reduce the drag force, the golfrisbee shape is further smoothed. The essential difference between the golfrisbee and the conventional hand-thrown flying disk is that the golfrisbee 1 gets rid of all the sharp edges. It has no edge at all. The golfrisbee 1 has the dome shape smooth design in its middle portion. The golfrisbee 1 with the skirt 16 is safe to play in the park. It is the only flying disk having both the thin profile of the ring structure and the dome shape of the flying disk. The golfrisbee 1 is launched with the golf club 2. The golfrisbee screw 13 is about half turn only. It makes the golfrisbee 1 be able to have very thin profile.

Figure 21A:
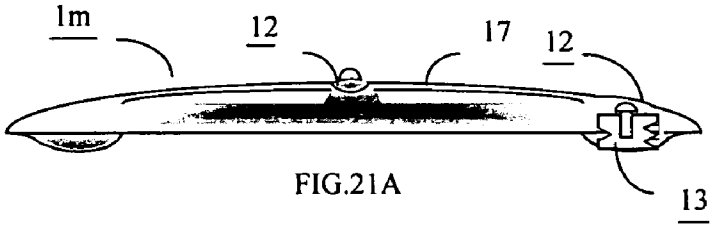
Figure 21D:
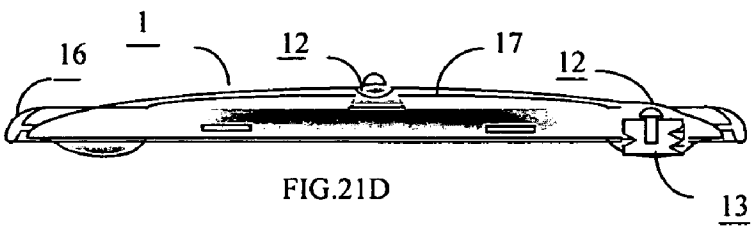
Figure 21B:
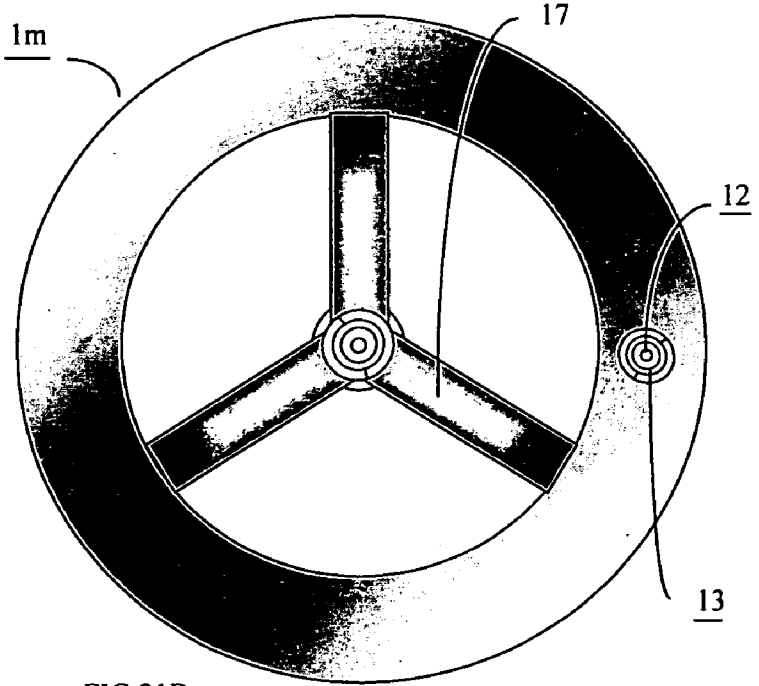
Figure 21E:
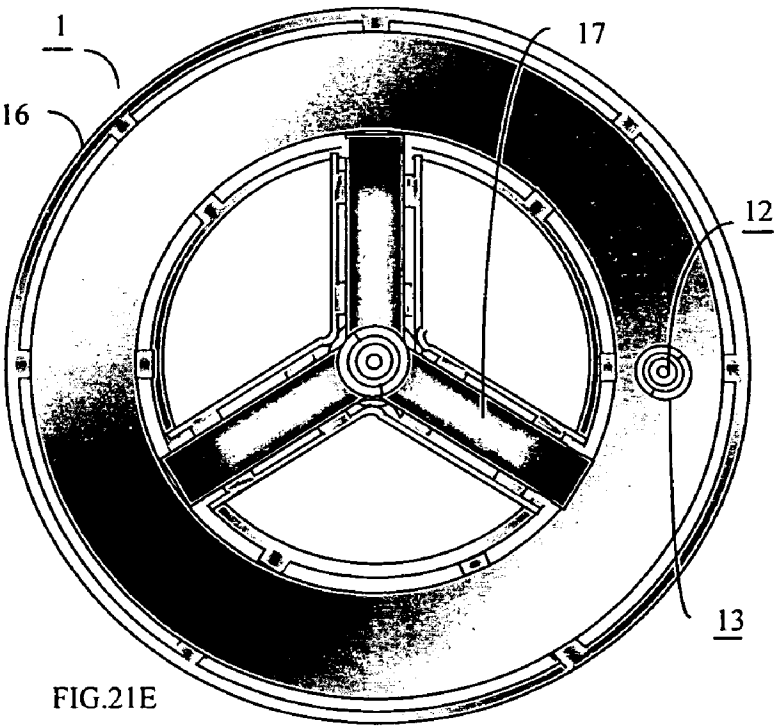
Figure 21F:
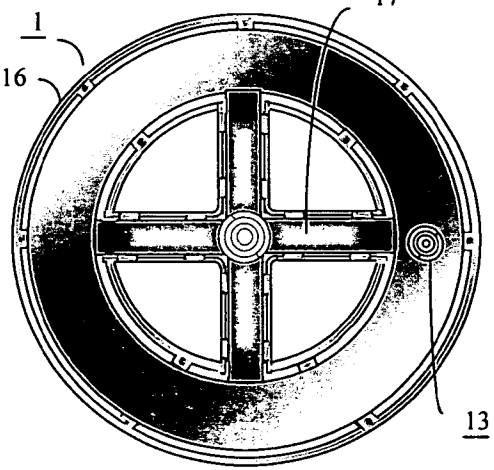
Figure 21C:
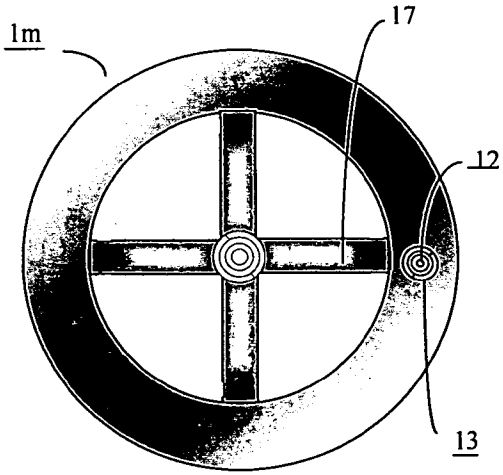
Figure 21G:
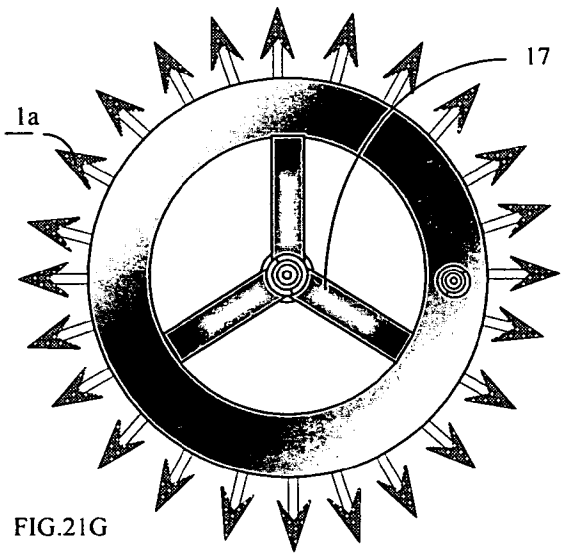
Figure 21J:
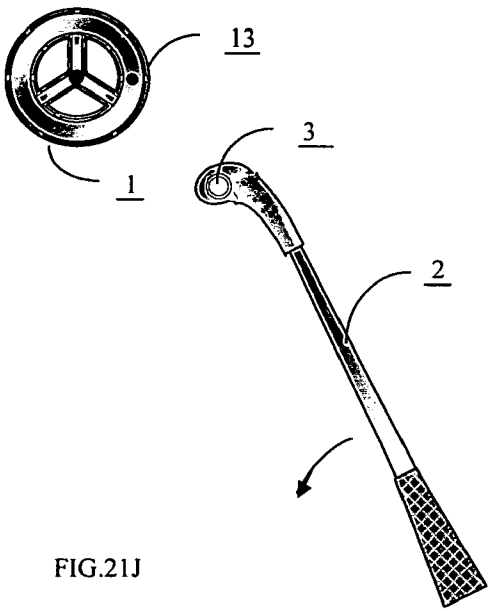
Figure 21H:
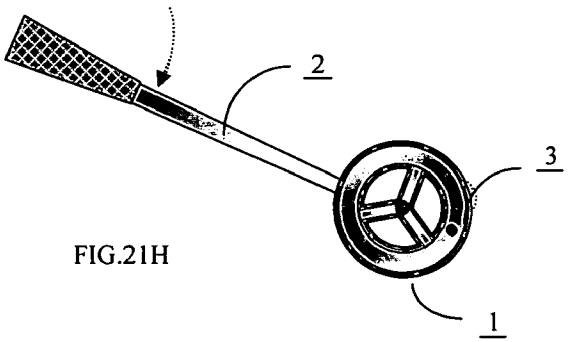
Figure 21I:
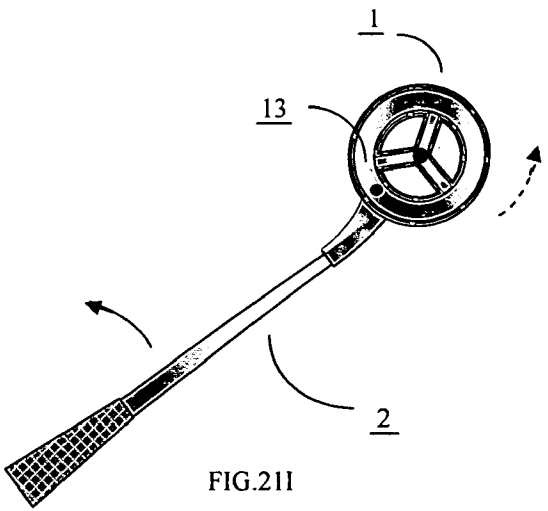
Figure 22A:
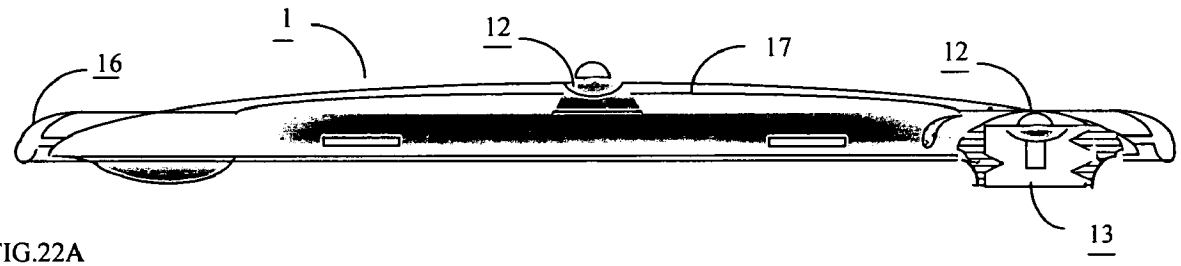
Figure 22B:
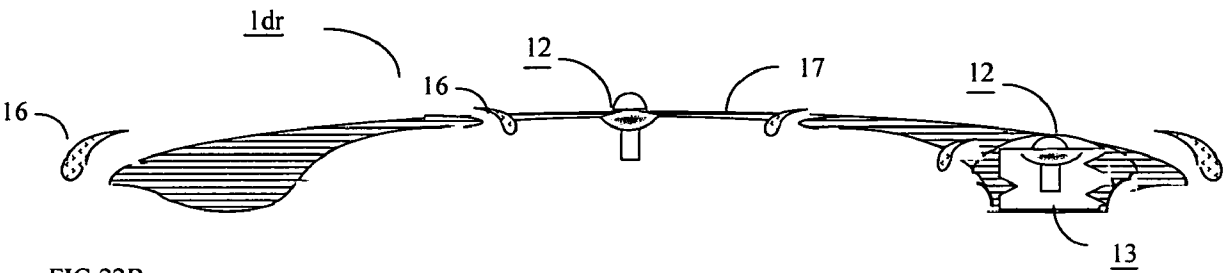
Figure 22C:
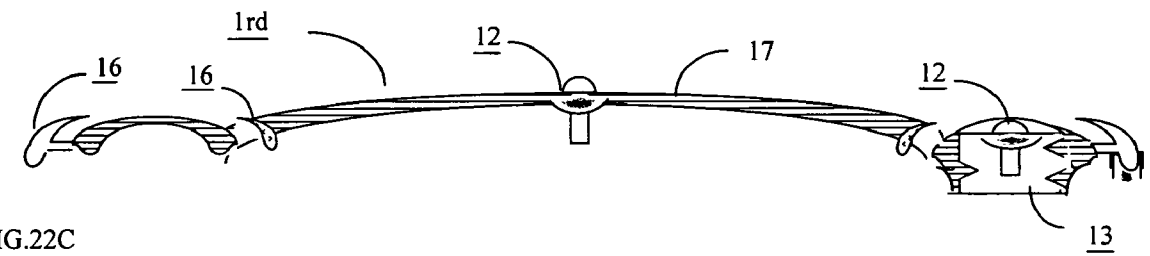

FIG. 21 shows the swiveling golh club and the universal direction wing technology applied to boomerang diskring or boomerang ring. As shown in FIG. 22, the same golfrisbee 1 has the structure to be diskring 1*dr* as shown in FIG. 22B or the structure to be ringdisk 1*rd* as shown in FIG. 22C. Both of them are referred to be the golfrisbee 1. The golfrisbee 1 has the hybrid structure of the disk, ring and boomerang. FIG. 21A and FIG. 21D are the application of the swiveling golh club technologies to the sky ballet golfrisbee 1 made of the boomerang diskring 1*dr* or boomerang ring 1*rd*. As shown in FIG. 21A, the golfrisbee 1*m* is the main plane of the structure either to be the main plane of diskring 1 dr as shown in FIG. 22B or the structure of main plane to be the main plane of ring (ringdisk) 1 rd as shown in FIG. 22C.

As shown in FIG. 22B, the flying object is a boomerang type diskring 1*dr*. The boomerang 17 is at the center portion of the diskring 1*dr*. The boomerang 17 is constituted of a plural of branches. As shown in FIG. 22C, the flying object is a boomerang ring 1*rd* and the boomerang is at the center portion of said diskring 1*dr*. The boomerang 17 is constituted of a plural of branches. As shown in FIG. 21C, the golfrisbee 1 has the cross section is either to be diskring 1*dr* as shown in FIG. 22B or the cross section of ring 1*rd* as shown in FIG. 22C. As shown in FIG. 22G, the golh club 2 is swiveled backward to be ready to throw the sky ballet golfrisbee 1. As shown in FIG. 21H, due to the eccentric force, the sky ballet golfrisbee 1 rotates. As shown in FIG. 21J, the golfrisbee 1 takes off and flies in the sky. As shown in FIG. 21G, there are arrowheads 1*a* around the peripheral of the golfrisbee 1*m*. As shown in FIG. 1E, swiveling the golh club, the golfrisbee with arrowhead hits and attached on the target board 18*a*.

FIG. 23 shows the alternative design of the golfrisbee 1 made of the boomerang diskring. As shown in FIG. 23D, the boomerang polygon is the combination of two different boomerangs 172*m* and 173*m* as shown in FIG. 16 and FIG. 17. Comparing with the boomerang polygon as shown in FIG. 23E with the boomerang diskring as shown in FIG. 23A, the boomerang diskring is the boomerang polygon with the number polygon edges to be infinite. The golfrisbee 1 is also considered to be the combination of the boomerang 172*m* as shown in FIG. 16 and the diskring 1*h* as shown in FIG. 20. As shown in FIG. 23, the hole 42 in the ring band is to reduce the weight. The center weight 12 is added to the center of the golfrisbee to increase the spinning effect. The center weight 12 is constituted of the weights 120, 124 the screw 122 and the nut 123. For the night golf and/or snow golf, the weight 120 and/or 124 can be either the light source and/or the sound source. For the ultra long distance, the addition of the weight is not easy. If the weight is larger than the aerodynamic lift force, the flying disk will dive downward and the flying distance is decreased instead of increase. Therefore, the light or sound for the night golh and snow golh needs to have a very compact design to reduce the weight and size.

To have the long drive in night golf or snow golf, the LED and buzzer have to be installed on the golfrisbee 1. Night golh is to play golh in the night. Night golh is the golh sport in the desert places. Why there is the need for the night golh? The first reason is that it is too hot to play golh during the daytime for the cities in the desert such as Las Vegas. The golher has to wait until the temperature is cooled down in the night. The night golh is the only golh which can be played in the hot desert. The second reason is that, in the weekdays, after the business hour, it is already 6 p.m. It becomes dark. If the golher wants to play golh in the weekday, the night golh is the only choice.

Comparing golh with golf, the night golf is limited to be putting only! It is difficult to find the long drive flying golf ball in the night. To have the long drive in night golf or snow golf, the LED and buzzer have to be installed on the golfball. However, as the golfball is hit by the golf club, the impact force will destroy the LED and buzzer. As the highflying golfball falls on the ground, the impact force will destroy the LED and buzzer installed in the golfball, too. Therefore, it is impossible to mount any signal indicator device on the golfball. The long drive of the golf ball causes no night golf, no snow golf, no park golf and booking for tee-time. It causes the usage of the golf course to be low. So, the light and/or sound generator mounted on the golfrisbee is very important for the golh to have the night golh and snow golh to increase the usage of the golf course.

As shown in FIG. 36, the weight 120 is the light source for the night golh and snow golh. The screw 122 passes the hole 1203 to hold the light 120 to the golfrisbee 1. The light source 1200 emits the light in the night golh to guide the golher to locate the golfrisbee. To save the power, the light sources are LED. The LEDs have different colors. As the golfrisbee rotates in the night, it has the rainbow in the dark sky. The switching button 1201 can be pushed to shut the battery power. The switching button can be capacitor type that the seal of 1201 can be solid. The battery and the switching circuit 1202 are to supply the power and light control to the light source 1200.

As shown in FIG. 37, it shows the sound source 124 is to add the weight at the center of the golfrisbee for the night golh and snow golh. The screw 122 passes the hole 1243 to hold the sound source 124 to the golfrisbee 1. The speaker 1240 generates the sound to guide the golher to locate the golfrisbee. The switching button 1241 can be pushed to shut the battery power. The switching button can be capacitor type that the seal of 1241 can be solid. The battery and the switching circuit 1242 are to supply the power and light control to the light source 1240.

As shown in FIG. 28, to have the video, audio effect and enhanced curved flying capability, the golfrisbee is modified to be the helicopter type golfrisbee as shown in FIG. 24. To have the control of the soft landing in the golfrisbee basket 182*cp*, the boomerang golfrisbee 1 adjusts the boomerang wing 17 to have different curved path. The boomerang wing 17 has many different wing segments to modify the curved flying path of the golfrisbee. As shown in FIG. 28A, the boomerang wing 17 having the segment 17*a* is for the right-hand golh club to have the curved up flying path. As shown in FIG. 28B, the boomerang wing 17 having the segment 17*b* is for the left-hand golh club to have the curved up flying path. As shown in FIG. 28C, the boomerang wing 17 having the segment 17*c* is for the left-hand golh club or right-hand club to have the curved up flying path. The segment 17*c* is derived from the bi-directional wing segment 1*m* as shown in FIG. 10D. As shown in FIG. 28D, the boomerang wing 17 having the segment 17*d* is for the right-hand golh club to have the curved down flying path. As shown in FIG. 28E, the boomerang wing 17 having the segment 17*e* is for the left-hand golh club to have the curved down flying path. As shown in FIG. 28F, the boomerang wing 17 having the segment 17*f* is for the left-hand golh club or right-hand club to have the curved down flying path.

As shown in FIG. 24, the golfrisbee has the universal wing 17*a*. The wing segment 17*a* can adjust the angle of attack to change the flying path of the golfrisbee. The wing segment 17*a* has the short stub 17*b* pivotally fitting in the golfrisbee body. Changing the angle of the attack of the wing segment 17*a*, the lift force of the golfrisbee will change. The flying path of the golfrisbee will change accordingly.

Figures 26A, 26B, 26C:
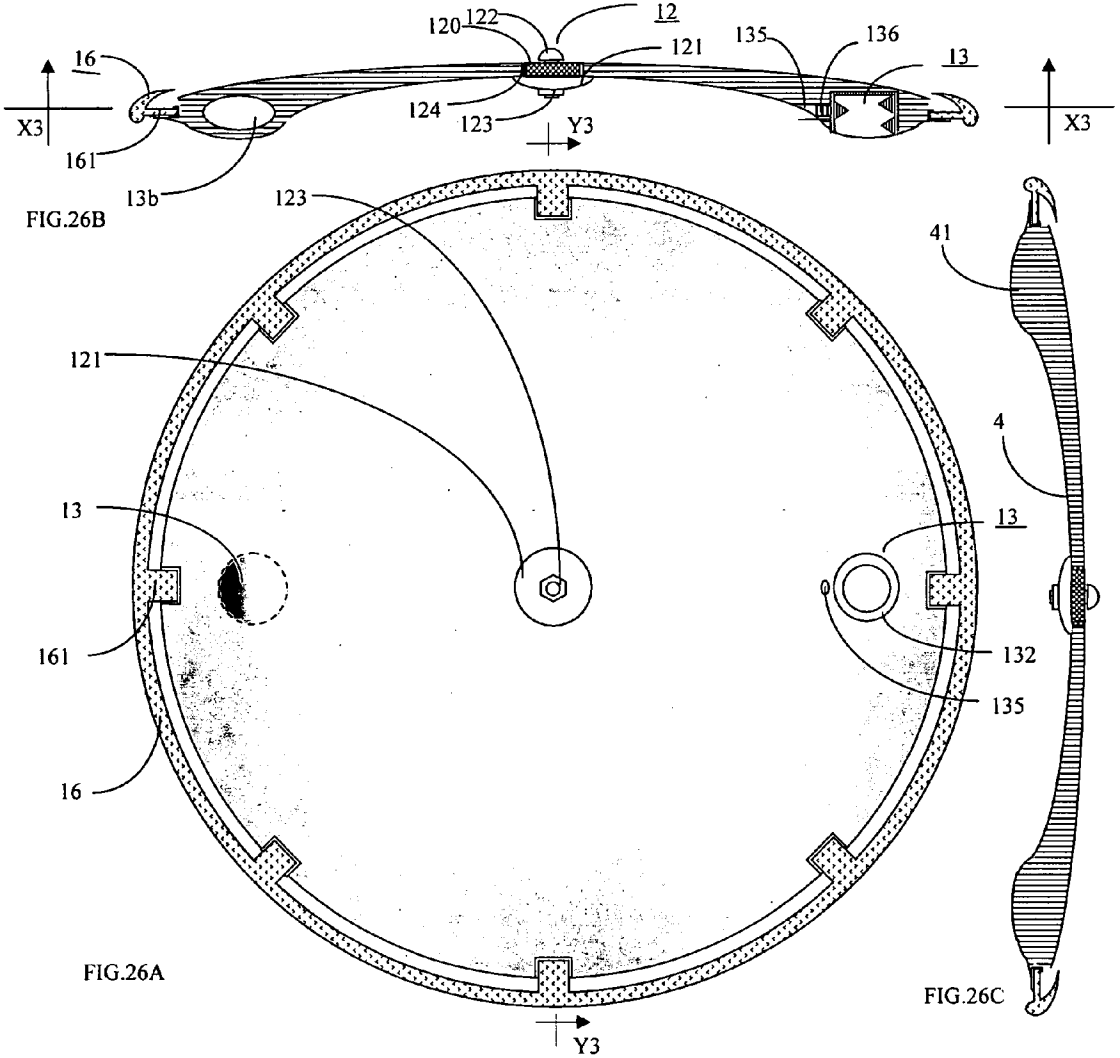
FIG. 26 is the section view of the golfrisbee having the exchangeable screw cap and weight-balanced design; (A) is the bottom view of the golfrisbee taken along the X3—X3 line in FIG. 26B; (B) is the horizontal section view; (C) is the vertical section view taken along the line Y3—Y3 in FIG. 26A.

There are many different versions of the golfrisbee. As shown in FIG. 24, the cap 131L is the punched through cap. For the punched through type cap, the launching angle can be increased a lot. Furthermore, the golfrisbee 1 can be made much thinner. It can reduce the drag force. The flying distance can be much farther. As shown in FIG. 25 the wing segment 17 is optional to be removed to be a golfring. As shown in FIG. 26, the golfrisbee has only one right hand cap to minimize the air drag. To have the weight balance, the air bubble 13*b* is embedded in the golfrisbee body on the opposite site of the cap. The volume of the air bubble is the same as the volume of the cap.

In addition, we need to provide the system pack solution. Golh is to introduce a complete system pack solution to the existing golf and flying disk problems. It offers the solution for the snow golf, night golf, park golf and disk golf. One unique golfrisbee disk will fulfill all the different tough requirements of the different golf sports.

The screw needs the lubricant to reduce the static friction. The initial static friction causes the uncertainty during the golh club swiveling process. To have the consistent swiveling process and expected result, the lubrication is needed to eliminate the stick force of the initial static friction. Furthermore, as the golfrisbee falls on the ground, the dirt sticks to the screw of the cap. It will cause the inconsistent swiveling result. So, the cap 13 of the golfrisbee is needed to be checked and cleaned quite often for the serious competition of championship.

The screw system of the golfrisbee cannot allow the dirt or sand to attach to it. We need to have the field cleaner to clean the sand and dirt away. Comparing with golf, the golh is a high-tech sport. To play good, you need to understand the mechanics, aerodynamics, etc. The most difficult problem is the initial static friction/stick force problem during the golfrisbee launching process. To swing consistently, the screw fit cap of the golfrisbee needs to be cleaned with blowing air and applied with lubricants of different viscosity. The static friction controller contains the compression air and lubricant.

As shown in FIG. 27, in the field operation, we use the static friction controller 7. It has the three processes to be integrated in one bottle device: the air compression, the air cleaning and the lubricant application. The static friction controller is constituted of the compressing cylinder 70, the switching block 71, the spraying nozzle 72 and the container 74. The lubricant 75 is stored in container 74. The cap 742 is to seal the lubricant 741 entrances. The spraying nozzle 72 is mounted on the top of the sliding cylinder 70. The sliding tube 70 can be fit in the hole 722. The cavity 723 guides the fluid into the nozzle 720. The hole 721 is to fit for the spraying tube. Press on the nozzle 72, the cylinder 70 slides downward. The one-way compression piston 7021 moves upward to seal the conduit. The one-way compression valves 714 moves downward to allow the air to be sucked into the conduit 713. The air inside the switching block compartment 716 is forced to flow out into the container 74. As the finger is released, the sliding cylinder 70 moves upward under the air pressure in the compartment 716. The air inside the conduit 713 is compressed and the one-way valve 714 is closed. As the air pressure inside the conduit 713 is larger than the air pressure in the compartment 716, the one-way valve 7021 moves downward. The compressed air flows into the compartment. Repeating the process as shown in FIG. 27A and FIG. 27B reciprocally, the air pressure inside the container 74 is built up.

Figure 27B:
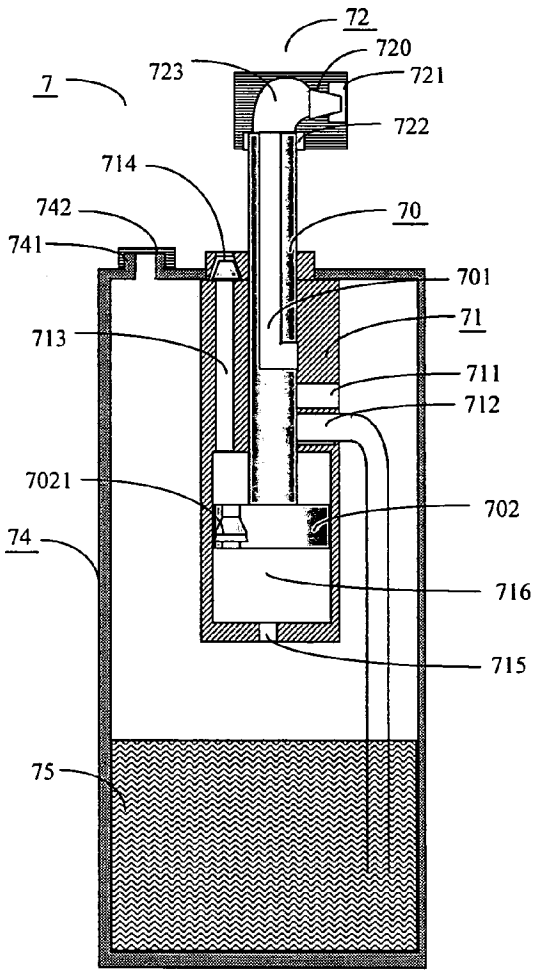
Figure 27A:
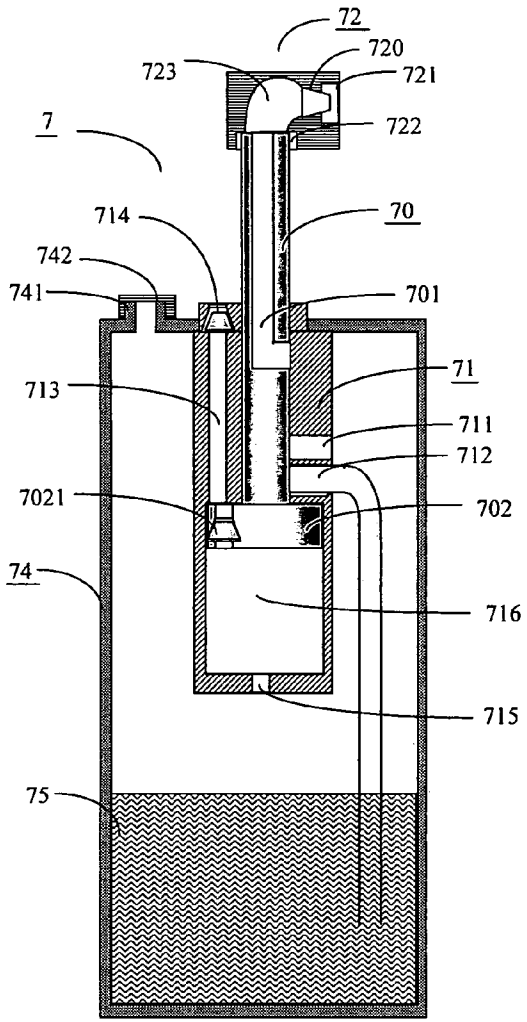
Figure 27D:
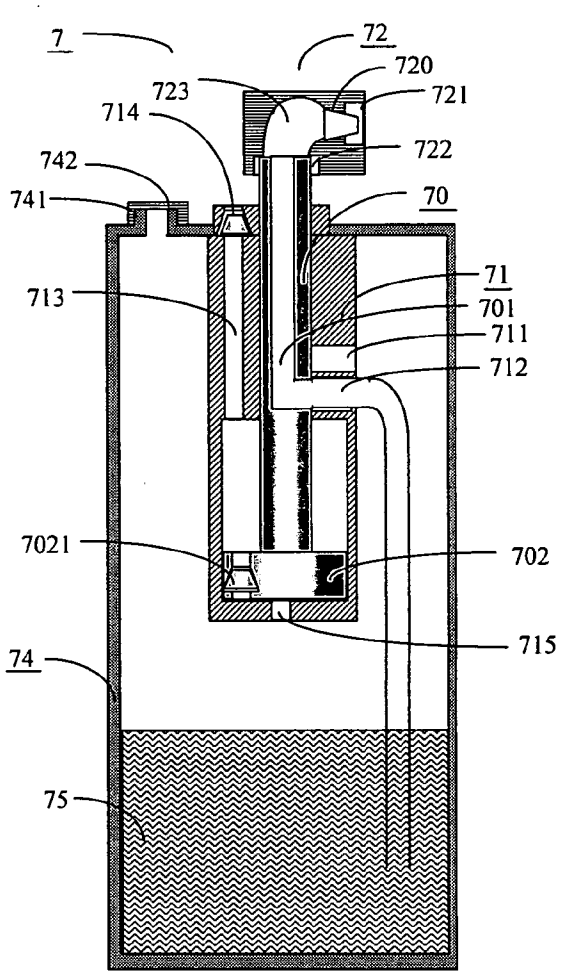
Figure 27C:
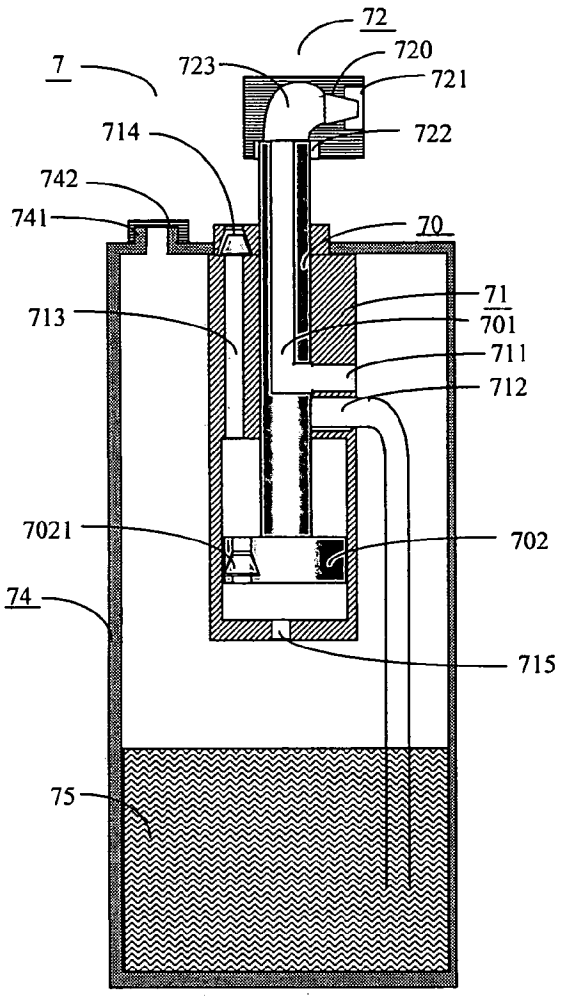

To use the compressed air to clean the cap of the golfrisbee or the screw of the golh head, as shown in FIG. 27C, the finger holds the sliding tube at the position to have the conduit 701 to align with the hole 711 on the wall of the switching block 71. The compressed air flows through the hole 711, the conduit 701, the cavity 723, and the nozzle 720. The compressed air blows on the cap or screw to blow away the dirt. As the dirt is cleaned, the golher can apply the lubricant 75 to the cap or screw. As shown in FIG. 27D, the finger holds the sliding tube 70 at the position to have the conduit 701 to align with the hole 712 on the wall of the switching block 71. The lubricant 75 flows through the hole 712, the conduit 701, and the cavity 723 and the nozzle 720. The lubricant 75 sprays on the cap and screw to lubricate the cap and screw.

Golf sport has one bag to carry many different golf clubs. Golh sport also has many different golh clubs for the golher to carry. For example, different pitch of the screw, different launching angle, different type of screw, different length of club, etc, there are many different golh clubs. Therefore, the golher may carry several golh clubs. Even worse, the flying objects have versatile disk, boomerang, ring, etc to be the flying object. So, the golher needs more room for the golh bag. However, to carry the golh bag walking on the snow is not so easy. So, the trolley is needed.

Both snow golh and night golh have the highflying disk activity. Using the golfrisbee, the snow golh and the night golh have the complete golf course activity. The golh can boost up the golf course income a lot. Definitely, the golf courses will welcome the golh for their own benefit of the golf course income. Due to the night golh, the golf course can operate at night in the weekday or in the hot desert. Due to the snow golh, the golf course can operate in the snowy winter. This is the win—win solution for the golf course and the golhers. It reduces golfer cost a lot, too. The member fee of the golf course will worth more. The golf course will sell the golh club and golfrisbee and encourage all the golfers to play golh in the night or in the snowy days. To encourage the golfer to play the golh, they will allow the golhers to share the same course and no tee-time!

The golfrisbee can be played in the snowfield to be the ski golh. The ski golh is to play the golh with the cross-country ski. The snow golh and ski golh are referred as white golh. With the golfrisbee, in the shiny sunshine, the golher can play the white golh. The white golh has the different taste from the green golh. To play the white golh, we need to provide the auxiliary equipment. The complete system package includes the golh cart equipped with ski to play the ski golh.

The golf never plays in the snowfield or the dark field. In $_{19}^{th}$ century, the USGA (United States Golf Association) already set the game rule for the snow golf. However, the snow golf cannot keep the snowy golf course to operate in the winter. After 110 years, the snow golf still cannot play the highflying golf ball game. It is impossible to have the long drive of the golf ball in the snowy golf course. It is hard to find the golf ball in the white snow course. Therefore, the snow golf and night golf are also limited to the putting only. Today the snow golf and the night golf already have the special rules and means. Both are the in-door golf activities to putt the golf ball to roll into the hole only. The golf cart, golf trolley or golf bag is not designed for the snow golf or night golf. The golf cart is a four wheels electrical car. The golf trolley cannot carry golfer. The golf bag is too heavy to be used on the soft snow. Therefore, the golf cart or golf trolley is not capable to work in the snowfield and the dark field.

To carry the heavy golf bag to walk on the soft snow is not an easy job. For the golf course in the desert of Las Vegas, the snake and animal will come out in the night. We need to minimize the hazards in the snow golh and night golh. The golh bag is integrated with the personal portable golh cart. The golher can ride on the personnel portable golh cart in the golf course to minimize the hazards and speed up the play. As he arrives at the disk-landing place, he can step down the golh cart; pop the support stick to support the golh cart as the standing golf bag. The golh cart will serve as the standing bag as you play the golh. As the golher launches the golfrisbee disk, the golher can immediately step on the golh cart to run after the flying disk.

Figure 29B:
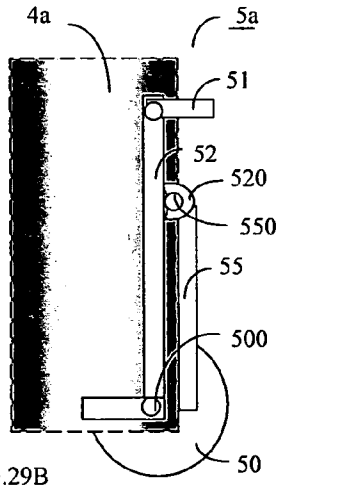
Figure 29D:
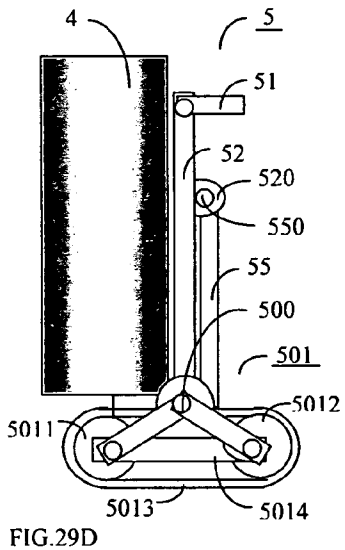
Figure 29A:
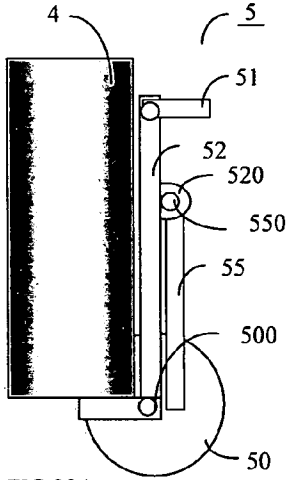
Figure 29C:
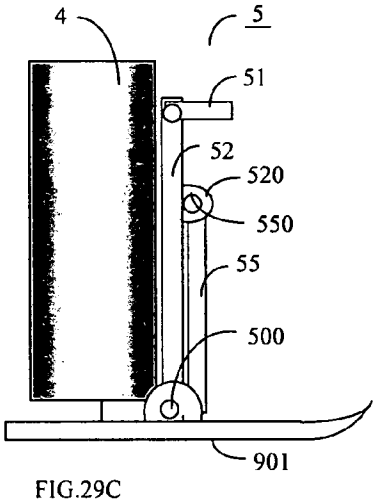
Figure 28A:
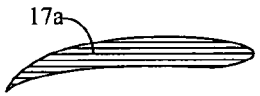
Figure 28B:
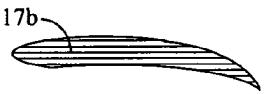
Figure 28C:
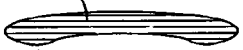
Figure 28D:
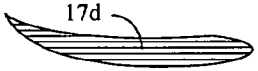
Figure 28E:
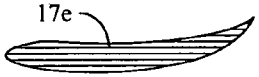
Figure 28F:
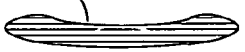

As shown in FIG. 29A, the golh trolley 5 is mounted on the axle 500 of wheels 50. The foldable handle 51 pulls the frame 52 to drag the golh trolley 5 forward. The supporter 55 is hinged to the ear 520 on the frame 52 with the pivotal axle 550. The golh bag 4 is leaned against the frame 52. FIG. 29B shows the golh bag being integrated with the portable trolley 5*a*. To ski on the snow, as shown in FIG. 29C, the trolley 5 is mounted on the snow ski 901. To ski on the snow and run on the road, as shown in FIG. 29D, the trolley is mounted on the belt wheel 501. The belt wheel 501 is composed of two wheels 5011 and 5012, belt 5013 and triangle structure 5014. The trolley 5 is pivotally mounted on the top node of the structure 5014.

To play the night golh in the desert or the snow golh in the heavy snow northern place, the golher has to ride on the cart. In the desert, during the day, the temperature is too high to play golh. The only time to play golh is in the night. However, in the night, the snakes come out, too. The golher has to ride on the golh cart. In the heavy snow place, the snow depth can be very deep. It is impossible for the golher to ski to drag the golf trolley. The golher has to ride on the golh cart, too.

The snow golf course and night golh courses are the tough play environment. We need special golh equipment for the snow golh and night golh. To play the snow golf in the snow golf course, there are other issues to be addressed. To play the snow golf in the field, it is impossible to drag the heavy golf bag to walk on the soft snow in the cold windy golf course. We need a specially designed golh cart to carry the bag and the golher altogether.

Figure 30B:
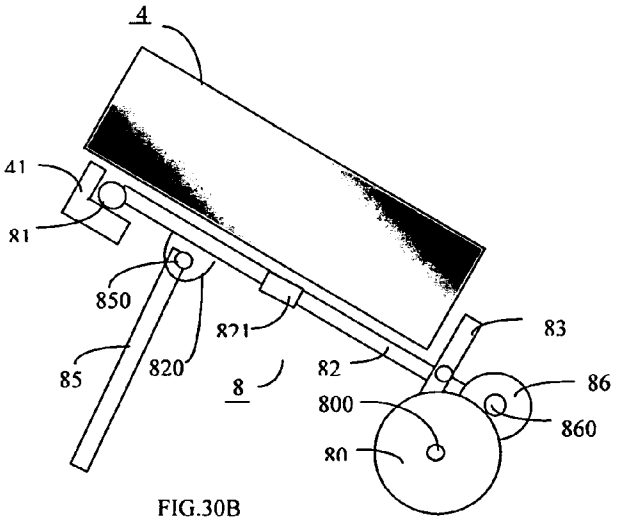
Figure 30C:
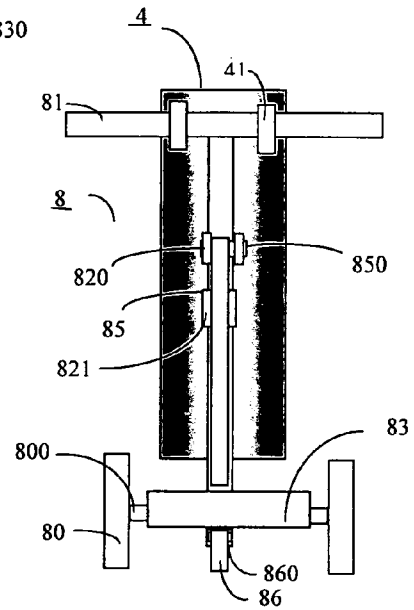
Figure 30A:
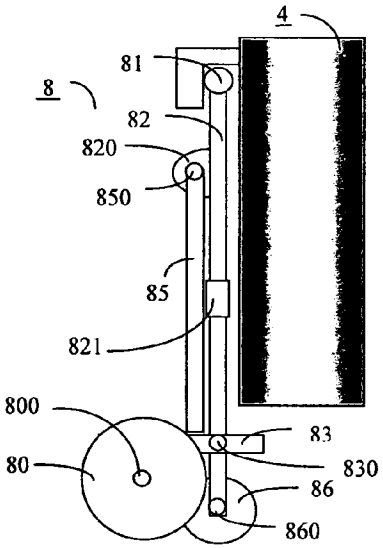

There are two kinds of cart. One is three-wheel golh cart 8 as shown in FIG. 30. The golher can stand on the golh cart 8 to drive the golh cart. The golh cart is a foldable and portable golh cart. Releasing the extension lock 821, the length of pole 82 can be adjusted. The pole 82 is foldable with the pivotal joint 830. The technique for the golh cart adopts our former U.S. Pat. No. 5,474,144 Twin-Wheel Motor Car with Differential Height and Speed Mechanism. It needs only one motor to drive the twin-wheels 80. Since it has three wheels, it does not need the complicate self-balance circuits and control. It does not have the speed limit as the two-wheel golh cart does. Therefore, the cost becomes much cheaper and the speed is much faster. As shown in FIG. 30C, the front wheel 86 is mounted on the support frame 82 with the axle 860. Rotating the handle 81, the frame 82 rotates which also causes the front wheel 86 to rotate to change direction. The twin-wheels have the differential mechanism to drive the wheels 86 to have the different speed during the turning direction. In FIG. 30B, the support 85 pivotally rotates on the axle 850 to support the ear 820. The support 85 supports the frame 82. The golf cart is served as the standing bag and golh trolley.

The golh needs to play as the snow golh and the night golh. It is impossible for the golher to pull the golf trolley in the deep snow. It is extreme dangerous to walk in the dark field. The golh cannot use the existed golf facilities to play the snow golh or night golh. In the snowfield and the dark field, the golh trolley has to be integrated with the golh cart and be able to carry the golher. The Dean L. Kamen et al U.S. Pat. No. 5,971,091 Transportation Vehicles and Methods and U.S. Pat. No. 6,302,230B1 Personal Mobility Vehicles and Methods do not have the trolley function of golh cart. Our new innovative golh cart is unique to have the multiple functions of the golh bag, golh trolley and golh cart. The golh cart is similar to the two-wheel golf trolley. However, the golher can ride on the golh cart.

Figure 35A:
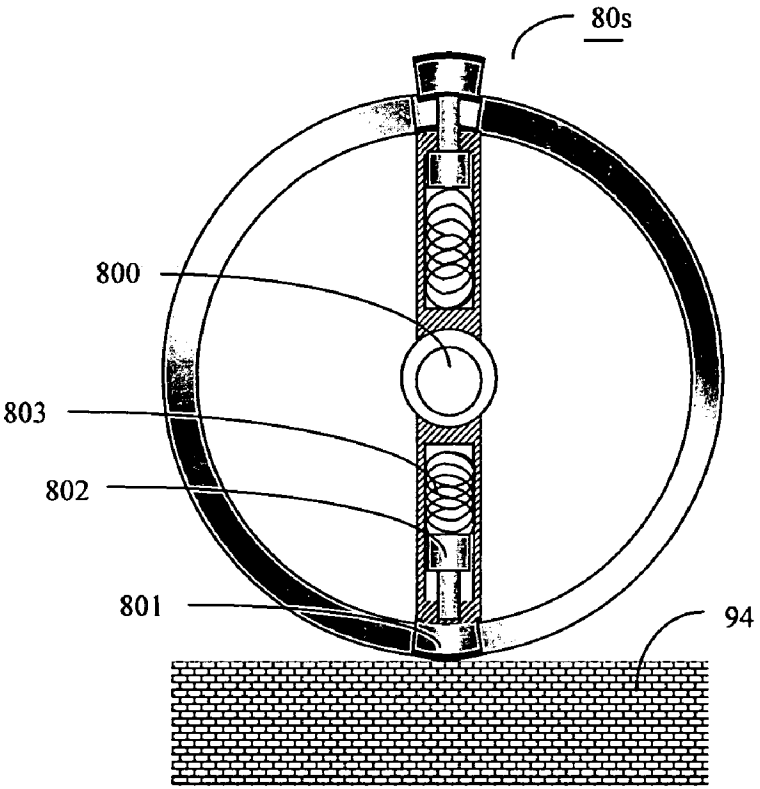

On the contrary, the snow golh and ski golh are the real golf sports in the snowy winter season. To run on the deep snow in the golf course, the wheel can change to be the snow wheel 80*s* as shown in FIG. 35. The wheel paddle 801 is at the end of the cylinder 802. The cylinder 802 is under the bias of the spring 803. As shown in FIG. 35A, the snow wheel 80*s* rolls on the solid ground. The wheel paddle 801 is compressed to be the same circle as the wheel 80*s*. As shown in FIG. 35A, the snow wheel 80*s* rolls on the snow. The wheel paddle 801 is expanded into the snow to serve as the paddle. The wheel paddle 801 expels the snow to drive the golh cart 8 forward or backward.

Figure 30E:
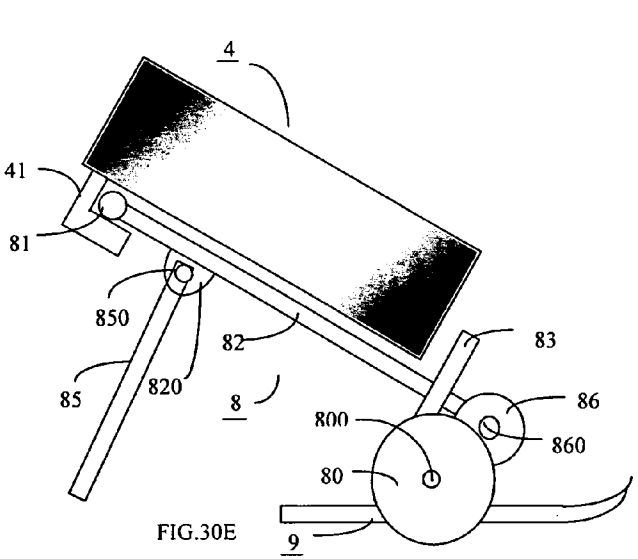
Figure 30D:
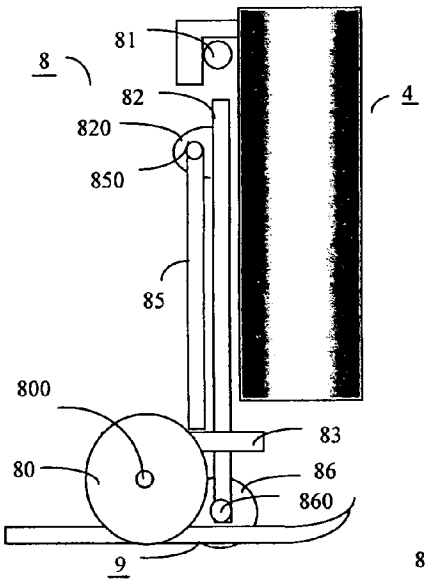
Figure 30F:
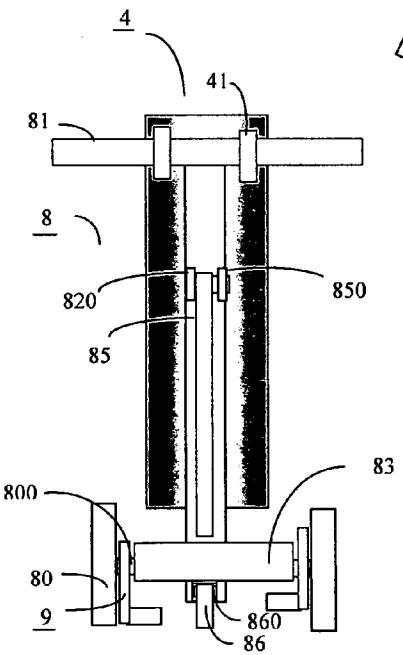
Figure 31B:
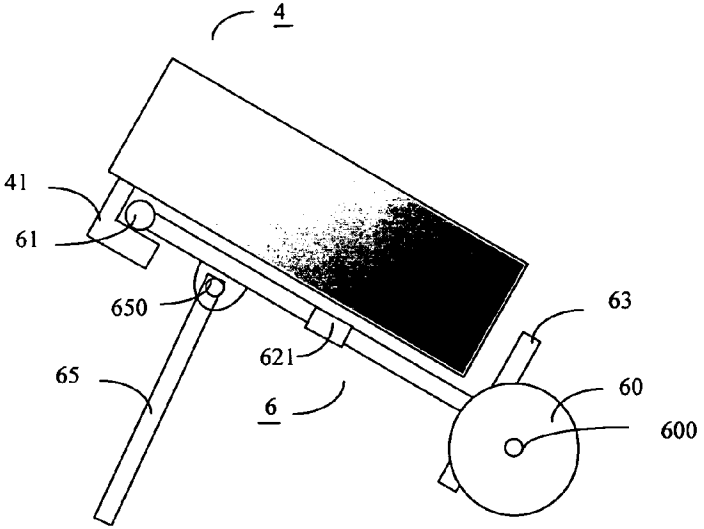
Figure 31C:
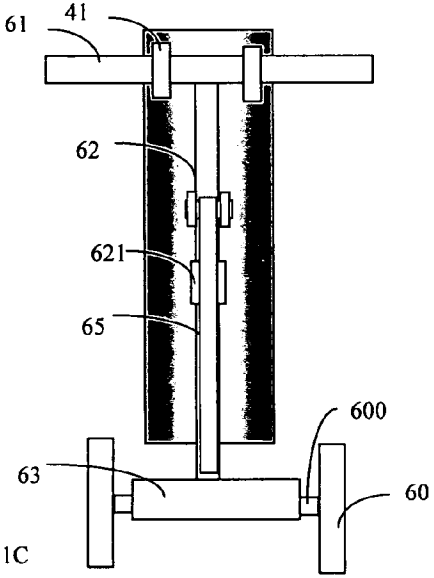
Figure 31A:
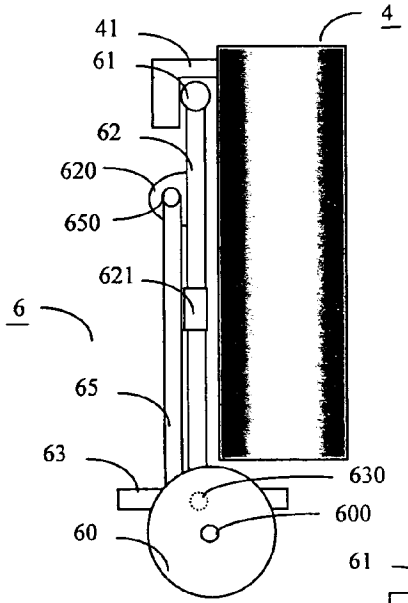
Figure 31E:
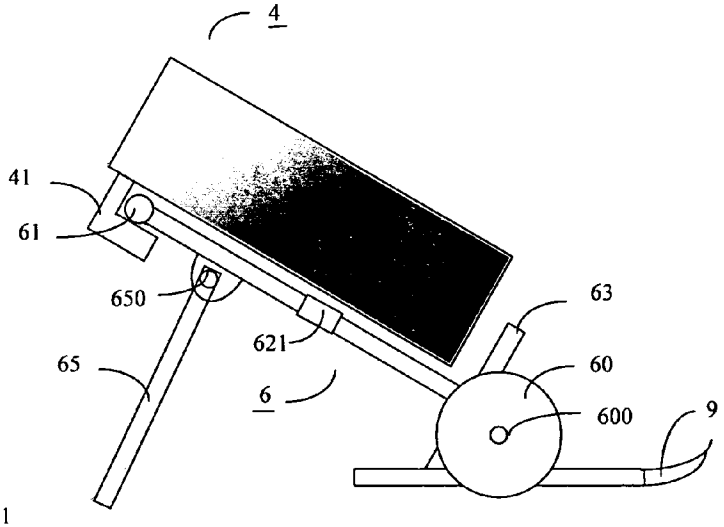
Figure 31F:
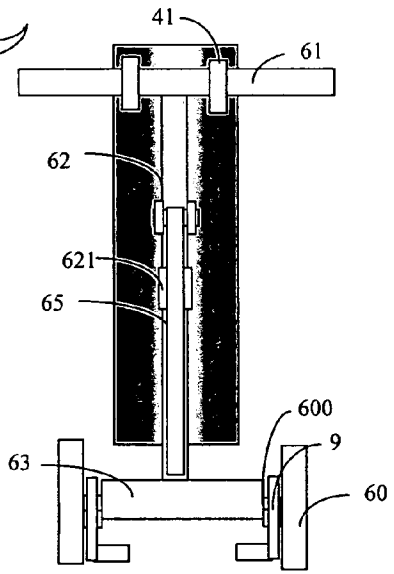
Figure 31D:
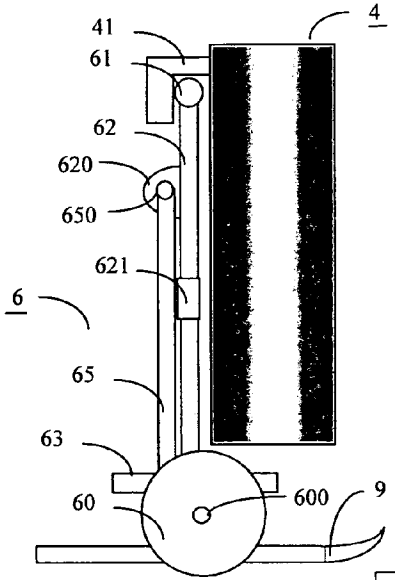
Figure 32A:
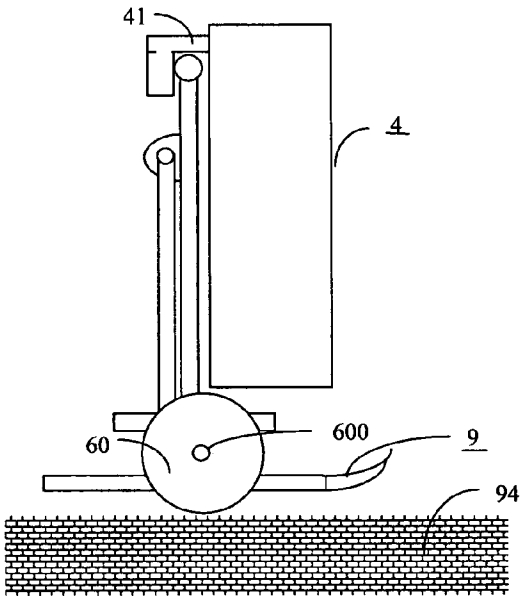
Figure 32C:
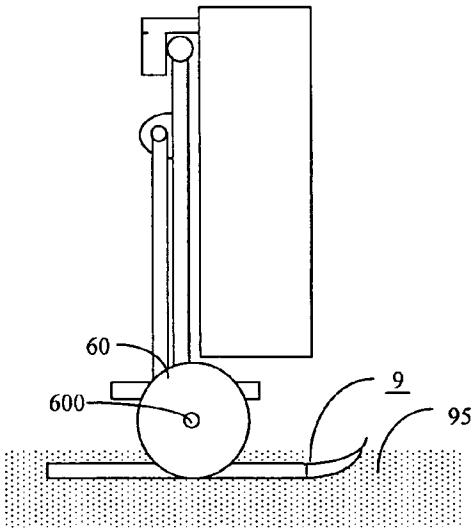
Figure 32B:
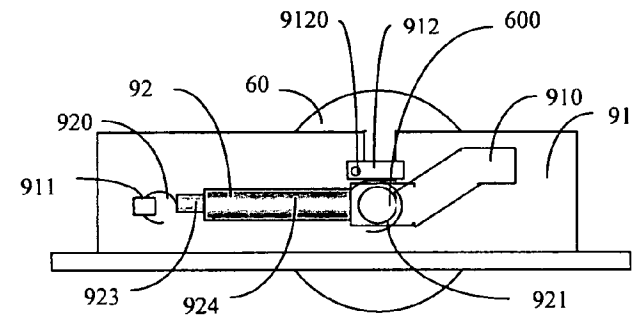
Figure 32D:
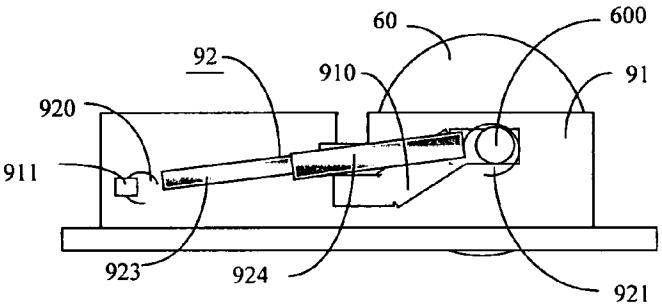
Figure 33A:
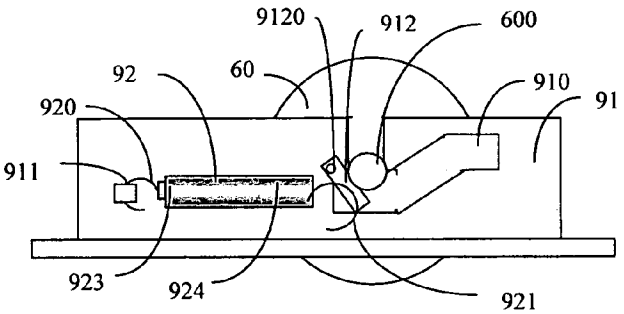
Figure 33B:
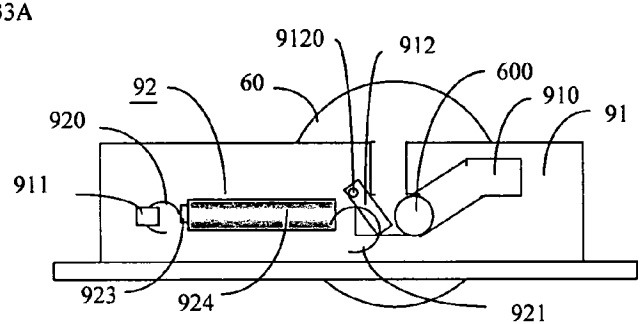
Figure 33C:
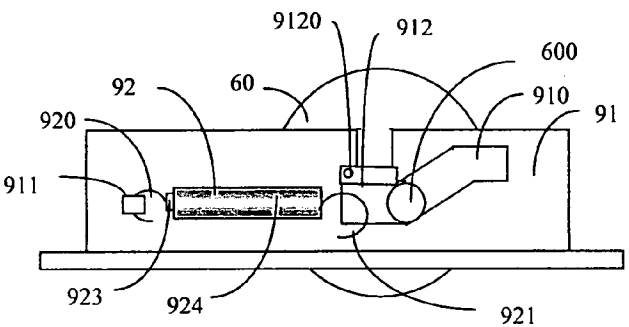
Figure 33D:
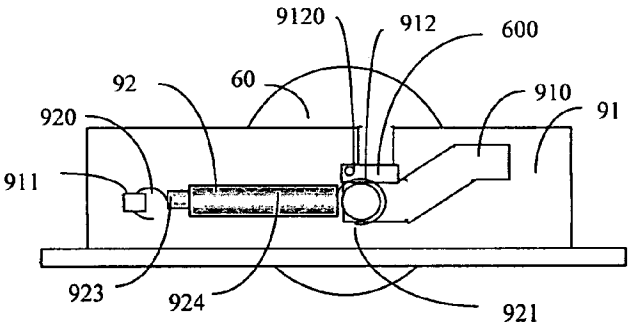

As shown in FIG. 30D to FIG. 30F, the golh cart 9 is further equipped with the automatic golh snow ski 9. As shown in FIG. 32A and FIG. 32B, the automatic golh snow ski 9 is raised up to run on the solid ground. As shown in FIG. 32C and FIG. 32D, the automatic golh ski 9 is lowered to support the weight of golh cart 9 to drive on the soft snow. The wheel can be changed to be the snow wheel 80*s*.

As shown in FIG. 32B, there is a Z-shape guiding slot 910 notched on the guiding plate 91. The wheel axle 600 passes through the Z-shape guiding slot 910. The spring 92 connects between the axle 600 and the ski 9 to pull the ski forward to raise the ski 9. The spring 92 is constituted of two segments 923 and 924. The segment 924 has the hooked end 921 to hook the axle 600. The segment 924 has the hooked end 920 to hook the ear 923 of the guiding board 91. Under the compression force of the spring 92, the guiding plate 91 is pulled forward to raise the ski 9 up.

As shown in FIG. 32C, the wheel rolls on the soft snow 95 and traps in the snow 95. The ski 9 contacts with the snow 95. As the wheel 60 rotates to drive the golh cart to move forward, due to friction, the ski 9 is left behind. The wheel axle 600 climbs up the slope of the Z-shape guiding slot 910 to force the ski 9 downward to engage with snow 95 to support the weight of golh carts.

FIG. 33 shows the installation of the snow ski without removing the wheel. As shown in FIG. 33A, the wheel axle 600 passes the slot and presses the locking plate 912 downward. The locking plate 912 is pivotally mounted on the guiding plate 91 with the pin 9120. FIG. 33B shows the axle 600 is mounted in the guiding slot 910. FIG. 33C shows the locking plate is closed with the biasing spring. FIG. 33D shows the hook 921 is attached to the axle 600 and the installation is finished. FIG. 34 shows the lower slot of Z-shape guiding slot can make the extension to be the guiding slot 910*e*. The snow ski 9 can be folded to integrate with the golh cart or golh trolley.

FIG. 31 shows the two-wheel golh cart. The golh cart is foldable and portable. Releasing the extension lock 621, the length of pole 62 can be adjusted. The pole 62 is foldable with the pivotal joint 630. The golh cart can be further innovated from the Segway of Dean L. Kamen et al U.S. Pat. No. 5,971,091 Transportation Vehicles and Methods and U.S. Pat. No. 6,302,230B1 Personal Mobility Vehicles and Methods. The supporting stick 65 is pivotally mounted on the frame 62 with the pivotal axle 650 passing the ear 620 of the frame 62. The two-wheel golher cart 6 is served as the standing bag as shown in FIG. 31B. The snow ski 9 can be mounted as shown in FIG. 32D, FIG. 32E and FIG. 32F. The wheel can be changed to be the snow wheel 8*s*, too.

Figure 38B:
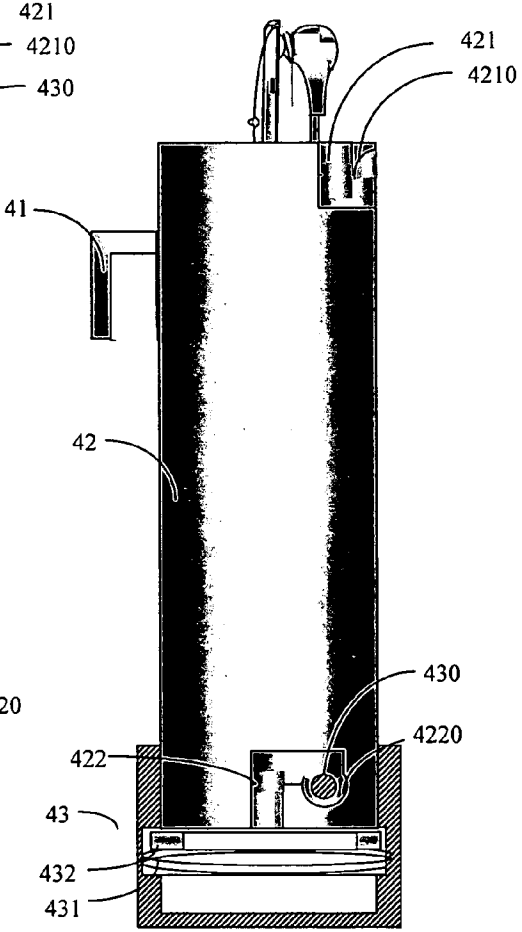
Figure 38A:
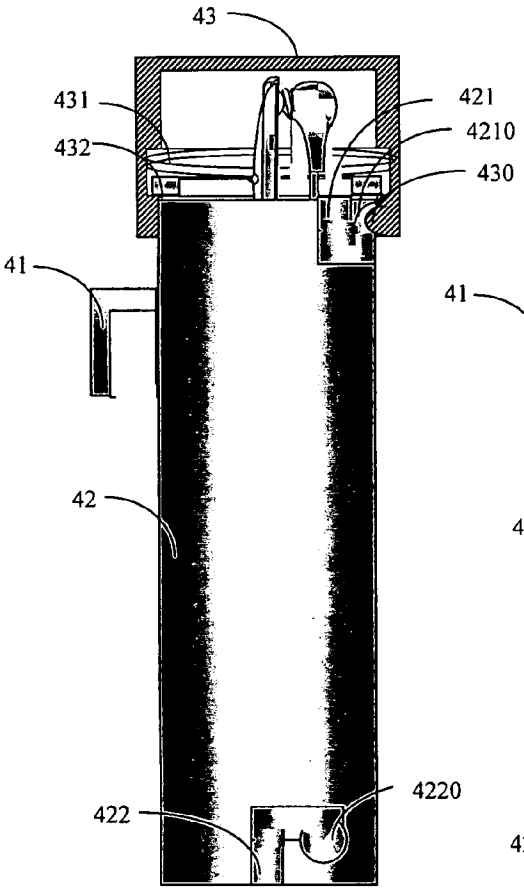

FIG. 38 shows the self-locked portable golh bag for traveling golher. As shown in FIG. 38A, the golh bag has the self-lock cap 43 being self-locked with the golh bag 42. The handle 41 is to carry the golh bag 42 or to hang the golh bag 42 on the golh cart as shown in FIG. 30. Under the biasing spring 431, the pressing plate 432 presses against the top rim of the golh bag 42. Under this pressure, the protrude 430 is locked in the notch 4210. To open the golh bag, pressing the cap 43 downward, the protuberance 430 moves downward to slide in the slot 421. Rotating the cap 43, slides the protuberance 430 to the slot 421 end. Lifting up the cap 43, the golh bag 42 is opened. As shown FIG. 38B, the cap 43 can be held at the bottom of golh bag 42 to facilitate the carry of the golh bag 42. Slide the protrude 430 into the vertical segment of the slot 422 and press the cap 43 upward. As the protrude hits the end of the vertical segment, rotate the cap 43 horizontally to the end. Under the biasing force of the spring 431, the pressing plate biases against the bottom plate of the golh bag 42. Under the biasing force, the protrude 430 is fitted in the notch 422. The self-locked cap 43 is self-locked to the bottom of the golh bag 42.

To play the basedisc, we need the portable base. To play the golh in the park, we need the portable-putting hole. As shown in the FIG. 39, it shows the universal portable hole base. It can be used as either the base in the basedisc or the putting hole in the park golh. The rolling golf ball can roll upward on the inclined plane 452 and the plateau 451 into the hole 450. The flag 46 has the flag 461 to mark the number of the hole. The flag is inserted in the hole 450 of the base 45 with the stub 460 fitting inside the hole 450.

Now the flying disk technology is comparable with the golf technology. The long-drive champion record for the golf ball is about 1236 feet. The hand-throw Aerobee Ring has the flying range record to be 1,333 feet. Therefore, the golfball and flying disk can be compatible to share the same golf course. Furthermore, we make the innovation for golfrisbee. The golfrisbee will make the flying disk flying higher and longer distance. With the golfrisbee, golh club and professional training with the golh swing trainer, almost all the people can launch the golfrisbee as well as and as far as the long drive of golf ball.

However, the way of golh swing is different from the way of golf swinging. There is the golh swing trainer to train the golfer to be the golher. The golf swing trainer provides guidance for the correct way of the swing of the golf club. Our golh swing trainer not only guides the swing path but also guides the swing speed and swing acceleration. The golher swing trainer integrates both the weight training and swing training in the same swing trainer.

Figure 40A:
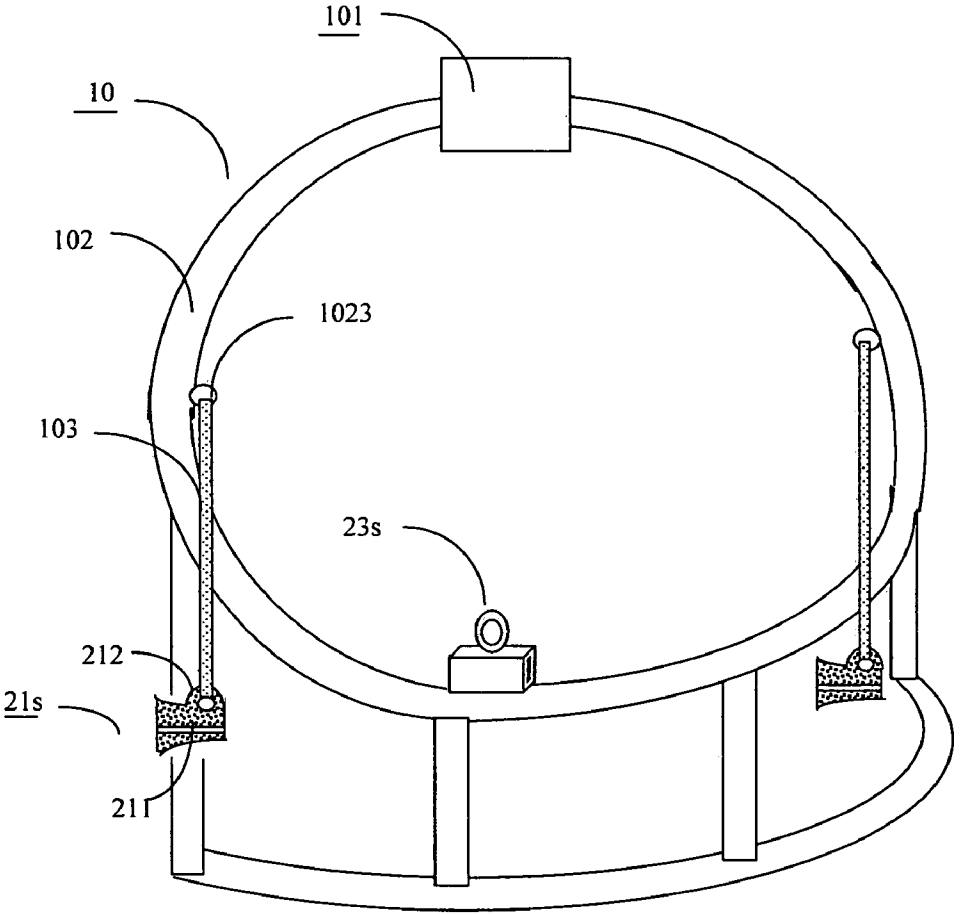
Figure 40C:
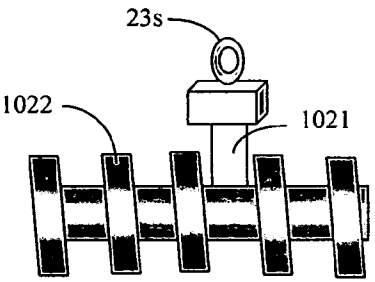
Figure 40D:
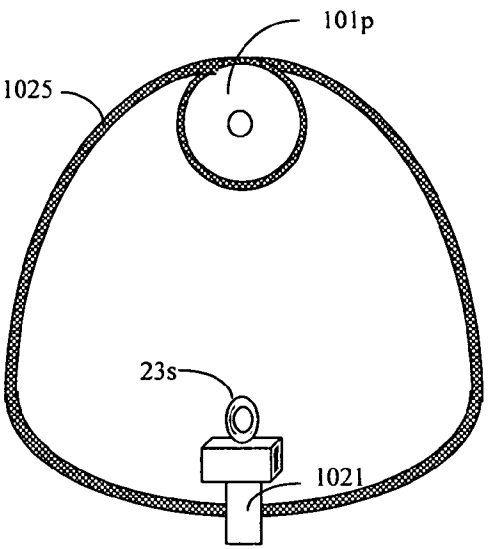
Figure 40B:
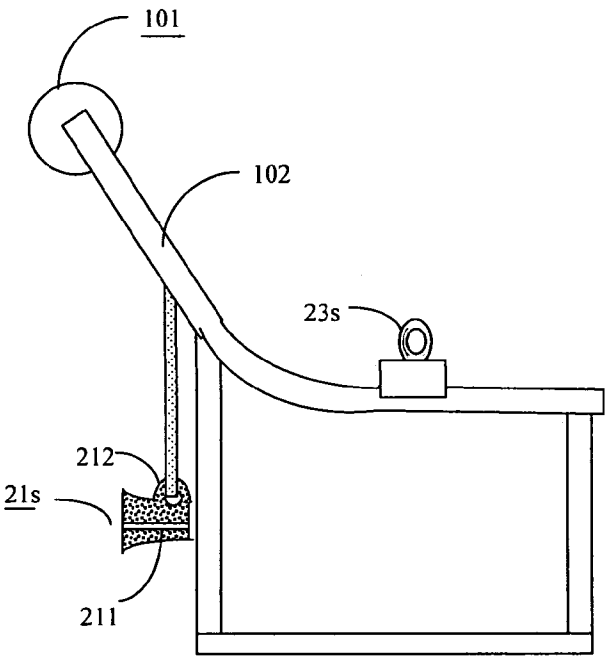

The swing of golh is different from the swing of golf. To launch the golfrisbee with the golh club, the swing speed and the swing pattern is very important. To train the golher to be familiar with the swing way of golh, as shown in FIG. 40, the golh swing trainer 10 is important for the golh instructor. The golher stands inside the golher trainer and has the golher club 2 fit inside the swing glider 23*s* as the same position as the payload 23 shown in FIG. 8. The handle 21*s* is fit at the position 21 shown in FIG. 8. The Computer aided golh instructor 101 drives the solenoid tube 1022 located inside the tube 102 to rotate to drive the gliding stub 1021 and the swing glider 23*s* to slide. The swing glider 23*s* is to guide the correct swing speed of the golh club. In FIG. 40D, it shows the alternative design of the guide. As the pulley 101*p* pulls the rope 1025, the guide 23*s* slides to move to guide the correct swing speed.

The golh simulator 41 is the miniature of the portable wheel balance machine. Instead of balancing the wheel, we apply the same principle and mechanism to measure the rotation of the golfrisbee 1. The golher can easily check the simulating results of flying distance, launching angle, launching speed, and flying direction on the LCD screen. Furthermore, the golher can adjust the parameter of the viscosity of the lubricant, the starting angle, the launching angle of the screw, etc to find the optimum swing pattern for himself. With the golher simulator, the golher does not need to go through the tedious launching and walking, trial and error process and improve his techniques systematically.

FIG. 41 is the golh simulator 11. The golfrisbee 1 is mounted on the rubber wheel head 111. The rubber 1111 envelops around the steel drum 1110 to be the rubber head. Any golfrisbee cap 3 can easily fit on the rubber wheel head 111. As the golher swings the golher club, the sensors 113 and microprocessor 114 of balance mechanism record and analyze the dynamical behaviors of the golfrisbee. The dynamics results are shown on the LCD display. The LCD display 112 is mounted on pole of the golf club.

Figure 42A:
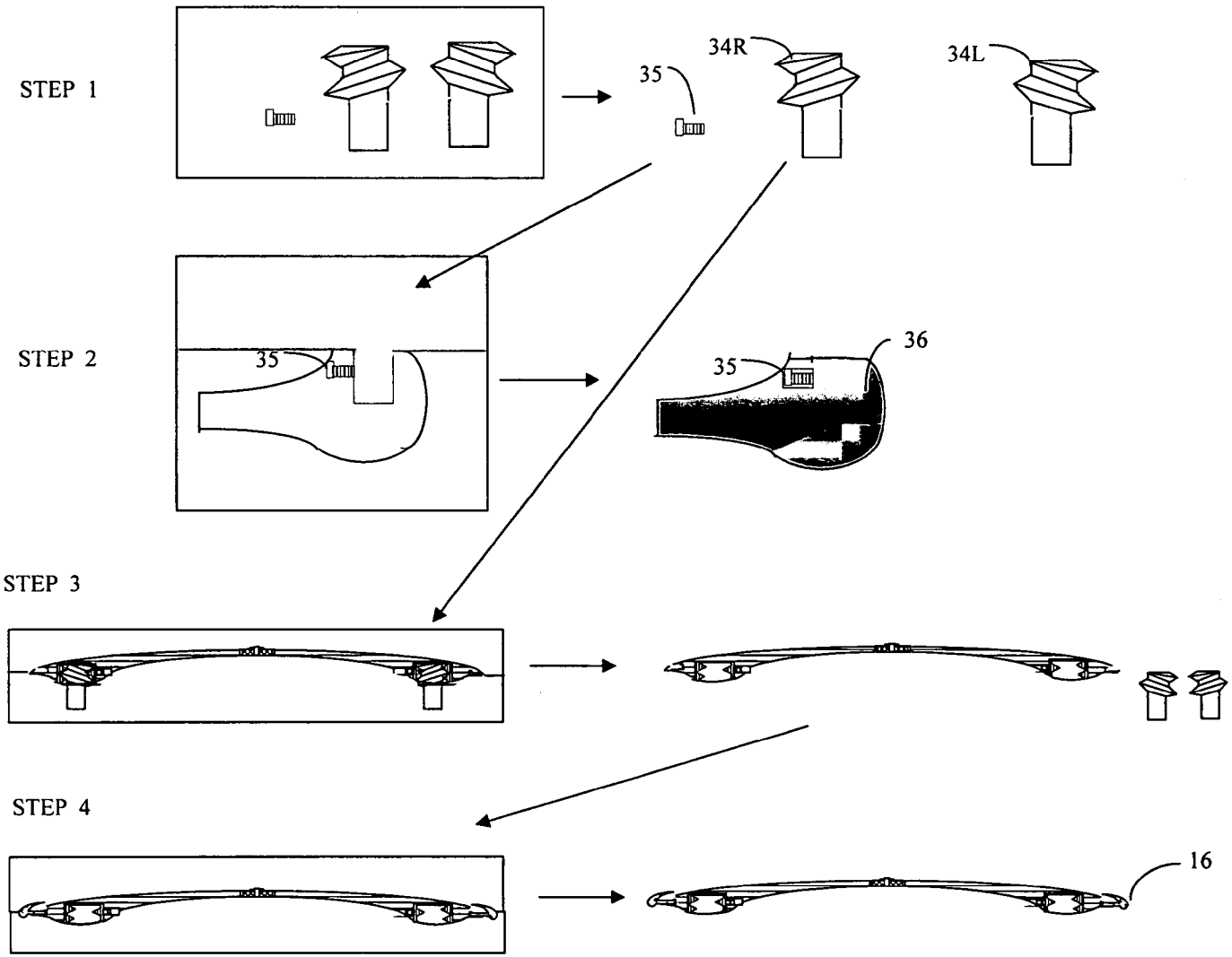

The golfrisbee is made of the composite material to be one single piece. Furthermore, the golfrisbee has the screw. Therefore, the mass production manufacture process is very important to the golh industry. As shown in FIG. 42A, the manufacture of making golh club and golfrisbee module is highly complicated four-step process. In the first step, the golh club head locking screw 35, launching stubs 34 R and 34L are casted with model. As shown in step 2, the locking screw 35 is put in the club head module to cast the golh head with the locking screw 35. As shown in step 3, the launching stubs 34 R and 34L are put in the golfrisbee module to cast the golfrisbee with the launching screws. As shown in step 4, the golfrisbee is put in the skirt module to have the skirt 16 casted to be one unit with the golfrisbee 1.

Figure 42B:
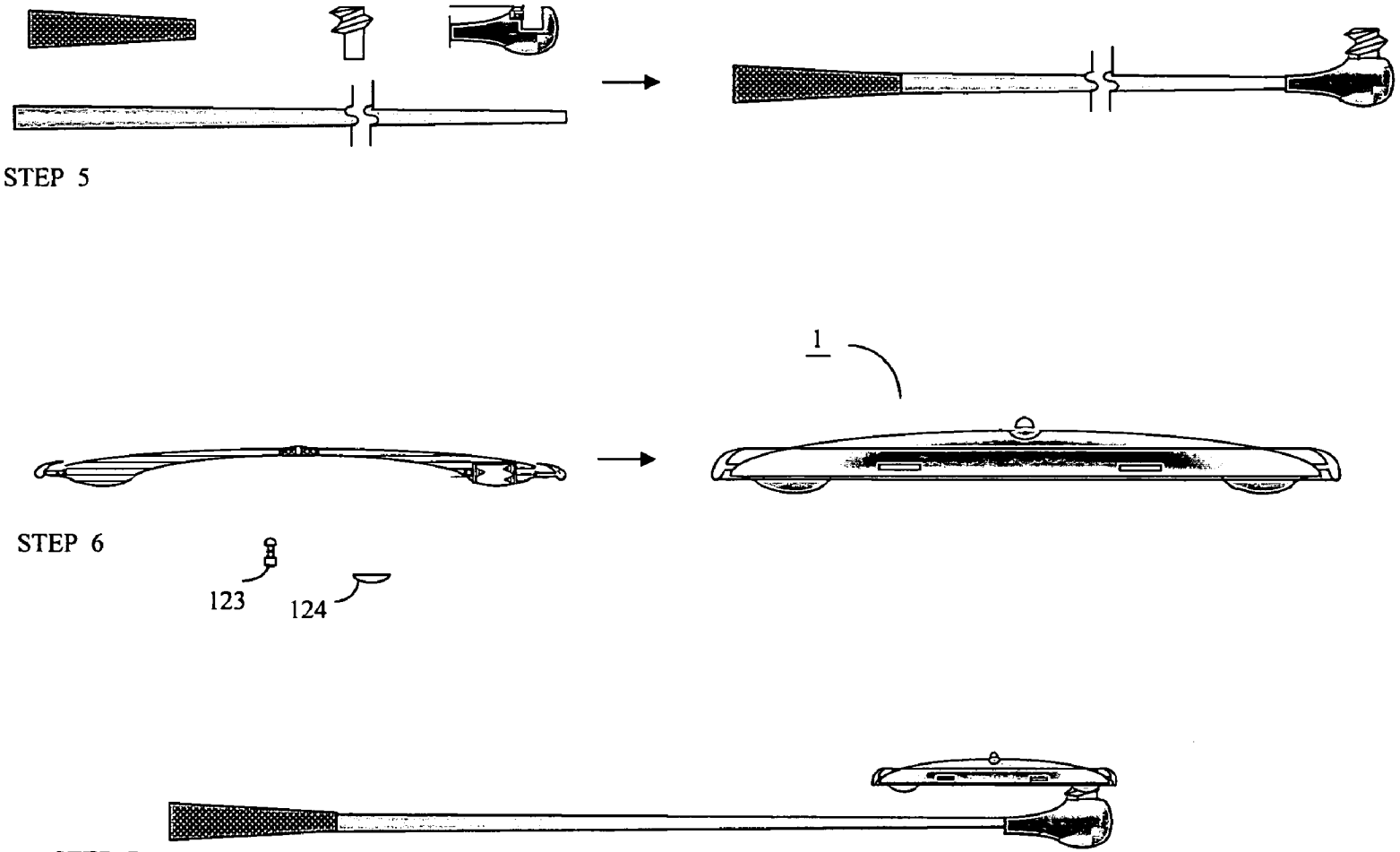

FIG. 42B shows the assembly process of the golh club and golfrisbee. In Step 5, the handle, golf club head, golf club pole and golf launching stub are assembled to be the golh club. In Step 6, the payload 124, screw 123 and golfrisbee body are assembled to be the golfrisbee 1. In step 7, the golfrisbee 1 is mounted on the launching screw stub and is ready for launching test. The detailed production process and flow are discussed in details as follows.

As shown in FIG. 23F, the golfrisbee is made of two materials. The skirt 16 material is made of the soft material 16*s* as shown in FIG. 46. The main plane 1*m* material is made of the elastic material 1*me* as shown in FIG. 43. It adopted the double injection plastic modules as shown in FIG. 43 and FIG. 46. As shown in FIG. 44, the golfrisbee 1 is made of three materials. It adopted the triple injection plastic modules as shown in FIG. 43 and FIG. 46. To minimize the air drag, as shown in FIG. 43, the callouts show the details of the curvatures for the stubs which support the skirt 16.

Figure 43B:
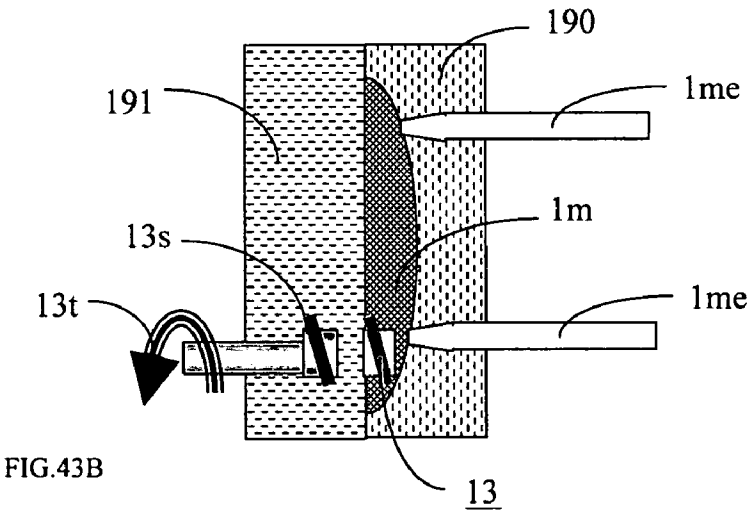
Figure 43A:
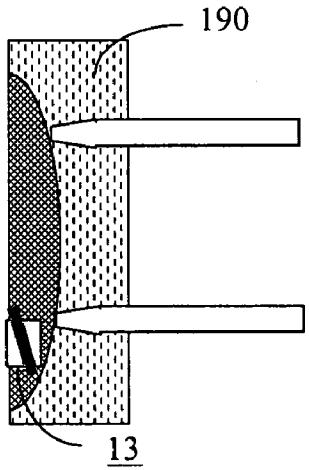
Figure 43A:
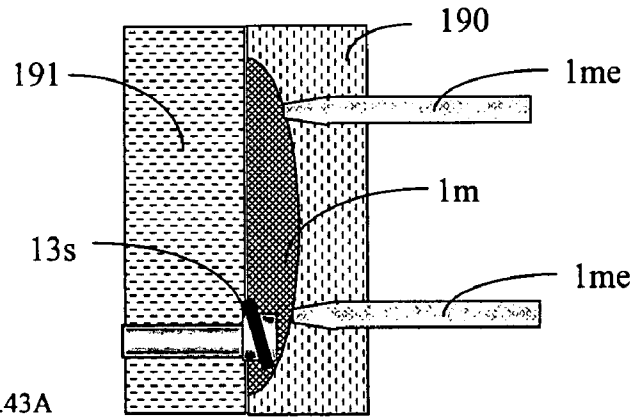
Figure 43C:
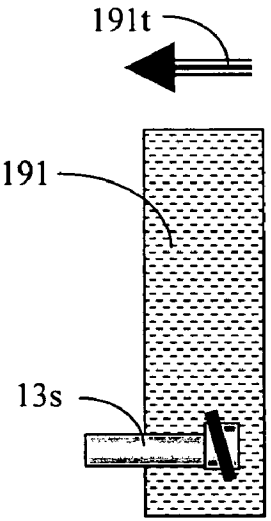

During the plastic module injection, to generate the screw 13 of the golfrisbee 1, it must rotate to retrieve the screwed module head 13*s*. The rotation of the screwed module head 13*s* will cause the distortion of the main plane 1*m* of the golfrisbee 1. To get rid of the distortion due to the rotation of the screwed module head 13*s*, there is the need for the special module injection process. A plastic injection module for the flying object comprises a screw module 13*s* and a main plane cavity module 190, said screw module 13*s* rotates to retrieve from said main plane cavity module 190 before said plastic injection modules 190 and 191 are open. As shown in FIG. 43A, as the modules 190 and 191 close, the elastic plastics 1*me* is injected into the cavity of the main plane 1*m*. After the plastic injection, the screwed module head 13*s* rotates and retrieves from the cavity as shown in FIG. 43B. The modules 190 and 191 still close and press on the injected plastic main plain 1*m* to release the stress on the main plane 1*m* with the residue heat of the plastic injection and keep the main plane 1*m* in the original shape. After the main plane 1*m* is hardened, then the module 191 opens as shown by the arrow 191*t*.

Figure 45A:
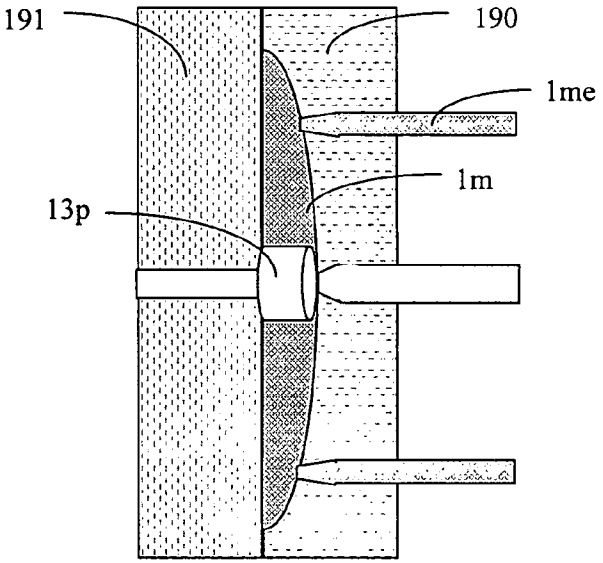
Figure 45B:
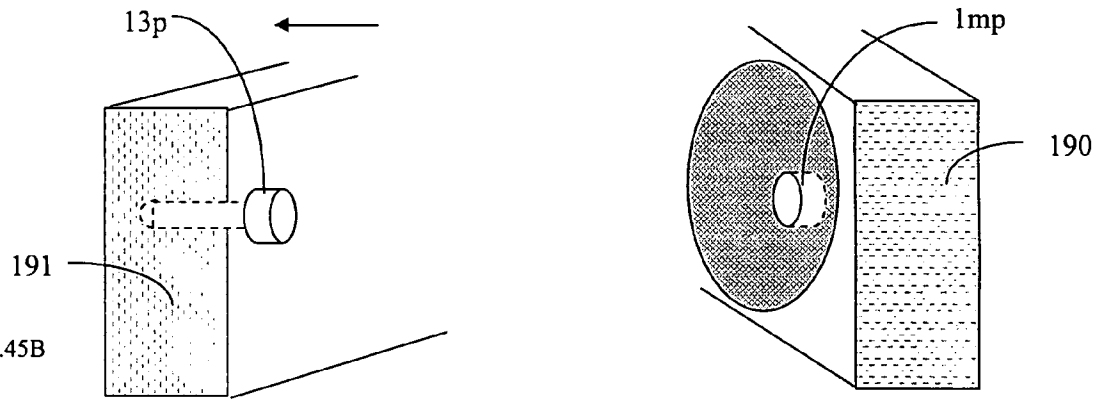
Figure 45C:
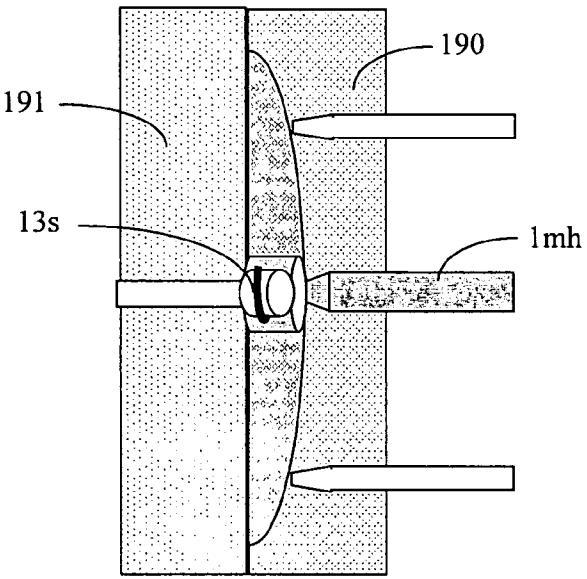
Figure 45D:
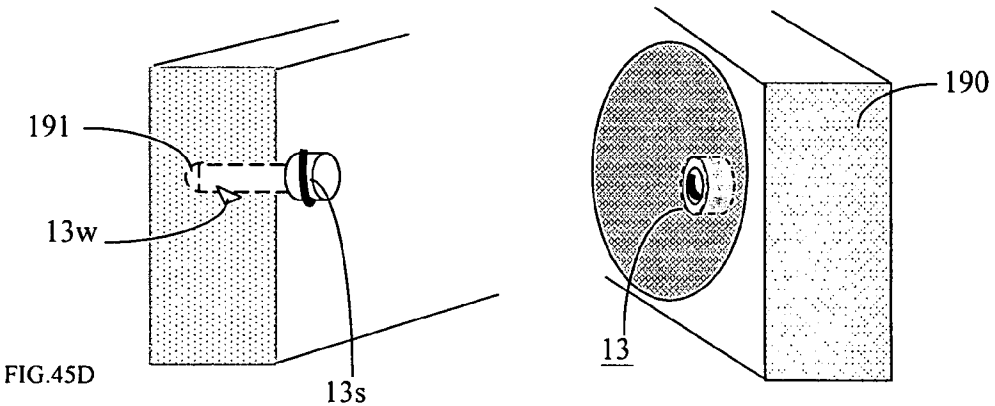

To increase the life of the golfrisbee 1, as shown in FIG. 44, the screw bore 13 is made of the hard plastic material. The screw 134 is in the shape of dual half ring. The golfrisbee is constituted of three kinds of material: the soft skirt 16, the elastic main plane 1*m* and the hard screw 13. The composite golfrisbee 1 adopts the triple plastic injection process. To reduce the air drag, as shown in FIG. 44C, the skirt support 161 envelops the edge of the main plane 1*m*. There are smooth transition curves between the skirt 16 and the main plane 1*m*. As shown in FIG. 45A, the pore 13*p* reserves a hole imp as the elastic material 1*me* is injected for the main plane 1*m*. As shown in FIG. 45B, the modules are separated and the hole 1*mp* is formed in the main plane 1*m*. Then the hard plastic 1*mh* is injected and the screwed module head 13*s* is inserted in the reserved pore as shown in FIG. 45C. As shown in FIG. 45D, the screw module head rotates and retrieves, then the modules 190 and 191 open. The hard female screw 13 is formed.

As shown in FIG. 46A, the soft plastic 16*s* is injected for the skirt 16. As the module 190 and 191 open, the complete golfrisbee 1 is done. It notes that the soft plastic 16*s* injection can be integrated with either FIG. 43 or FIG. 44 to have the double injection or triple injection to minimize the production cost.

As the golfrisbee is large and flat for the long throwing distance, the distortion of plastic injection becomes problem. To overcome the shrinkage distortion in plastic injection, as shown in FIG. 47, the backbone plate 1*mk* is embedded in the golfrisbee disk or golfrisbee ring. The screw 13 is integrated with the backbone plate 1*mk*. As shown in FIG. 48, the backbone plate 1*mk* and screw 13 are injected with the hard plastic material 1*mh* such as polycarbonate. Then the backbone plate 1*mk* with the screw 13 is put in the cavity to be injected and enwrapped with the elastic plastic material injection 1*me* such as rubber. The high technology and high performance golfrisbee is made of the composite material with the complex manufacturing process.

The golh sport is to swivel the golh club to launch the golfrisbee to fly into the golfrisbee disk. The golher having the less number of swivels score will be the winner. The golh sport comprises the three key technologies of golh club, golfrisbee disk and the golfrisbee basket. While the invention has been particularly shown and described with reference to the preferred embodiments thereof, it will be understood by those skilled in the art that various changes in form and details may be made therein without departing from the spirit and scope of the invention.

We claim:

1. A golh sport means comprises swiveling club means, flying object means, said swiveling club means comprising a swinging pole means and a fitting head means; said head means being at an end of said pole means;

said flying object means having a center of gravity, as said flying object means flying in sky being rotating with said center of gravity as an axis that said center of gravity being referred being a rotational axis of said flying object means;

said flying object being pivotally mounted on said fitting head means with an adaptive means, an pivotally rotational axis of said fitting head being an pivotal axis of said flying object means;

said rotational axis of said flying object means and said pivotal axis of said flying object means being not coincident to be eccentric to have a distance between said rotational axis of said flying object means and said pivotal axis of said flying object to be eccentric;

said flying object means having said rotational axis being eccentric to said pivotal axis and pivotally mounted on said head means of said swiveling club means with an mounting adaptor means, rotating said flying object means that said flying object means being engaged through a mounting fit means with said head means of said club means;

swiveling said swiveling club means, due to said rotational axis being eccentric to said pivotal axis, said flying object means pivotally rotating in a reverse direction on said head means due to initial force and being followed by an eccentric force of a swing of said swiveling of said swiveling club means, said flying object means disengaging with said head of said swiveling club and being detached from said head means of said swiveling club means and being launched to fly toward a target means;

said flying object means flying in a plan which in parallel to a swiveling plan of said swiveling club means to minimize drag force on said flying object means to have long range flying distance.

2. A golh sport means according to claim 1, said flying object means comprises a plurality of flying direction wing, said a plurality flying direction wing having a bi-directional flying wing section to be an overlap of a section of a forward direction flying wing and a section of backward direction flying wing;

there being smooth transitional curves between said section of said forward direction flying wing and said section of backward direction flying wing;

a section of said flying object having section of said bi-directional flying wing having an envelop being an union of a wing section being made of said transitional curve, said forward direction flying wing and section of backward direction flying wing.

3. A golh sport means according to claim 1 comprising a plurality of said target means, said target means comprises a plural of wind-bell-chain means and a hanging cap means, said wind-bell-chain means comprising a plural of sound generating tube means being hang on a hanging string means hanging beneath said cap means;

said tube means further comprising a hitting pan means, hanging fork means and sound generating cylinder means;

said cylinder means dangling on said fork means;

said fork means being supported by said pan means;

said pan means clamping on said string means;

said tube means being aligned successfully on said string means;

said pan means of which said tube means locating at a lower position being in a bottom position inside said cylinder of which said tube means locating at an upper position;

as said cap swinging, said cylinder means of tube means at upper position dangling and hitting on said pan of said tube means at lower position, harmonic sound being generated from said hitting action.

4. A golh sport means according to claim 1 of which swiveling club means and flying object means further comprising a direction controlling lock-and-release engaging means in a flying rotational plan of rotating flight of said flying object, said adaptor means of said flying object mounting on said adapting fit means of said head at an release position, then rotating said flying object means, said adaptor means of said flying object means being engaged with said adapting fit means of said club in said lock position of said engaging means in said flying rotational plan of said flying object;

swiveling said club means, said flying object means rotating due to eccentric force of said eccentrically mounted flying object, said rotating in a reverse direction of said rotating of said lock position, said rotating in a reverse direction making said engaging means of said flying object being in release position;

in said releasing position of said engaging means, the flying object being launched to fly.

5. A golh sport means according to claim 4 of which said direction controlling lock-and-release engaging means is a screw means;

said adapting screw means of said flying object means being mounted on a fitting screw means of said head of said club means, rotating said flying object means, said screw means of said flying object means being engaged with said screw means of said head means of said club means;

swiveling said club means, said flying object means being rotated in a reverse rotating direction, due to an eccentric force of said eccentrically mounted flying object, said screw means being in a released position and said flying object means being launched to fly.

6. A golh sport means according to claim 5 of which said screw means being constituted of a dual semi-circle screw, said dual semi-circle screw of said flying object being mounted on said dual semi-circle screw on said head means of club means, rotating said flying object in a half cycle, said dual semi-circle of said flying object being locked with said dual semi-circle screw of said head means of club means;

swiveling said club means, said flying object being rotated in a reverse rotating direction half cycle due to an eccentric force of said eccentrically mounted flying object, said flying object being in a releasing position and said flying object means being launched to fly.

7. A golh sport means according to claim 5 of which said screw means in said flying object being a female screw; and said screw means on said head means of said club means being a male screw, said female screw being mounted on said male screw, rotating said flying object means, said female screw being engaged with said male screw;

swiveling said club means, said flying object rotating in a reverse rotation direction and said female screw being disengaged with said male screw, said flying object being released and launching to fly.

8. A golh sport means according to claim 4 of which said head means further comprising an adjusting lock means to adjust an angular position of said direction controlling lock-and-release engaging means;

releasing said lock means, said direction controlling lock-and-release engaging means being able to rotate to adjust for a narrow window of angular position to have an optimum launch for said flying object;

tightening said lock means to fix said angular position of said direction controlling lock-and-release engaging means, then swiveling said club means, said flying object being released to launch to fly, repeating above processes for said direction controlling lock angular position-and-release engaging means, until an optimum of a farthest throwing distance being reached.

9. A golh sport means according to claim 7 of which said female screw further comprise a compact lighting light means and sound generating sound means, said light means and said sound means being located at a middle of said female screw, screws being notched at a peripheral of said female screw;

said male screw having a pore in a middle portion at a top of said male screw to adapt said light means and said sound means;

said light means and said sound means indicating flying path and final landing place in night golh and snow golh.

10. A golh sport means according to claim 1 of which said flying object means being composed of composite material of soft wrapping means and hard framing backbone means to form an aerodynamic airfoil means;

said mounting adaptor means of said flying object means being integrated with said backbone means of said flying object means;

said wrapping means wrapping around said backbone means at edges of said flying object means;

said wrapping means and said backbone means being constituted a smooth shape of said aerodynamic airfoil means.

11. A flying object means according to claim 1 of which said flying wing being a plural wing segments being constituted of airfoil segment of slat means, airfoil segment of main wing means and airfoil segment of flap means, said slat means being at front of said main wing means; said flap means being at back of said main wing means;

said plural flying direction wing being an overlap of said flying forward direction of a plural wing segments with flying backward direction of a plural wing segments plus sections made of smooth transitional curves between said two plural wing segments;

said overlap being with following ways of said flap means of said forward direction wing being overlapped with said slat means of said backward direction wing, said slat means of said forward direction wing being overlapped with said flap means of said backward direction wing and said main wing of said forward direction wing being overlapped with said main wing or said backward direction wing, an overlapping flap with slat being a slotted skirt means.

12. A target means according to claim 3 further comprises an reverted umbrella basket means, said basket means further comprising a plural of L-shaped ribs pivotally mounted a framing ring means, one short end of said L-shaped ribs biasing against a wall of said ring, said ring means being hanged beneath said wind-bell-chain means with low ends of said string means of said wind-bell-chain means, as said ribs contracting to be a bundle, said target means being portable.

13. A target means according to claim 3 of which hanging cap means is supported on a supporting pole with a universal swing type joint means, said joint means being at top of said pole;

said joint means being beneath said cap;

said cap means free swinging on said joint means in any direction, said cylinders of said wind-bell-chain hitting on said pans to generate harmonic sound.

14. A target means according to claim 3 of which hanging cap means further comprises light means, said light being in an interior side of said wind-bell-chain to be protected by said wind-bell-chain;

said light means shining light on said wind-bell-chains means for night golh.

15. A golh sport means according to claim 1 of which said flying object is a throwing golfball means, said golfball comprising a throwing ball means, a shooting stick means and a pivotal mounting adaptor means;

said ball means being at one end of said stick means, said adaptor means being at another end of said stick means;

as said golfball means being pivotally mounted on said club means, swiveling said club means, said golfball means rotating due to an eccentric force generated by said ball and said golfball means being thrown to fly.

16. A golh sport means according to claim 1 of which said flying object is a flying disk type golfrisbee means, said golfrisbee means being in disk shape having said adaptor means being eccentric;

said eccentric having said golfrisbee to mount eccentrically on said head means of said club means;

swiveling said club means, said golfrisbee means rotating due to said eccentric of said adaptor means; an eccentric force generating due to said eccentric position of said adaptor means on said golfrisbee means, said golfrisbee being launched to fly with gyroscopic rotational satiability for long range flight.

17. A golh sport means according to claim 1 of which said flying object is a flying ring type golfring means, said golfring being in a ring shape, said adaptor means being on said ring of golfring;

said adaptor means being eccentric to the ring, swiveling said club means, said golfring means rotating due to said eccentric of said adaptor means; an eccentric force generating due to said eccentric of said adaptor means, said golfring means being launched to fly with gyroscopic rotation to stabilize said golfring for a long rang flight.

18. A golh sport means according to claim 1 of which said flying object is a flying boomerang means, said boomerang being constituted of a plural of branches being joined together at one end;

said adaptor being eccentric on said boomerang;

swiveling said club means, said boomerang means rotating due to said eccentric of said adaptor means; an eccentric force generating due to said eccentric of said adaptor means, said boomerang being launched to fly with rotation to make curved flight path for odd number of branches; even number and symmetric branches boomerang making straight flight path.

19. A golh sport means according to claim 1 of which said flying object is a polygon means said polygon being constituted of a plural of branches with ends being jointed together successfully;

said adaptor being eccentric on said polygon;

swiveling said club means, said polygon means rotating due to said eccentric of said adaptor means; an eccentric force generating due to said eccentric of said adaptor means, said polygon means being launched to fly with gyroscopic rotation, odd number edges polygon making curved flight path, even number edges polygon making straight flight path.

20. A golh sport means according to claim 1 of which said bead of club means further comprising a dust cover to protect said head means for said flying object means from muddy as said heads means putt a ball means on ground, said head having a plural of latch means;

said dust cover having a plural of latch means;

said latch means of said head being interlaced and interlocked with latch means of said dust cover as said dust cover being in position with head;

as said flying object means not being mounted on said head means, putting said dust cover on said head means, as said dust cover mounting on said head and sliding sideward, said dust cover being locked with said head of said club means.

* * * * *